US011309175B2

(12) United States Patent
Hoyes et al.

(10) Patent No.: US 11,309,175 B2
(45) Date of Patent: Apr. 19, 2022

(54) MULTI-REFLECTING TIME-OF-FLIGHT MASS SPECTROMETERS

(71) Applicants: Micromass UK Limited, Wilmslow (GB); Leco Corporation, St. Joseph, MI (US)

(72) Inventors: John Brian Hoyes, Stockport (GB); Anatoly Verenchikov, City of Bar (ME)

(73) Assignees: Micromass UK Limited, Wilmslow (GB); Leco Corporation, St. Joseph, MI (US)

( * ) Notice: Subject to any disclaimer, the term of this patent is extended or adjusted under 35 U.S.C. 154(b) by 0 days.

(21) Appl. No.: 16/611,145

(22) PCT Filed: May 4, 2018

(86) PCT No.: PCT/GB2018/051206

§ 371 (c)(1),
(2) Date: Nov. 5, 2019

(87) PCT Pub. No.: WO2018/203082

PCT Pub. Date: Nov. 8, 2018

(65) Prior Publication Data

US 2020/0083034 A1 Mar. 12, 2020

(30) Foreign Application Priority Data

May 5, 2017 (GB) ..... 1707208

(51) Int. Cl.
*H01J 49/40* (2006.01)

(52) U.S. Cl.
CPC ..... *H01J 49/406* (2013.01); *H01J 49/403* (2013.01); *H01J 49/408* (2013.01)

(58) Field of Classification Search
CPC ..... H01J 49/40; H01J 49/403; H01J 49/406; H01J 49/408
See application file for complete search history.

(56) References Cited

U.S. PATENT DOCUMENTS

| | | | |
|---|---|---|---|
| 3,898,452 | A | 8/1975 | Hertel |
| 4,390,784 | A | 6/1983 | Browning et al. |
| 4,691,160 | A | 9/1987 | Ino |
| 4,731,532 | A | 3/1988 | Frey et al. |

(Continued)

FOREIGN PATENT DOCUMENTS

| | | | |
|---|---|---|---|
| CA | 2412657 | A1 | 5/2003 |
| CN | 101369510 | A | 2/2009 |

(Continued)

OTHER PUBLICATIONS

International Preliminary Report on Patentability for International application No. PCT/GB2018/051206, dated Nov. 5, 2019, 7 pages.

(Continued)

*Primary Examiner* — David E Smith

(57) ABSTRACT

A multi-reflecting time of flight mass analyser is disclosed in which the ion flight path is maintained relatively small and the duty cycle is made relatively high. Spatial focusing of the ions in the dimension (z-dimension) in which the mirrors (36) are elongated can be eliminated whilst maintaining a reasonably high sensitivity and resolution.

18 Claims, 26 Drawing Sheets

(56) References Cited

U.S. PATENT DOCUMENTS 4,855,595 A 8/1989 Blanchard
5,017,780 A 5/1991 Kutscher et al.
5,107,109 A 4/1992 Stafford, Jr. et al.
5,128,543 A 7/1992 Reed et al.
5,202,563 A 4/1993 Cotter et al.
5,331,158 A 7/1994 Dowell
5,367,162 A 11/1994 Holland et al.
5,396,065 A 3/1995 Myerholtz et al.
5,435,309 A 7/1995 Thomas et al.
5,464,985 A 11/1995 Cornish et al.
5,619,034 A 4/1997 Reed et al.
5,654,544 A 8/1997 Dresch
5,689,111 A 11/1997 Dresch et al.
5,696,375 A 12/1997 Park et al.
5,719,392 A 2/1998 Franzen
5,763,878 A 6/1998 Franzen
5,777,326 A 7/1998 Rockwood et al.
5,834,771 A 11/1998 Yoon et al.
5,847,385 A 12/1998 Dresch
5,869,829 A 2/1999 Dresch
5,955,730 A 9/1999 Kerley et al.
5,994,695 A 11/1999 Young
6,002,122 A 12/1999 Wolf
6,013,913 A 1/2000 Hanson
6,020,586 A 2/2000 Dresch et al.
6,080,985 A 6/2000 Welkie et al.
6,107,625 A 8/2000 Park
6,160,256 A 12/2000 Ishihara
6,198,096 B1 3/2001 Le Cocq
6,229,142 B1 5/2001 Bateman et al.
6,271,917 B1 8/2001 Hagler
6,300,626 B1 10/2001 Brock et al.
6,316,768 B1 11/2001 Rockwood et al.
6,337,482 B1 1/2002 Francke
6,384,410 B1 5/2002 Kawato
6,393,367 B1 5/2002 Tang et al.
6,437,325 B1 8/2002 Reilly et al.
6,455,845 B1 9/2002 Li et al.
6,469,295 B1 10/2002 Park
6,489,610 B1 12/2002 Barofsky et al.
6,504,148 B1 1/2003 Hager
6,504,150 B1 * 1/2003 Verentchikov ..... H01J 49/164 250/281
6,534,764 B1 3/2003 Verentchikov et al.
6,545,268 B1 4/2003 Verentchikov et al.
6,570,152 B1 5/2003 Hoyes
6,576,895 B1 6/2003 Park
6,580,070 B2 6/2003 Cornish et al.
6,591,121 B1 7/2003 Madarasz et al.
6,614,020 B2 9/2003 Cornish
6,627,877 B1 9/2003 Davis et al.
6,646,252 B1 11/2003 Gonin
6,647,347 B1 11/2003 Roushall et al.
6,664,545 B2 12/2003 Kimmel et al.
6,683,299 B2 1/2004 Fuhrer et al.
6,694,284 B1 2/2004 Nikoonahad et al.
6,717,132 B2 4/2004 Franzen
6,734,968 B1 5/2004 Wang et al.
6,737,642 B2 5/2004 Syage et al.
6,744,040 B2 6/2004 Park
6,744,042 B2 6/2004 Zajfman et al.
6,747,271 B2 6/2004 Gonin et al.
6,770,870 B2 8/2004 Vestal
6,782,342 B2 8/2004 LeGore et al.
6,787,760 B2 9/2004 Belay et al.
6,794,643 B2 9/2004 Russ, IV et al.
6,804,003 B1 10/2004 Wang et al.
6,815,673 B2 11/2004 Plomley et al.
6,833,544 B1 12/2004 Campbell et al.
6,836,742 B2 12/2004 Brekenfeld
6,841,936 B2 1/2005 Keller et al.
6,861,645 B2 3/2005 Franzen
6,864,479 B1 3/2005 Davis et al.
6,870,156 B2 3/2005 Rather
6,870,157 B1 3/2005 Zare
6,872,938 B2 3/2005 Makarov et al.
6,888,130 B1 5/2005 Gonin
6,900,431 B2 5/2005 Belov et al.
6,906,320 B2 6/2005 Sachs et al.
6,940,066 B2 9/2005 Makarov et al.
6,949,736 B2 9/2005 Ishihara
7,034,292 B1 4/2006 Whitehouse et al.
7,071,464 B2 7/2006 Reinhold
7,084,393 B2 8/2006 Fuhrer et al.
7,091,479 B2 8/2006 Hayek
7,126,114 B2 10/2006 Chernushevich
7,196,324 B2 3/2007 Verentchikov
7,217,919 B2 5/2007 Boyle et al.
7,221,251 B2 5/2007 Menegoli et al.
7,326,925 B2 2/2008 Verentchikov et al.
7,351,958 B2 4/2008 Vestal
7,365,313 B2 4/2008 Fuhrer et al.
7,385,187 B2 6/2008 Verentchikov et al.
7,388,197 B2 6/2008 McLean et al.
7,399,957 B2 7/2008 Parker et al.
7,423,259 B2 9/2008 Hidalgo et al.
7,498,569 B2 3/2009 Ding
7,501,621 B2 3/2009 Willis et al.
7,504,620 B2 3/2009 Sato et al.
7,521,671 B2 4/2009 Kirihara et al.
7,541,576 B2 6/2009 Belay et al.
7,582,864 B2 9/2009 Verentchikov
7,608,817 B2 10/2009 Flory
7,663,100 B2 2/2010 Vestal
7,675,031 B2 3/2010 Konicek et al.
7,709,789 B2 5/2010 Vestal et al.
7,728,289 B2 6/2010 Naya et al.
7,745,780 B2 6/2010 McLean et al.
7,755,036 B2 7/2010 Satoh
7,772,547 B2 8/2010 Verentchikov
7,800,054 B2 9/2010 Fuhrer et al.
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov
7,985,950 B2 7/2011 Makarov et al.
7,989,759 B2 8/2011 Holle
7,999,223 B2 8/2011 Makarov et al.
8,017,907 B2 9/2011 Willis et al.
8,017,909 B2 9/2011 Makarov et al.
8,063,360 B2 11/2011 Willis et al.
8,080,782 B2 12/2011 Hidalgo et al.
8,093,554 B2 1/2012 Makarov
8,237,111 B2 8/2012 Golikov et al.
8,354,634 B2 1/2013 Green et al.
8,373,120 B2 2/2013 Verentchikov
8,395,115 B2 3/2013 Makarov et al.
8,492,710 B2 7/2013 Fuhrer et al.
8,513,594 B2 8/2013 Makarov
8,633,436 B2 1/2014 Ugarov
8,637,815 B2 1/2014 Makarov et al.
8,642,948 B2 2/2014 Makarov et al.
8,642,951 B2 2/2014 Li
8,648,294 B2 2/2014 Prather et al.
8,653,446 B1 2/2014 Mordehai et al.
8,658,984 B2 2/2014 Makarov et al.
8,680,481 B2 3/2014 Giannakopulos et al.
8,723,108 B1 5/2014 Ugarov
8,735,818 B2 5/2014 Kovtoun et al.
8,772,708 B2 7/2014 Kinugawa et al.
8,785,845 B2 7/2014 Loboda
8,847,155 B2 9/2014 Vestal
8,853,623 B2 10/2014 Verenchikov
8,884,220 B2 11/2014 Hoyes et al.
8,921,772 B2 12/2014 Verenchikov
8,952,325 B2 2/2015 Giles et al.
8,957,369 B2 2/2015 Makarov
8,975,592 B2 3/2015 Kobayashi et al.
9,048,080 B2 6/2015 Verenchikov et al.
9,082,597 B2 7/2015 Willis et al.
9,082,604 B2 7/2015 Verenchikov
9,099,287 B2 8/2015 Giannakopulos
9,136,101 B2 9/2015 Grinfeld et al.

(56) References Cited

U.S. PATENT DOCUMENTS 9,147,563 B2 9/2015 Makarov
9,196,469 B2 11/2015 Makarov
9,207,206 B2 12/2015 Makarov
9,214,322 B2 12/2015 Kholomeev et al.
9,214,328 B2 12/2015 Hoyes et al.
9,281,175 B2 3/2016 Haufler et al.
9,312,119 B2 4/2016 Verenchikov
9,324,544 B2 4/2016 Rather
9,373,490 B1 6/2016 Nishiguchi et al.
9,396,922 B2 7/2016 Verenchikov et al.
9,417,211 B2 8/2016 Verenchikov
9,425,034 B2 8/2016 Verentchikov et al.
9,472,390 B2 10/2016 Verenchikov et al.
9,514,922 B2 12/2016 Watanabe et al.
9,576,778 B2 2/2017 Wang
9,595,431 B2 3/2017 Verenchikov
9,673,033 B2 6/2017 Grinfeld et al.
9,679,758 B2 6/2017 Grinfeld et al.
9,683,963 B2 6/2017 Verenchikov
9,728,384 B2 8/2017 Verenchikov
9,779,923 B2 10/2017 Verenchikov
9,786,484 B2 10/2017 Willis et al.
9,786,485 B2 10/2017 Ding et al.
9,865,441 B2 1/2018 Damoc et al.
9,865,445 B2 1/2018 Verenchikov et al.
9,870,903 B2 1/2018 Richardson et al.
9,870,906 B1 1/2018 Quarmby et al.
9,881,780 B2 1/2018 Verenchikov et al.
9,899,201 B1 2/2018 Park
9,922,812 B2 3/2018 Makarov
9,941,107 B2 4/2018 Verenchikov
9,972,483 B2 5/2018 Makarov
10,006,892 B2 6/2018 Verenchikov
10,037,873 B2 7/2018 Wang et al.
10,141,175 B2 11/2018 Verentchikov et al.
10,141,176 B2 11/2018 Stewart et al.
10,163,616 B2 12/2018 Verenchikov et al.
10,186,411 B2 1/2019 Makarov
10,192,723 B2 1/2019 Verenchikov et al.
10,290,480 B2 5/2019 Crowell et al.
10,373,815 B2 8/2019 Crowell et al.
10,388,503 B2 8/2019 Brown et al.
10,593,525 B2 3/2020 Hock et al.
10,593,533 B2 3/2020 Hoyes et al.
10,622,203 B2 4/2020 Veryovkin
10,629,425 B2 4/2020 Hoyes et al.
10,636,646 B2 4/2020 Hoyes et al.
2001/0011703 A1 8/2001 Framzen
2001/0030284 A1 10/2001 Dresch et al.
2002/0030159 A1 3/2002 Chernushevich et al.
2002/0107660 A1 8/2002 Nikoonahad et al.
2002/0190199 A1 12/2002 Li et al.
2003/0010907 A1 1/2003 Hayek et al.
2003/0111597 A1 6/2003 Gonin et al.
2003/0232445 A1 12/2003 Fulghum
2004/0026613 A1 2/2004 Bateman et al.
2004/0084613 A1 5/2004 Bateman et al.
2004/0108453 A1 6/2004 Kobayashi et al.
2004/0119012 A1 6/2004 Vestal
2004/0144918 A1 7/2004 Zare et al.
2004/0155187 A1 8/2004 Axelsson
2004/0159782 A1 8/2004 Park
2004/0183007 A1 9/2004 Belov et al.
2005/0006577 A1 1/2005 Fuhrer et al.
2005/0040326 A1 2/2005 Enke
2005/0103992 A1 5/2005 Yamaguchi et al.
2005/0133712 A1 6/2005 Belov et al.
2005/0151075 A1 7/2005 Brown et al.
2005/0194528 A1 9/2005 Yamaguchi et al.
2005/0242279 A1 11/2005 Verentchikov
2005/0258364 A1 11/2005 Whitehouse et al.
2006/0169882 A1 8/2006 Pau et al.
2006/0214100 A1 9/2006 Verentchikov et al.
2006/0289746 A1 12/2006 Raznikov et al.
2007/0023645 A1 2/2007 Chernushevich
2007/0029473 A1 2/2007 Verentchikov
2007/0176090 A1 8/2007 Verentchikov
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0203288 A1 8/2008 Makarov et al.
2008/0290269 A1 11/2008 Saito et al.
2009/0090861 A1 4/2009 Willis et al.
2009/0114808 A1 5/2009 Bateman et al.
2009/0206250 A1 8/2009 Wollnik
2009/0250607 A1 10/2009 Staats et al.
2009/0272890 A1 11/2009 Ogawa et al.
2009/0294658 A1 12/2009 Vestal et al.
2009/0314934 A1 12/2009 Brown
2010/0001180 A1 1/2010 Bateman et al.
2010/0044558 A1* 2/2010 Sudakov ..... H01J 49/406 250/281
2010/0072363 A1 3/2010 Giles et al.
2010/0078551 A1 4/2010 Loboda
2010/0140469 A1 6/2010 Nishiguchi
2010/0193682 A1 8/2010 Golikov et al.
2010/0207023 A1 8/2010 Loboda
2010/0301202 A1 12/2010 Vestal
2011/0133073 A1 6/2011 Sato et al.
2011/0168880 A1* 7/2011 Ristroph ..... H01J 49/406 250/282
2011/0180702 A1 7/2011 Flory et al.
2011/0180705 A1 7/2011 Yamaguchi
2011/0186729 A1 8/2011 Verentchikov et al.
2012/0168618 A1 7/2012 Vestal
2012/0261570 A1 10/2012 Shvartsburg et al.
2012/0298853 A1 11/2012 Kurulugama
2013/0056627 A1* 3/2013 Verenchikov ..... H01J 49/06 250/282
2013/0068942 A1 3/2013 Verenchikay
2013/0187044 A1 7/2013 Ding et al.
2013/0240725 A1 9/2013 Makarov
2013/0248702 A1 9/2013 Makarov
2013/0256524 A1* 10/2013 Brown ..... H01J 49/067 250/282
2013/0313424 A1 11/2013 Makaray et al.
2013/0327935 A1 12/2013 Wiedenbeck
2014/0054454 A1 2/2014 Hoyes et al.
2014/0054456 A1 2/2014 Kinugawa et al.
2014/0084156 A1 3/2014 Ristroph et al.
2014/0117226 A1 5/2014 Gainnakopulos
2014/0138538 A1 5/2014 Hieftje et al.
2014/0183354 A1 7/2014 Moon et al.
2014/0191123 A1 7/2014 Wildgoose et al.
2014/0217275 A1* 8/2014 Ding ..... H01J 49/4245 250/282
2014/0246575 A1 9/2014 Langridge et al.
2014/0291503 A1 10/2014 Shchepunov et al.
2014/0312221 A1 10/2014 Verenchikov et al.
2014/0361162 A1 12/2014 Murray et al.
2015/0028197 A1 1/2015 Grinfeld et al.
2015/0028198 A1 1/2015 Grinfeld et al.
2015/0034814 A1 2/2015 Brown et al.
2015/0048245 A1 2/2015 Vestal et al.
2015/0060656 A1 3/2015 Ugarov
2015/0122986 A1 5/2015 Haase
2015/0194296 A1 7/2015 Verenchikov et al.
2015/0228467 A1 8/2015 Grinfeld et al.
2015/0279650 A1 10/2015 Verenchikov
2015/0294849 A1 10/2015 Makarov et al.
2015/0318156 A1 11/2015 Loyd et al.
2015/0364309 A1 12/2015 Welkie
2015/0380233 A1 12/2015 Verenchikov
2016/0005587 A1 1/2016 Verenchikov
2016/0035552 A1* 2/2016 Verenchikov ..... H01J 49/0031 250/282
2016/0035558 A1* 2/2016 Verenchikov ..... H01J 49/406 250/287
2016/0079052 A1 3/2016 Makarov
2016/0225598 A1 8/2016 Ristroph
2016/0225602 A1 8/2016 Ristroph et al.
2016/0240363 A1 8/2016 Verenchikov
2017/0025265 A1 1/2017 Verenchikov et al.

(56) References Cited

U.S. PATENT DOCUMENTS

| | | | |
|---|---|---|---|
| 2017/0032952 | A1 | 2/2017 | Verenchikov |
| 2017/0098533 | A1 | 4/2017 | Stewart et al. |
| 2017/0168031 | A1 | 6/2017 | Verenchikov |
| 2017/0229297 | A1 | 8/2017 | Green et al. |
| 2017/0338094 | A1 | 11/2017 | Verenchikov et al. |
| 2018/0144921 | A1 | 5/2018 | Hoyes et al. |
| 2018/0315589 | A1 | 11/2018 | Oshiro |
| 2018/0366312 | A1 | 12/2018 | Hamish et al. |
| 2019/0180998 | A1 | 6/2019 | Stewart et al. |
| 2019/0206669 | A1 | 7/2019 | Verenchikov et al. |
| 2019/0237318 | A1 | 8/2019 | Brown |
| 2019/0360981 | A1 | 11/2019 | Verenchikov |
| 2020/0083034 | A1 | 3/2020 | Hoyes et al. |
| 2020/0090919 | A1 | 3/2020 | Artaev et al. |
| 2020/0126781 | A1 | 4/2020 | Kovtoun |
| 2020/0152440 | A1 | 5/2020 | Hoyes et al. |
| 2020/0168447 | A1 | 5/2020 | Verenchikov |
| 2020/0168448 | A1 | 5/2020 | Verenchikov et al. |
| 2020/0243322 | A1 | 7/2020 | Stewart et al. |
| 2020/0373142 | A1 | 11/2020 | Verenchikov |
| 2020/0373143 | A1 | 11/2020 | Verenchikov et al. |
| 2020/0373145 | A1 | 11/2020 | Verenchikov et al. |

FOREIGN PATENT DOCUMENTS

| | | | |
|---|---|---|---|
| CN | 102131563 | A | 7/2011 |
| CN | 201946564 | U | 8/2011 |
| DE | 4310106 | C1 | 10/1994 |
| DE | 10116536 | A | 10/2002 |
| DE | 102015121830 | A1 | 6/2017 |
| DE | 102019129108 | A1 | 6/2020 |
| DE | 112015001542 | B4 | 7/2020 |
| EP | 3237259 | A2 | 9/1987 |
| EP | 1137044 | A2 | 9/2001 |
| EP | 1566828 | A2 | 8/2005 |
| EP | 1901332 | A1 | 3/2008 |
| EP | 2068346 | A2 | 6/2009 |
| EP | 1665326 | B1 | 4/2010 |
| EP | 1789987 | A4 | 9/2010 |
| EP | 1522087 | B1 | 3/2011 |
| EP | 2599104 | A1 | 6/2013 |
| EP | 1743354 | B1 | 8/2019 |
| EP | 3662501 | A1 | 6/2020 |
| EP | 3662502 | A1 | 6/2020 |
| EP | 3662503 | A1 | 6/2020 |
| GB | 2080021 | A | 1/1982 |
| GB | 2217907 | A | 11/1989 |
| GB | 2300296 | A | 10/1996 |
| GB | 2390935 | A | 1/2004 |
| GB | 2396742 | A | 6/2004 |
| GB | 2403063 | A | 12/2004 |
| GB | 2455977 | A | 7/2009 |
| GB | 2476964 | A | 7/2011 |
| GB | 2478300 | A | 9/2011 |
| GB | 2484361 | B | 4/2012 |
| GB | 2484429 | B | 4/2012 |
| GB | 2485825 | A | 5/2012 |
| GB | 2489094 | A | 9/2012 |
| GB | 2490571 | A | 11/2012 |
| GB | 2495127 | A | 4/2013 |
| GB | 2495221 | A | 4/2013 |
| GB | 2496991 | A | 5/2013 |
| GB | 2496994 | A | 5/2013 |
| GB | 2500743 | A | 10/2013 |
| GB | 2501332 | A | 10/2013 |
| GB | 2506362 | A | 4/2014 |
| GB | 2528875 | A | 2/2016 |
| GB | 2555609 | A | 5/2018 |
| GB | 2556451 | A | 5/2018 |
| GB | 2556830 | A | 6/2018 |
| GB | 2562990 | A | 12/2018 |
| GB | 2575157 | A | 1/2020 |
| GB | 2575339 | A | 1/2020 |
| JP | 36229049 | A | 2/1987 |
| JP | 2000036285 | A | 2/2000 |
| JP | 2000048764 | A | 2/2000 |
| JP | 2003031178 | A | 1/2003 |
| JP | 3571546 | B2 | 9/2004 |
| JP | 2005538346 | A | 12/2005 |
| JP | 2006049273 | A | 2/2006 |
| JP | 2007227042 | A | 9/2007 |
| JP | 2010062152 | A | 3/2010 |
| JP | 4649234 | B2 | 3/2011 |
| JP | 2011119279 | A | 6/2011 |
| JP | 4806214 | B2 | 11/2011 |
| JP | 2013539590 | A | 10/2013 |
| JP | 5555582 | B2 | 7/2014 |
| JP | 2015506567 | A | 3/2015 |
| NO | 2019030474 | A1 | 2/2019 |
| RU | 2564443 | C2 | 10/2015 |
| RU | 2015148627 | A | 5/2017 |
| SU | 198034 | A1 | 8/1967 |
| SU | 1681340 | A1 | 9/1991 |
| SU | 1725289 | A1 | 4/1992 |
| WO | 1998008244 | A2 | 2/1987 |
| WO | 3103071 | A1 | 3/1991 |
| WO | 1998001218 | A1 | 1/1998 |
| WO | 200077823 | A2 | 12/2000 |
| WO | 2005001878 | A2 | 1/2005 |
| WO | 2005043575 | A2 | 5/2005 |
| WO | 2006049623 | A2 | 5/2006 |
| WO | 2006102430 | A2 | 9/2006 |
| WO | 2006103448 | A2 | 10/2006 |
| WO | 2007044696 | A1 | 4/2007 |
| WO | 2007104992 | A2 | 9/2007 |
| WO | 2007136373 | A1 | 11/2007 |
| WO | 2008046594 | A2 | 4/2008 |
| WO | 2008087389 | A2 | 7/2008 |
| WO | 2010008386 | A1 | 1/2010 |
| WO | 2010138781 | A2 | 12/2010 |
| WO | 2011086430 | A1 | 7/2011 |
| WO | 2011107836 | A1 | 9/2011 |
| WO | 2012010894 | A1 | 1/2012 |
| WO | 2012013354 | A1 | 2/2012 |
| WO | 2012023031 | A2 | 2/2012 |
| WO | 2012024468 | A2 | 2/2012 |
| WO | 2012024570 | A2 | 2/2012 |
| WO | 2012116765 | A1 | 9/2012 |
| WO | 13045428 | A1 | 4/2013 |
| WO | 13063587 | A2 | 5/2013 |
| WO | 2013067366 | A2 | 5/2013 |
| WO | 13093587 | A1 | 6/2013 |
| WO | 2013098612 | A1 | 7/2013 |
| WO | 13110587 | A2 | 8/2013 |
| WO | 13124207 | A1 | 8/2013 |
| WO | 2013110588 | A2 | 8/2013 |
| WO | 2014021960 | A1 | 2/2014 |
| WO | 2014074822 | A1 | 5/2014 |
| WO | 2014110697 | A1 | 7/2014 |
| WO | 2014142897 | A1 | 9/2014 |
| WO | 2015142897 | A1 | 9/2015 |
| WO | 2015152968 | A1 | 10/2015 |
| WO | 2015153622 | A1 | 10/2015 |
| WO | 2015153630 | A1 | 10/2015 |
| WO | 2015153644 | A1 | 10/2015 |
| WO | 2015175988 | A1 | 11/2015 |
| WO | 2015189544 | A1 | 12/2015 |
| WO | 2016064398 | A1 | 4/2016 |
| WO | 2016174462 | A1 | 11/2016 |
| WO | 2016178029 | | 11/2016 |
| WO | 2018073589 | A1 | 4/2018 |
| WO | 2018109920 | A1 | 6/2018 |
| WO | 2018124861 | A2 | 7/2018 |
| WO | 2018183201 | A1 | 10/2018 |
| WO | 2019030472 | A1 | 2/2019 |
| WO | 2019030475 | A1 | 2/2019 |
| WO | 2019030476 | A1 | 2/2019 |
| WO | 2019030477 | A1 | 2/2019 |
| WO | 2019058226 | A1 | 3/2019 |
| WO | 2019162687 | A1 | 8/2019 |
| WO | 2019202338 | A1 | 10/2019 |
| WO | 2019229599 | A1 | 12/2019 |
| WO | 2020002940 | A1 | 1/2020 |

(56) References Cited

FOREIGN PATENT DOCUMENTS

| | | | |
|---|---|---|---|
| WO | 2020021255 | A1 | 1/2020 |
| WO | 2020121167 | A1 | 6/2020 |
| WO | 2020121168 | A1 | 6/2020 |

OTHER PUBLICATIONS

International Search Report and Written Opinion for International application No. PCT/GB2018/051206, dated Jul. 12, 2018, 9 pages.
Search Report Under Section 17(5) for Application No. GB1507363.8 dated Nov. 9, 2015.
International Search Report and Written Opinion of the International Search Authority for Application No. PCT/GB2016/051238 dated Jul. 12, 2016, 16 pages.
IPRP for application PCT/GB2016/051238 dated Oct. 31, 2017, 13 pages.
International Search Report and Written Opinion for International Application No. PCT/US2016/063076 dated Mar. 30, 2017, 9 pages.
Search Report for GB Application No. 1520540.4 dated May 25, 2016.
IPRP for application PCT/US2016/063076, dated May 29, 2018, 7 pages.
IPRP PCT/GB17/51981 dated Jan. 8, 2019, 7 pages.
Author unknown, "Electrostatic lens Wikipedia," Mar. 31, 2017 (Mar. 31, 2017), XP055518392, Retrieved from the Internet:URL: https://en.wikipedia.org/w/index.phptitle=Electrostatic_lens oldid=773161674 [retrieved on Oct. 24, 2018].
Hussein, O.A. et al., "Study the most favorable shapes of electrostatic quadrupole doublet lenselenses",AIP Conference Proceedings, vol. 1815, Feb. 17, 2017 (Feb. 17, 2017), p. 110003.
Kozlov, B. et al. "Enhanced Mass Accuracy in Multi-Reflecting TOF MS" www.Waters.com/Posters, ASMS Conference (2017).
Doroshenko, V.M., and Cotter, R.J., "Ideal velocity focusing in a reflectron time-of-flight mass spectrometer", American Society for Mass Spectrometry, 10(10):992-999 (1999).
Guan S., et al. "Stacked-ring electrostatic ion guide" Journal of the American Society for Mass Spectrometry, Elsevier Science Inc, 7(1):101-106 (1996).
International Search Report and Written Opinion for application No. PCT/GB2018/052104, dated Oct. 31, 2018, 14 pages.
International Search Report and Written Opinion for application No. PCT/GB2018/052105, dated Oct. 15, 2018, 18 pages.
International Search Report and Written Opinion for application PCT/GB2018/052102, dated Oct. 25, 2018, 14 pages.
International Search Report and Written Opinion for application No. PCT/GB2018/052099, dated Oct. 10, 2018, 16 pages.
International Search Report and Written Opinion for application No. PCT/GB2018/052101, dated Oct. 19, 2018, 15 pages.
Combined Search and Examination Report under Sections 17 and 18(3) for application GB1807605.9 dated Oct. 29, 2018, 5 pages.
Combined Search and Examination Report under Sections 17 and 18(3) for application GB1807626.5, dated Oct. 29, 2018, 7 pages.
Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.
Search Report under Section 17(5) for application GB1707208.3, dated Oct. 12, 2017, 5 pages.
Communication Relating to the Results of the Partial International Search for International Application No. PCT/GB2019/01118, dated Jul. 19, 2019, 25 pages.
International Search Report and Written Opinion for International Application No. PCT/GB2019/051839 dated Sep. 18, 2019.
International Search Report and Written Opinion for International Application No. PCT/US2016/062203 dated Mar. 6, 2017, 8 pages.
International Search Report and Written Opinion for application PCT/GB2018/052100, dated Oct. 19, 2018, 19 pages.
Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.
Combined Search and Examination Report for United Kingdom Application No. GB1901411.7 dated Jul. 31, 2019.
Examination Report for United Kingdom Application No. GB1618980.5 dated Jul. 25, 2019.
Combined Search and Examination Report for GB 1906258.7, dated Oct. 25, 2019.
Combined Search and Examination Report for GB1906253.8, dated Oct. 30, 2019, 5 pages.
Author unknown, "Einzel Lens", Wikipedia [online] Nov. 2020 [retrieved on Nov. 3, 2020]. Retrieved from Internet URL: https://en.wikipedia.org/wiki/Einze_lens, 2 pages.
International Search Report and Written Opinion for International application No. PCT/GB2019/051235, dated Sep. 25, 2019, 22 pages.
International Search Report and Written Opinion for International application No. PCT/GB2019/051416, dated Oct. 10, 2019, 22 pages.
Search and Examination Report under Sections 17 and 18(3) for Application No. GB1906258.7, dated Dec. 11, 2020, 7 pages.
International Search Report and Written Opinion for International Application No. PCT/US2016/062174 dated Mar. 3, 2017, 8 pages.
IPRP PCT/US2016/062174 dated May 22, 2018, 6 pages.
Search Report for GB Application No. GB1520130.4 dated May 25, 2016.
Search Report for GB Application No. GB1520134.6 dated May 26, 2016.
IPRP PCT/US2016/062203, dated May 22, 2018, 6 pages.
Barry Shaulis et al: "Signal linearity of an extended range pulse counting detector: Applications to accurate and precise U-Pb dating of zircon by laser ablation quadrupole ICP-MS", G3: Geochemistry, Geophysics, Geosystems, 11(11):1-12, Nov. 20, 2010.
Search Report for United Kingdom Application No. GB1708430.2 dated Nov. 28, 2017.
International Search Report and Written Opinion for International Application No. PCT/GB2018/051320 dated Aug. 1, 2018.
International Search Report and Written Opinion for International Application No. PCT/GB2019/051234 dated Jul. 29, 2019, 5 pages.
Extended European Search Report for EP Patent Application No. 16866997.6, dated Oct. 16, 2019.
Search Report under Section 17(5) for GB1916445.8, dated Jun. 15, 2020.
International Search Report and Written Opinion for International application No. PCT/GB2020/050209, dated Apr. 28, 2020, 12 pages.
Carey, D.C., "Why a second-order magnetic optical achromat works", Nucl. Instrum. Meth., 189(203):365-367 (1981) Abstract.
Sakurai, et al., "Ion optics for time-of-flight mass spectrometers with multiple symmetry", Int J Mass Spectrom Ion Proc 63:273-287 (1985) Abstract.
Wollnik, H., et al., "An energy-isochronous multi-pass time-of-flight mass spectrometer consisting of two coaxial electrostatic mirrors", Int J Mass Spectrom 227:217-222 (2003) Abstract.
Kozlov, B. et al. "Fast Ion Mobility Spectrometry and High Resolution TOF MS" ASMS Conference Poster (2014).
Verenchicov, A. N. "Parallel MS-MS Analysis in a Time-Flight Tandem. Problem Statement, Method, and Instrucmental Schemes" Institute for Analytical Instrumentation RAS, Saint-Petersburg, (2004) Abstract.
Yavor, M. I. "Planar Multireflection Time-of-Flight Mass Analyser with Unlimited Mass Range" Institute for Analytical Instrumentation RAS, Saint-Petersburg, (2004) Abstract.
Khasin, Y. I. et al. "Initial Experimenatl Studies of a Planar Multireflection Time-of-Flight Mass Spectrometer" Institute for Analytical Instrucmentation RAS, Saint-Petersburg, (2004) Abstract.
Verenchicov, A. N. et al. "Stability of Ion Motion in Periodic Electrostatic Fields" Institute for Analytical Instrucmentation RAS, Saint-Petersburg, (2004) Abstract.

(56) References Cited

OTHER PUBLICATIONS

Verenchicov., A. N. "The Concept of Multireflecting Mass Spectrometer for Continuous Ion Sources" Institute for Analytical Instrucmentation RAS, Saint-Petersburg, (2006) Abstract.
Verenchicov., A. N. et al. "Accurate Mass Measurements for Inerpreting Spectra of atmospheric Pressure Ionization" Institute for Analytical Instrucmentation RAS, Saint-Petersburg, (2006) Abstract.
Kozlov, B. N. et al., "Experimental Studies of Space Charge Effects in Multireflecting Time-of-Flight Mass Spectrometes" Institute for Analytical Instrucmentation RAS, Saint-Petersburg, (2006) Abstract.
Kozlov, B. N. et al., "Multireflecting Time-of-Flight Mass Spectrometer With an Ion Trap Source" Institute for Analytical Instrucmentation RAS, Saint-Petersburg, (2006) Abstract.
Hasin, Y. I., et al., "Planar Time-of-Flight Multireflecting Mass Spectrometer with an Orthogonal Ion Injection Out of Continuous Ion Sources" Institute for Analytical Instrucmentation RAS, Saint-Petersburg, (2006) Abstract.
Lutvinsky Y. I. et al., "Estimation of Capacity of High Resolution Mass Spectra for Analysis of Complex Mixtures" Institute for Analytical Instrucmentation RAS, Saint-Petersburg, (2006) Abstract.
Verenchicov., A. N. et al. "Multiplexing in Multi-Reflecting TOF MS" Journal of Applied Solution Chemistry and Modeling, 6:1-22 (2017).
Supplementary Partial EP Search Report for EP Application No. 16869126.9, dated Jun. 13, 2019.
Supplementary Partial EP Search Report for EP Application No. 16866997.6, dated Jun. 7, 2019.
"Reflectron—Wikipedia", Oct. 9, 2015, Retrieved from the Internet:URL:https://en.wikipedia.org/w/index.phptitle=Reflectron oldid=684843442 [retrieved on May 29, 2019].
Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.
International Search Report and Written Opinion for International Application No. PCT/EP2017/070508 dated Oct. 16, 2017, 17 pages.
Search Report for United Kingdom Application No. GB1613988.3 dated Jan. 5, 2017, 4 pages.
Sakurai et al., "A New Multi-Passage Time-of-Flight Mass Spectrometer at JAIST", Nuclear Instruments & Methods in Physics Research, Section A, Elsevier, 427(1-2): 182-186, May 11, 1999. Abstract.
Toyoda et al., "Multi-Turn-Time-of-Flight Mass Spectometers with Electrostatic Sectors", Journal of Mass Spectrometry, 38: 1125-1142, Jan. 1, 2003.
Stresau, D., et al.: "Ion Counting Beyond 10ghz Using a New Detector and Conventional Electronics", European Winter Conference on Plasma Spectrochemistry, Feb. 4-8, 2001, Lillehammer, Norway, Retrieved from the Internet: URL:https://www.etp-ms.com/file-repository/21[retrieved on Jul. 31, 2019].
Kaufmann, R., et al., "Sequencing of peptides in a time-of-flight mass spectrometer:evaluation of postsource decay following matrix-assisted laser desorption ionisation (MALDI)", International Journal of Mass Spectrometry and Ion Processes, Elsevier Scientific Publishing Co. Amsterdam, NL,131:355-385, Feb. 24, 1994.
Kozlov, B. et al. "High accuracy self-calibration method for high resolution mass spectra" ASMS Conference Abstract, 2019.
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Examination Report under Section 18(3) for Application No. GB1906258.7, dated May 5, 2021, 4 pages.
Guan S. et al. "Stacked-ring electrostatic ion guide" Journal of the American Society for Mass Spectrometry, Elsevier Science Inc, 7(1):101-106 (1996). Abstract.
O'Halloran, G.J., et al., "Determination of Chemical Species Prevalent in a Plasma Jet", Bendix Corp Report ASD-TDR-62-644, U.S. Air Force (1964). Abstract.
Collision Frequency, https://en.wikipedia.org/wiki/Collision_frequency accessed Aug. 17, 2021.
International Search Report and Written Opinion for International Application No. PCT/GB2020/050471, dated May 13, 2020, 9 pages.
Search Report for GB Application No. GB2002768.6 dated Jul. 7, 2020.
Search Report for GB Application No. GB 1903779.5, dated Sep. 20, 2019.

* cited by examiner

--Prior Art--

--Prior Art--

Fig. 5A (Rk=250K)

| | Varient # | 1 | 2 | 3 | 4 | 5 | 6 | 7 | 8 |
|---|---|---|---|---|---|---|---|---|---|
| | System size (mm) | 200x500 | | | | | | | |
| Param | Resolution, K | 10 | 14 | 20 | 27 | | 10 | 13 | 15 |
| | Duty Cycle | 21.3% | 14.9% | 9.8% | 5.7% | | 21.3% | 16.0% | 12.8% |
| | | | | | | | | | |
| Size | # of reflections | 2 | 3 | 4 | 5 | | 2 | 3 | 4 |
| | Length L, mm | 400 | 400 | 400 | 400 | | 400 | 400 | 400 |
| | Width W, mm | 150 | 150 | 150 | 150 | | 200 | 200 | 200 |
| | | | | | | | | | |
| TOF | Energy in TOF, eV | 9200 | 9200 | 9200 | 9200 | | 9200 | 9200 | 9200 |
| | V tof, mm/us | 42.90 | 42.90 | 42.90 | 42.90 | | 42.90 | 42.90 | 42.90 |
| | Leff, mm | 1200 | 1600 | 2000 | 2400 | | 1200 | 1600 | 2000 |
| | TOF, us | 28 | 37 | 47 | 56 | | 28 | 37 | 47 |
| | | | | | | | | | |
| Beam | Z energy, eV | 100 | 80 | 50 | 30 | | 100 | 100 | 100 |
| | V beam, mm/us | 4.47 | 4.00 | 3.16 | 2.45 | | 4.47 | 4.47 | 4.47 |
| Trajectory | Z step, mm | 42 | 37 | 29 | 23 | | 42 | 42 | 42 |
| | Inclination, mrad | 104 | 93 | 74 | 57 | | 104 | 104 | 104 |
| | Inclination, deg | 6.1 | 5.5 | 4.3 | 3.4 | | 6.1 | 6.1 | 6.1 |
| | Mirr Z edge, mm | 33 | 19 | 16 | 18 | | 58 | 37 | 17 |
| | | | | | | | | | |
| OA | beam d, mm | 1.2 | 1.2 | 1.2 | 1.2 | | 1.2 | 1.2 | 1.2 |
| | beam ang, mrad | 17 | 17 | 17 | 17 | | 17 | 17 | 17 |
| | OA length | 27 | 22 | 14 | 8 | | 27 | 27 | 27 |
| | OA time, us | 5.97 | 5.58 | 4.58 | 3.20 | | 5.97 | 5.97 | 5.97 |
| | Duty Cycle | 0.213 | 0.149 | 0.098 | 0.057 | | 0.213 | 0.160 | 0.128 |
| | | | | | | | | | |
| dK | Accelerator field, V/mm | 600 | 600 | 600 | 600 | | 600 | 600 | 580 |
| | dK, eV | 720 | 720 | 720 | 720 | | 720 | 720 | 696 |
| R(6%) | dK/K | 7.83% | 7.83% | 7.83% | 7.83% | | 7.83% | 7.83% | 7.57% |
| 250000 | Res(dK) | 86371 | 86371 | 86371 | 86371 | | 86371 | 86371 | 98914 |
| | dT(dK) | 0.16 | 0.22 | 0.27 | 0.32 | | 0.16 | 0.22 | 0.24 |
| | | | | | | | | | |
| Packets | Vx, m/s | 76.03 | 68.00 | 53.76 | 41.64 | | 76.03 | 76.03 | 76.03 |
| | Turn Around, ns | 1.27 | 1.13 | 0.90 | 0.69 | | 1.27 | 1.27 | 1.31 |
| | DAS and Det, ns | 0.7 | 0.7 | 0.7 | 0.7 | | 0.7 | 0.7 | 0.7 |
| | | | | | | | | | |
| Resolution | FWHM, ns | 1.46 | 1.35 | 1.17 | 1.04 | | 1.46 | 1.46 | 1.50 |
| | Resolution | 9603 | 13820 | 19949 | 26962 | | 9603 | 12742 | 15495 |
| | | | | | | | | | |
| Mesh | angle, mrad | 6.52 | 6.52 | 6.52 | 6.52 | | 6.52 | 6.52 | 6.30 |
| | Y spread, mm | 1.83 | 1.83 | 1.83 | 1.83 | | 1.83 | 1.83 | 1.77 |
| | | | | | | | | | |
| | | | | | | | | | |
| | Leff | 1.2 | 1.6 | 2 | 2.4 | | 1.2 | 1.6 | 2 |
| | Square | 0.1 | 0.1 | 0.1 | 0.1 | | 0.125 | 0.125 | 0.125 |
| | | | | | | | | | |
| | Resolution | 9603 | 13820 | 19949 | 26962 | | 9603 | 12742 | 15495 |
| | Duty Cycle | 0.213 | 0.149 | 0.098 | 0.057 | | 0.213 | 0.160 | 0.128 |
| | Transm OA | 1 | 1 | 1 | 0.6 | | 1 | 1 | 1 |
| | Res*DC*Transm | 2050 | 2066 | 1960 | 925.6 | | 2050 | 2040 | 1984 |

Fig. 5A (Cont. I)

| 9 | 10 | 11 | 12 | # | 14 | 15 | 16 | 17 | 18 | 20 | 21 |
|---|---|---|---|---|---|---|---|---|---|---|---|
| 250x500 | | | | | 250x700 | | | | | | |
| | | | | | | | | | | | |
| 22 | 29 | 35 | 42 | | 13 | 20 | 29 | 40 | 49 | 22 | 28 |
| 8.9% | 6.2% | 4.3% | 2.2% | | 28.5% | 19.5% | 13.4% | 8.2% | 5.7% | 16.3% | 13.1% |
| | | | | | | | | | | | |
| 5 | 6 | 7 | 8 | | 2 | 3 | 4 | 5 | 6 | 4 | 5 |
| 400 | 400 | 400 | 400 | | 600 | 600 | 600 | 600 | 600 | 600 | 600 |
| 200 | 200 | 200 | 200 | | 200 | 200 | 200 | 200 | 200 | 350 | 350 |
| | | | | | | | | | | | |
| 9200 | 9200 | 9200 | 9200 | | 9200 | 9200 | 9200 | 9200 | 9200 | 9200 | 9200 |
| 42.90 | 42.90 | 42.90 | 42.90 | | 42.90 | 42.90 | 42.90 | 42.90 | 42.90 | 42.90 | 42.90 |
| 2400 | 2800 | 3200 | 3600 | | 1600 | 2200 | 2800 | 3400 | 4000 | 2800 | 3400 |
| 56 | 65 | 75 | 84 | | 37 | 51 | 65 | 79 | 93 | 65 | 79 |
| | | | | | | | | | | | |
| 60 | 40 | 30 | 20 | | 100 | 70 | 41 | 20 | 15 | 100 | 85 |
| 3.46 | 2.83 | 2.45 | 2.00 | | 4.47 | 3.74 | 2.86 | 2.00 | 1.73 | 4.47 | 4.12 |
| 32 | 26 | 23 | 19 | | 63 | 52 | 40 | 28 | 24 | 63 | 58 |
| 81 | 66 | 57 | 47 | | 104 | 87 | 67 | 47 | 40 | 104 | 96 |
| 4.8 | 3.9 | 3.4 | 2.7 | | 6.1 | 5.1 | 3.9 | 2.7 | 2.4 | 6.1 | 5.7 |
| 19 | 21 | 20 | 25 | | 37 | 21 | 20 | 30 | 27 | 50 | 31 |
| | | | | | | | | | | | |
| 1.2 | 1.2 | 1.2 | 1.2 | | 1.2 | 1.2 | 1.2 | 1.2 | 1.2 | 1.2 | 1.2 |
| 17 | 17 | 17 | 17 | | 17 | 17 | 17 | 17 | 17 | 17 | 17 |
| 17 | 11 | 8 | 4 | | 48 | 37 | 25 | 13 | 9 | 48 | 43 |
| 4.99 | 4.02 | 3.20 | 1.83 | | 10.63 | 9.98 | 8.75 | 6.49 | 5.33 | 10.63 | 10.35 |
| 0.089 | 0.062 | 0.043 | 0.022 | | 0.285 | 0.195 | 0.134 | 0.082 | 0.057 | 0.163 | 0.131 |
| | | | | | | | | | | | |
| 580 | 580 | 580 | 560 | | 600 | 600 | 600 | 550 | 530 | 600 | 600 |
| 696 | 696 | 696 | 672 | | 720 | 720 | 720 | 660 | 636 | 720 | 720 |
| 7.57% | 7.57% | 7.57% | 7.30% | | 7.83% | 7.83% | 7.83% | 7.17% | 6.91% | 7.83% | 7.83% |
| 98914 | 98914 | 98914 | 113820 | | 86371 | 86371 | 86371 | 122327 | 141863 | 86371 | 86371 |
| 0.28 | 0.33 | 0.38 | 0.37 | | 0.22 | 0.30 | 0.38 | 0.32 | 0.33 | 0.38 | 0.46 |
| | | | | | | | | | | | |
| 58.89 | 48.08 | 41.64 | 34.00 | | 76.03 | 63.61 | 48.68 | 34.00 | 29.44 | 76.03 | 70.09 |
| 1.02 | 0.83 | 0.72 | 0.61 | | 1.27 | 1.06 | 0.81 | 0.62 | 0.56 | 1.27 | 1.17 |
| 0.7 | 0.7 | 0.7 | 0.7 | | 0.7 | 0.7 | 0.7 | 0.7 | 0.7 | 0.7 | 0.7 |
| | | | | | | | | | | | |
| 1.27 | 1.13 | 1.07 | 1.00 | | 1.46 | 1.30 | 1.14 | 0.99 | 0.95 | 1.50 | 1.44 |
| 22110 | 28779 | 34818 | 42078 | | 12742 | 19656 | 28724 | 40093 | 48966 | 21815 | 27577 |
| | | | | | | | | | | | |
| 6.30 | 6.30 | 6.30 | 6.09 | | 6.52 | 6.52 | 6.52 | 5.98 | 5.76 | 6.52 | 6.52 |
| 1.77 | 1.77 | 1.77 | 1.70 | | 2.74 | 2.74 | 2.74 | 2.51 | 2.42 | 2.74 | 2.74 |
| | | | | | | | | | | | |
| | | | | | | | | | | | |
| 2.4 | 2.8 | 3.2 | 3.6 | | 1.6 | 2.2 | 2.8 | 3.4 | 4 | 2.8 | 3.4 |
| 0.125 | 0.125 | 0.125 | 0.125 | | 0.175 | 0.175 | 0.175 | 0.175 | 0.175 | 0.28 | 0.28 |
| | | | | | | | | | | | |
| 22110 | 28779 | 34818 | 42078 | | 12742 | 19656 | 28724 | 40093 | 48966 | 21815 | 27577 |
| 0.089 | 0.062 | 0.043 | 0.022 | | 0.285 | 0.195 | 0.134 | 0.082 | 0.057 | 0.163 | 0.131 |
| 1 | 0.8 | 0.6 | 0.4 | | 1 | 1 | 0.82 | 0.4 | 0.3 | 1 | 1 |
| 1974 | 1418 | 896.5 | 366.009 | | 3633 | 3824 | 3157 | 1313 | 839.2183 | 3554 | 3601 |

Fig. 5A (Cont. II)

| 22 | 23 | 24 | 25 | 26 | 28 | 29 | 30 | 31 | 32 | 33 |
|---|---|---|---|---|---|---|---|---|---|---|
| 400x700 | | | | | 400x1000 | | | | | |
| | | | | | | | | | | |
| 35 | 44 | 53 | 61 | 70 | 35 | 48 | 61 | 75 | 90 | 105 |
| 10.4% | 8.2% | 6.6% | 5.4% | 4.3% | 17.9% | 13.5% | 10.6% | 8.4% | 6.6% | 5.2% |
| | | | | | | | | | | |
| 6 | 7 | 8 | 9 | 10 | 4 | 5 | 6 | 7 | 8 | 9 |
| 600 | 600 | 600 | 600 | 600 | 900 | 900 | 900 | 900 | 900 | 900 |
| 350 | 350 | 350 | 350 | 350 | 350 | 350 | 350 | 350 | 350 | 350 |
| | | | | | | | | | | |
| 9200 | 9200 | 9200 | 9200 | 9200 | 9200 | 9200 | 9200 | 9200 | 9200 | 9200 |
| 42.90 | 42.90 | 42.90 | 42.90 | 42.90 | 42.90 | 42.90 | 42.90 | 42.90 | 42.90 | 42.90 |
| 4000 | 4600 | 5200 | 5800 | 6400 | 4000 | 4900 | 5800 | 6700 | 7600 | 8500 |
| 93 | 107 | 121 | 135 | 149 | 93 | 114 | 135 | 156 | 177 | 198 |
| | | | | | | | | | | |
| 60 | 42 | 32 | 25 | 20 | 60 | 36 | 25 | 18 | 13 | 10 |
| 3.46 | 2.90 | 2.53 | 2.24 | 2.00 | 3.46 | 2.68 | 2.24 | 1.90 | 1.61 | 1.41 |
| 48 | 41 | 35 | 31 | 28 | 73 | 56 | 47 | 40 | 34 | 30 |
| 81 | 68 | 59 | 52 | 47 | 81 | 63 | 52 | 44 | 38 | 33 |
| 4.8 | 4.0 | 3.5 | 3.1 | 2.7 | 4.8 | 3.7 | 3.1 | 2.6 | 2.2 | 1.9 |
| 30 | 33 | 33 | 34 | 35 | 30 | 34 | 34 | 36 | 40 | 41 |
| | | | | | | | | | | |
| 1.2 | 1.2 | 1.2 | 1.2 | 1.2 | 1.2 | 1.2 | 1.2 | 1.2 | 1.2 | 1.2 |
| 17 | 17 | 17 | 17 | 17 | 17 | 17 | 17 | 17 | 17 | 17 |
| 33 | 26 | 20 | 16 | 13 | 58 | 41 | 32 | 25 | 19 | 15 |
| 9.66 | 8.81 | 8.06 | 7.28 | 6.49 | 16.65 | 15.39 | 14.27 | 13.08 | 11.68 | 10.37 |
| 0.104 | 0.082 | 0.066 | 0.054 | 0.043 | 0.179 | 0.135 | 0.106 | 0.084 | 0.066 | 0.052 |
| | | | | | | | | | | |
| 600 | 540 | 520 | 500 | 440 | 600 | 580 | 500 | 480 | 440 | 420 |
| 720 | 648 | 624 | 600 | 528 | 720 | 696 | 600 | 576 | 528 | 504 |
| 7.83% | 7.04% | 6.78% | 6.52% | 5.74% | 7.83% | 7.57% | 6.52% | 6.26% | 5.74% | 5.48% |
| 86371 | 131643 | 153094 | 179098 | 298649 | 86371 | 98914 | 179098 | 210866 | 298649 | 359728 |
| 0.54 | 0.41 | 0.40 | 0.38 | 0.25 | 0.54 | 0.58 | 0.38 | 0.37 | 0.30 | 0.28 |
| | | | | | | | | | | |
| 58.89 | 49.27 | 43.01 | 38.01 | 34.00 | 58.89 | 45.62 | 38.01 | 32.26 | 27.41 | 24.04 |
| 0.98 | 0.91 | 0.83 | 0.76 | 0.77 | 0.98 | 0.79 | 0.76 | 0.67 | 0.62 | 0.57 |
| 0.7 | 0.7 | 0.7 | 0.7 | 0.7 | 0.7 | 0.7 | 0.7 | 0.7 | 0.7 | 0.7 |
| | | | | | | | | | | |
| 1.32 | 1.22 | 1.15 | 1.10 | 1.07 | 1.32 | 1.20 | 1.10 | 1.04 | 0.98 | 0.95 |
| 35298 | 43950 | 52543 | 61448 | 69580 | 35298 | 47564 | 61448 | 75193 | 90128 | 104816 |
| | | | | | | | | | | |
| 6.52 | 5.87 | 5.65 | 5.43 | 4.78 | 6.52 | 6.30 | 5.43 | 5.22 | 4.78 | 4.57 |
| 2.74 | 2.47 | 2.37 | 2.28 | 2.01 | 4.11 | 3.97 | 3.42 | 3.29 | 3.01 | 2.88 |
| | | | | | | | | | | |
| | | | | | | | | | | |
| 4 | 4.6 | 5.2 | 5.8 | 6.4 | 4 | 4.9 | 5.8 | 6.7 | 7.6 | 8.5 |
| 0.28 | 0.28 | 0.28 | 0.28 | 0.28 | 0.4 | 0.4 | 0.4 | 0.4 | 0.4 | 0.4 |
| | | | | | | | | | | |
| 35298 | 43950 | 52543 | 61448 | 69580 | 35298 | 47564 | 61448 | 75193 | 90128 | 104816 |
| 0.104 | 0.082 | 0.066 | 0.054 | 0.043 | 0.179 | 0.135 | 0.106 | 0.084 | 0.066 | 0.052 |
| 1 | 0.84 | 0.64 | 0.5 | 0.4 | 1 | 0.72 | 0.5 | 0.36 | 0.26 | 0.2 |
| 3656 | 3034 | 2235.33 | 1654.06 | 1210.2 | 6303 | 4614 | 3243.24 | 2266.1 | 1544.638 | 1097.551 |

Fig. 5B (Rk=80K)

| | Varient # | 1 | 2 | 3 | 4 | 5 | 6 | 7 |
|---|---|---|---|---|---|---|---|---|
| | System size (mm) | 200x500 | | | | | | |
| Param | Resn, K | 9 | 13 | 17 | 23 | 9 | 12 | 14 |
| | Duty Cycle | 21.3% | 14.9% | 9.8% | 5.7% | 21.3% | 16.0% | 12.8% |
| | | | | | | | | |
| Size | N refl | 2 | 3 | 4 | 5 | 2 | 3 | 4 |
| | Length L, mm | 400 | 400 | 400 | 400 | 400 | 400 | 400 |
| | Width W, mm | 150 | 150 | 150 | 150 | 200 | 200 | 200 |
| | | | | | | | | |
| TOF | K, eV | 9200 | 9200 | 9200 | 9200 | 9200 | 9200 | 9200 |
| | V tof, mm/us | 42.9 | 42.9 | 42.9 | 42.9 | 42.9 | 42.9 | 42.9 |
| | Leff, mm | 1200 | 1600 | 2000 | 2400 | 1200 | 1600 | 2000 |
| | TOF, us | 27.98 | 37.3 | 46.63 | 55.95 | 27.98 | 37.3 | 46.63 |
| | | | | | | | | |
| Beam | Beam, eV | 100 | 80 | 50 | 30 | 100 | 100 | 100 |
| | V beam, mm/us | 4.472 | 4 | 3.162 | 2.449 | 4.472 | 4.472 | 4.472 |
| Trajectory | Z step, mm | 41.7 | 37.3 | 29.49 | 22.84 | 41.7 | 41.7 | 41.7 |
| | Inclination, mrad | 104.3 | 93.25 | 73.72 | 57.1 | 104.3 | 104.3 | 104.3 |
| | Inclination, deg | 6.133 | 5.485 | 4.337 | 3.359 | 6.133 | 6.133 | 6.133 |
| | Mirr Z edge, mm | 33.3 | 19.05 | 16.02 | 17.9 | 58.3 | 37.45 | 16.59 |
| | | | | | | | | |
| OA | beam d, mm | 1.2 | 1.2 | 1.2 | 1.2 | 1.2 | 1.2 | 1.2 |
| | beam ang, mrad | 17 | 17 | 17 | 17 | 17 | 17 | 17 |
| | OA length | 26.7 | 22.3 | 14.49 | 7.842 | 26.7 | 26.7 | 26.7 |
| | OA time, us | 5.971 | 5.575 | 4.582 | 3.201 | 5.971 | 5.971 | 5.971 |
| | Duty Cycle | 0.213 | 0.149 | 0.098 | 0.057 | 0.213 | 0.16 | 0.128 |
| | | | | | | | | |
| dK | E, V/mm | 600 | 580 | 540 | 460 | 600 | 600 | 580 |
| | dK, eV | 720 | 696 | 648 | 552 | 720 | 720 | 696 |
| R(6%) | dK/K | 0.078 | 0.076 | 0.07 | 0.06 | 0.078 | 0.078 | 0.076 |
| 80000 | Res(dK) | 27639 | 31653 | 42126 | 80000 | 27639 | 27639 | 31653 |
| | dT(dK) | 0.506 | 0.589 | 0.553 | 0.35 | 0.506 | 0.675 | 0.737 |
| | | | | | | | | |
| Packets | Vx, m/s | 76.03 | 68 | 53.76 | 41.64 | 76.03 | 76.03 | 76.03 |
| | Turn Around, ns | 1.267 | 1.172 | 0.996 | 0.905 | 1.267 | 1.267 | 1.311 |
| | DAS and Det, ns | 0.7 | 0.7 | 0.7 | 0.7 | 0.7 | 0.7 | 0.7 |
| | | | | | | | | |
| Resolution | FWHM, ns | 1.534 | 1.487 | 1.337 | 1.197 | 1.534 | 1.597 | 1.659 |
| | Resolution | 9121 | 12541 | 17438 | 23380 | 9121 | 11677 | 14056 |
| | | | | | | | | |
| Mesh | angle, mrad | 6.522 | 6.304 | 5.87 | 5 | 6.522 | 6.522 | 6.304 |
| | Y spread, mm | 1.826 | 1.765 | 1.643 | 1.4 | 1.826 | 1.826 | 1.765 |
| | | | | | | | | |
| | Leff | 1.2 | 1.6 | 2 | 2.4 | 1.2 | 1.6 | 2 |
| | Square | 0.1 | 0.1 | 0.1 | 0.1 | 0.125 | 0.125 | 0.125 |
| | | | | | | | | |
| | Resolution | 9121 | 12541 | 17438 | 23380 | 9121 | 11677 | 14056 |
| | Duty Cycle | 0.213 | 0.149 | 0.098 | 0.057 | 0.213 | 0.16 | 0.128 |
| | Transm OA | 1 | 1 | 1 | 0.6 | 1 | 1 | 1 |
| | Res*DC*Transm | 1947 | 1874 | 1714 | 802.6 | 1947 | 1869 | 1800 |

Fig. 5B (Cont. I)

| 8 | 9 | 10 | 11 | 12 | 13 | 14 | 15 | 16 | 17 | 18 | 19 |
|---|---|---|---|---|---|---|---|---|---|---|---|
| 250x500 | | | | 250x700 | | | | | | | |
| | | | | | | | | | | | |
| 19 | 25 | 30 | 36 | 12 | 17 | 25 | 34 | 43 | 19 | 23 | 29 |
| 8.9% | 6.2% | 4.3% | 2.6% | 28.5% | 19.5% | 13.4% | 9.0% | 6.0% | 16.3% | 13.2% | 10.5% |
| | | | | | | | | | | | |
| 5 | 6 | 7 | 8 | 2 | 3 | 4 | 5 | 6 | 4 | 5 | 6 |
| 400 | 400 | 400 | 400 | 600 | 600 | 600 | 600 | 600 | 600 | 600 | 600 |
| 200 | 200 | 200 | 200 | 200 | 200 | 200 | 200 | 200 | 350 | 350 | 350 |
| | | | | | | | | | | | |
| 9200 | 9200 | 9200 | 9200 | 9200 | 9200 | 9200 | 9200 | 9200 | 9200 | 9200 | 9200 |
| 42.9 | 42.9 | 42.9 | 42.8952 | 42.9 | 42.9 | 42.9 | 42.9 | 42.89522 | 42.9 | 42.9 | 42.9 |
| 2400 | 2800 | 3200 | 3600 | 1600 | 2200 | 2800 | 3400 | 4000 | 2800 | 3400 | 4000 |
| 55.95 | 65.28 | 74.6 | 83.9254 | 37.3 | 51.29 | 65.28 | 79.26 | 93.25048 | 65.28 | 79.26 | 93.25 |
| | | | | | | | | | | | |
| 60 | 40 | 30 | 22 | 100 | 70 | 41 | 24 | 16 | 100 | 90 | 65 |
| 3.464 | 2.828 | 2.449 | 2.09762 | 4.472 | 3.742 | 2.864 | 2.191 | 1.788854 | 4.472 | 4.243 | 3.606 |
| 32.3 | 26.38 | 22.84 | 19.5604 | 62.55 | 52.34 | 40.05 | 30.65 | 25.02173 | 62.55 | 59.34 | 50.43 |
| 80.76 | 65.94 | 57.1 | 48.901 | 104.3 | 87.23 | 66.76 | 51.08 | 41.70288 | 104.3 | 98.91 | 84.05 |
| 4.75 | 3.879 | 3.359 | 2.87653 | 6.133 | 5.131 | 3.927 | 3.004 | 2.453111 | 6.133 | 5.818 | 4.944 |
| 19.24 | 20.87 | 20.05 | 21.7585 | 37.45 | 21.49 | 19.89 | 23.39 | 24.93481 | 49.89 | 26.64 | 23.7 |
| | | | | | | | | | | | |
| 1.2 | 1.2 | 1.2 | 1.2 | 1.2 | 1.2 | 1.2 | 1.2 | 1.2 | 1.2 | 1.2 | 1.2 |
| 17 | 17 | 17 | 17 | 17 | 17 | 17 | 17 | 17 | 17 | 17 | 17 |
| 17.3 | 11.38 | 7.842 | 4.56039 | 47.55 | 37.34 | 25.05 | 15.65 | 10.02173 | 47.55 | 44.34 | 35.43 |
| 4.995 | 4.022 | 3.201 | 2.17408 | 10.63 | 9.979 | 8.749 | 7.141 | 5.602317 | 10.63 | 10.45 | 9.827 |
| 0.089 | 0.062 | 0.043 | 0.0259 | 0.285 | 0.195 | 0.134 | 0.09 | 0.060078 | 0.163 | 0.132 | 0.105 |
| | | | | | | | | | | | |
| 530 | 480 | 450 | 420 | 600 | 540 | 500 | 450 | 420 | 530 | 510 | 480 |
| 636 | 576 | 540 | 504 | 720 | 648 | 600 | 540 | 504 | 636 | 612 | 576 |
| 0.069 | 0.063 | 0.059 | 0.05478 | 0.078 | 0.07 | 0.065 | 0.059 | 0.054783 | 0.069 | 0.067 | 0.063 |
| 45396 | 67477 | 87352 | 115113 | 27639 | 42126 | 57311 | 87352 | 115112.9 | 45396 | 52947 | 67477 |
| 0.616 | 0.484 | 0.427 | 0.36454 | 0.675 | 0.609 | 0.569 | 0.454 | 0.405039 | 0.719 | 0.749 | 0.691 |
| | | | | | | | | | | | |
| 58.89 | 48.08 | 41.64 | 35.6595 | 76.03 | 63.61 | 48.68 | 37.25 | 30.41052 | 76.03 | 72.12 | 61.29 |
| 1.111 | 1.002 | 0.925 | 0.84904 | 1.267 | 1.178 | 0.974 | 0.828 | 0.72406 | 1.434 | 1.414 | 1.277 |
| 0.7 | 0.7 | 0.7 | 0.7 | 0.7 | 0.7 | 0.7 | 0.7 | 0.7 | 0.7 | 0.7 | 0.7 |
| | | | | | | | | | | | |
| 1.451 | 1.314 | 1.236 | 1.1592 | 1.597 | 1.499 | 1.327 | 1.175 | 1.085504 | 1.751 | 1.747 | 1.612 |
| 19285 | 24832 | 30169 | 36199.7 | 11677 | 17103 | 24586 | 33726 | 42952.61 | 18644 | 22692 | 28926 |
| | | | | | | | | | | | |
| 5.761 | 5.217 | 4.891 | 4.56522 | 6.522 | 5.87 | 5.435 | 4.891 | 4.565217 | 5.761 | 5.543 | 5.217 |
| 1.613 | 1.461 | 1.37 | 1.27826 | 2.739 | 2.465 | 2.283 | 2.054 | 1.917391 | 2.42 | 2.328 | 2.191 |
| | | | | | | | | | | | |
| 2.4 | 2.8 | 3.2 | 3.6 | 1.6 | 2.2 | 2.8 | 3.4 | 4 | 2.8 | 3.4 | 4 |
| 0.125 | 0.125 | 0.125 | 0.125 | 0.175 | 0.175 | 0.175 | 0.175 | 0.175 | 0.28 | 0.28 | 0.28 |
| | | | | | | | | | | | |
| 19285 | 24832 | 30169 | 36199.7 | 11677 | 17103 | 24586 | 33726 | 42952.61 | 18644 | 22692 | 28926 |
| 0.089 | 0.062 | 0.043 | 0.0259 | 0.285 | 0.195 | 0.134 | 0.09 | 0.060078 | 0.163 | 0.132 | 0.105 |
| 1 | 0.8 | 0.6 | 0.44 | 1 | 1 | 0.82 | 0.48 | 0.32 | 1 | 1 | 1 |
| 1722 | 1224 | 776.8 | 412.609 | 3329 | 3328 | 2702 | 1458 | 825.7643 | 3037 | 2992 | 3048 |

Fig. 5B (Cont. II)

| 20 | 21 | 22 | 23 | 24 | 25 | 26 | 27 | 28 | 29 |
|---|---|---|---|---|---|---|---|---|---|
| 400x700 | | | | 400x1000 | | | | | |
| | | | | | | | | | |
| 36 | 43 | 51 | 60 | 29 | 40 | 52 | 65 | 78 | 91 |
| 8.5% | 6.9% | 5.7% | 4.6% | 18.0% | 13.7% | 10.7% | 8.5% | 6.8% | 5.5% |
| | | | | | | | | | |
| 7 | 8 | 9 | 10 | 4 | 5 | 6 | 7 | 8 | 9 |
| 600 | 600 | 600 | 600 | 900 | 900 | 900 | 900 | 900 | 900 |
| 350 | 350 | 350 | 350 | 350 | 350 | 350 | 350 | 350 | 350 |
| | | | | | | | | | |
| 9200 | 9200 | 9200 | 9200 | 9200 | 9200 | 9200 | 9200 | 9200 | 9200 |
| 42.9 | 42.8952 | 42.8952 | 42.8952 | 42.895 | 42.9 | 42.8952 | 42.8952 | 42.89522 | 42.89522 |
| 4600 | 5200 | 5800 | 6400 | 4000 | 4900 | 5800 | 6700 | 7600 | 8500 |
| 107.2 | 121.226 | 135.213 | 149.201 | 93.25 | 114.2 | 135.213 | 156.195 | 177.1759 | 198.1573 |
| | | | | | | | | | |
| 48 | 36 | 28 | 22 | 65 | 40 | 27 | 19 | 14 | 11 |
| 3.098 | 2.68328 | 2.36643 | 2.09762 | 3.6056 | 2.828 | 2.32379 | 1.94936 | 1.67332 | 1.48324 |
| 43.34 | 37.5326 | 33.1006 | 29.3406 | 75.649 | 59.34 | 48.7563 | 40.9002 | 35.10853 | 31.12038 |
| 72.23 | 62.5543 | 55.1677 | 48.901 | 84.055 | 65.94 | 54.1736 | 45.4447 | 39.00947 | 34.5782 |
| 4.249 | 3.67967 | 3.24516 | 2.87653 | 4.9444 | 3.879 | 3.18668 | 2.67322 | 2.294675 | 2.034012 |
| 23.31 | 24.8696 | 26.0471 | 28.2971 | 23.701 | 26.64 | 28.7312 | 31.8493 | 34.56589 | 34.95827 |
| | | | | | | | | | |
| 1.2 | 1.2 | 1.2 | 1.2 | 1.2 | 1.2 | 1.2 | 1.2 | 1.2 | 1.2 |
| 17 | 17 | 17 | 17 | 17 | 17 | 17 | 17 | 17 | 17 |
| 28.34 | 22.5326 | 18.1006 | 14.3406 | 60.649 | 44.34 | 33.7563 | 25.9002 | 20.10853 | 16.12038 |
| 9.146 | 8.3974 | 7.64892 | 6.8366 | 16.821 | 15.68 | 14.5264 | 13.2865 | 12.01714 | 10.86836 |
| 0.085 | 0.06927 | 0.05657 | 0.04582 | 0.1804 | 0.137 | 0.10743 | 0.08506 | 0.067826 | 0.054847 |
| | | | | | | | | | |
| 450 | 430 | 420 | 380 | 480 | 440 | 410 | 380 | 360 | 350 |
| 540 | 516 | 504 | 456 | 576 | 528 | 492 | 456 | 432 | 420 |
| 0.059 | 0.05609 | 0.05478 | 0.04957 | 0.0626 | 0.057 | 0.05348 | 0.04957 | 0.046957 | 0.045652 |
| 87352 | 104773 | 115113 | 171786 | 67477 | 95568 | 126761 | 171786 | 213260.9 | 238698.2 |
| 0.614 | 0.57852 | 0.58731 | 0.43426 | 0.691 | 0.598 | 0.53334 | 0.45462 | 0.415397 | 0.415079 |
| | | | | | | | | | |
| 52.67 | 45.6158 | 40.2293 | 35.6595 | 61.294 | 48.08 | 39.5044 | 33.1391 | 28.44644 | 25.21507 |
| 1.171 | 1.06083 | 0.95784 | 0.93841 | 1.277 | 1.093 | 0.96352 | 0.87208 | 0.790179 | 0.720431 |
| 0.7 | 0.7 | 0.7 | 0.7 | 0.7 | 0.7 | 0.7 | 0.7 | 0.7 | 0.7 |
| | | | | | | | | | |
| 1.496 | 1.39644 | 1.32378 | 1.24868 | 1.6119 | 1.429 | 1.30492 | 1.20715 | 1.134433 | 1.086881 |
| 35851 | 43405.2 | 51070.9 | 59743.5 | 28926 | 39975 | 51808.8 | 64695.7 | 78090.1 | 91158.65 |
| | | | | | | | | | |
| 4.891 | 4.67391 | 4.56522 | 4.13043 | 5.2174 | 4.783 | 4.45652 | 4.13043 | 3.913043 | 3.804348 |
| 2.054 | 1.96304 | 1.91739 | 1.73478 | 3.287 | 3.013 | 2.80761 | 2.60217 | 2.465217 | 2.396739 |
| | | | | | | | | | |
| 4.6 | 5.2 | 5.8 | 6.4 | 4 | 4.9 | 5.8 | 6.7 | 7.6 | 8.5 |
| 0.28 | 0.28 | 0.28 | 0.28 | 0.4 | 0.4 | 0.4 | 0.4 | 0.4 | 0.4 |
| | | | | | | | | | |
| 35851 | 43405.2 | 51070.9 | 59743.5 | 28926 | 39975 | 51808.8 | 64695.7 | 78090.1 | 91158.65 |
| 0.085 | 0.06927 | 0.05657 | 0.04582 | 0.1804 | 0.137 | 0.10743 | 0.08506 | 0.067826 | 0.054847 |
| 0.96 | 0.72 | 0.56 | 0.44 | 1 | 0.8 | 0.54 | 0.38 | 0.28 | 0.22 |
| 2935 | 2164.83 | 1617.87 | 1204.52 | 5217.9 | 4389 | 3005.63 | 2091.24 | 1483.032 | 1099.954 |

Fig. 6A (Rk=250K)

| | Varient # | 1 | 2 | 3 | 4 | 6 | 7 | 8 | 9 |
|---|---|---|---|---|---|---|---|---|---|
| | System size (mm) | 200x500 | | | | 250x500 | | | |
| Param | Resn, K | 10 | 16 | 22 | 30 | 10 | 13 | 18 | 24 |
| | Duty Cycle | 23.7% | 14.7% | 9.4% | 5.6% | 23.7% | 17.7% | 12.5% | 9.0% |
| Size | # of reflections | 2 | 3 | 4 | 5 | 2 | 3 | 4 | 5 |
| | Length L, mm | 400 | 400 | 400 | 400 | 400 | 400 | 400 | 400 |
| | Width W, mm | 150 | 150 | 150 | 150 | 200 | 200 | 200 | 200 |
| TOF | K, eV | 6000 | 6000 | 6000 | 6000 | 6000 | 6000 | 6000 | 6000 |
| | V tof, mm/us | 34.64 | 34.64 | 34.64 | 34.64 | 34.64 | 34.64 | 34.64 | 34.64 |
| | Leff, mm | 1200 | 1600 | 2000 | 2400 | 1200 | 1600 | 2000 | 2400 |
| | TOF, us | 35 | 46 | 58 | 69 | 35 | 46 | 58 | 69 |
| Beam | Beam, eV | 100 | 50 | 30 | 19 | 100 | 100 | 60 | 40 |
| | V beam, mm/us | 4.47 | 3.16 | 2.45 | 1.95 | 4.47 | 4.47 | 3.46 | 2.83 |
| Trajectory | Z step, mm | 52 | 37 | 28 | 23 | 52 | 52 | 40 | 33 |
| | Inclination, mrad | 129 | 91 | 71 | 56 | 129 | 129 | 100 | 82 |
| | Inclination, deg | 7.6 | 5.4 | 4.2 | 3.3 | 7.6 | 7.6 | 5.9 | 4.8 |
| | Mirr Z edge, mm | 23 | 20 | 18 | 19 | 48 | 23 | 20 | 18 |
| OA | beam d, mm | 1.2 | 1.2 | 1.2 | 1.2 | 1.2 | 1.2 | 1.2 | 1.2 |
| | beam ang, mrad | 17 | 17 | 17 | 17 | 17 | 17 | 17 | 17 |
| | OA length | 37 | 22 | 13 | 8 | 37 | 37 | 25 | 18 |
| | OA time, us | 8.19 | 6.80 | 5.42 | 3.85 | 8.19 | 8.19 | 7.22 | 6.24 |
| | Duty Cycle | 0.237 | 0.147 | 0.094 | 0.056 | 0.237 | 0.177 | 0.125 | 0.090 |
| dK | E, V/mm | 500 | 450 | 420 | 400 | 550 | 500 | 450 | 420 |
| | dK, eV | 600 | 540 | 504 | 480 | 660 | 600 | 540 | 504 |
| R(6%) | dK/K | 10.0% | 9.0% | 8.4% | 8.0% | 11.0% | 10.0% | 9.0% | 8.4% |
| 250000 | Res(dK) | 32400 | 49383 | 65077 | 79102 | 22130 | 32400 | 49383 | 65077 |
| | dT(dK) | 0.53 | 0.47 | 0.44 | 0.44 | 0.78 | 0.71 | 0.58 | 0.53 |
| Packets | Vx, m/s | 76.03 | 53.76 | 41.64 | 33.14 | 76.03 | 76.03 | 58.89 | 48.08 |
| | Turn Around, ns | 1.52 | 1.19 | 0.99 | 0.83 | 1.38 | 1.52 | 1.31 | 1.14 |
| | DAS and Det, ns | 0.7 | 0.7 | 0.7 | 0.7 | 0.7 | 0.7 | 0.7 | 0.7 |
| Resolution | FWHM, ns | 1.76 | 1.46 | 1.29 | 1.17 | 1.74 | 1.82 | 1.60 | 1.44 |
| | Resolution | 9857 | 15802 | 22340 | 29616 | 9978 | 12694 | 18098 | 23996 |
| Mesh | angle, mrad | 8.33 | 7.50 | 7.00 | 6.67 | 9.17 | 8.33 | 7.50 | 7.00 |
| | Y spread, mm | 2.33 | 2.10 | 1.96 | 1.87 | 2.57 | 2.33 | 2.10 | 1.96 |
| | Leff | 1.2 | 1.6 | 2 | 2.4 | 1.2 | 1.6 | 2 | 2.4 |
| | Square | 0.1 | 0.1 | 0.1 | 0.1 | 0.125 | 0.125 | 0.125 | 0.125 |
| | Resolution | 9857 | 15802 | 22340 | 29616 | 9978 | 12694 | 18098 | 23996 |
| | Duty Cycle | 0.237 | 0.147 | 0.094 | 0.056 | 0.237 | 0.177 | 0.125 | 0.090 |
| | Transm OA | 1 | 1 | 0.6 | 0.38 | 1 | 1 | 1 | 0.8 |
| | Res*DC*Transm | 2331 | 2328 | 1259 | 625.7 | 2360 | 2252 | 2262 | 1730 |

Fig. 6A (Cont. I)

| 10 | 11 | 12 | 14 | 15 | 16 | 17 | 18 | 20 | 21 | 22 |
|---|---|---|---|---|---|---|---|---|---|---|
| | | | 250x700 | | | | | | | |
| | | | | | | | | | | |
| 31 | 38 | 45 | 12 | 21 | 31 | 42 | 54 | 20 | 28 | 36 |
| 6.0% | 4.2% | 2.8% | 30.2% | 19.4% | 13.1% | 9.1% | 5.8% | 17.3% | 13.3% | 10.5% |
| | | | | | | | | | | |
| 6 | 7 | 8 | 2 | 3 | 4 | 5 | 6 | 4 | 5 | 6 |
| 400 | 400 | 400 | 600 | 600 | 600 | 600 | 600 | 600 | 600 | 600 |
| 200 | 200 | 200 | 200 | 200 | 200 | 200 | 200 | 350 | 350 | 350 |
| | | | | | | | | | | |
| 6000 | 6000 | 6000 | 6000 | 6000 | 6000 | 6000 | 6000 | 6000 | 6000 | 6000 |
| 34.64 | 34.64 | 34.64 | 34.64 | 34.64 | 34.64 | 34.64 | 34.64 | 34.64 | 34.64 | 34.64 |
| 2800 | 3200 | 3600 | 1600 | 2200 | 2800 | 3400 | 4000 | 2800 | 3400 | 4000 |
| 81 | 92 | 104 | 46 | 64 | 81 | 98 | 115 | 81 | 98 | 115 |
| | | | | | | | | | | |
| 25 | 19 | 15 | 100 | 45 | 25 | 16 | 10 | 100 | 62 | 42 |
| 2.24 | 1.95 | 1.73 | 4.47 | 3.00 | 2.24 | 1.79 | 1.41 | 4.47 | 3.52 | 2.90 |
| 26 | 23 | 20 | 77 | 52 | 39 | 31 | 24 | 77 | 61 | 50 |
| 65 | 56 | 50 | 129 | 87 | 65 | 52 | 41 | 129 | 102 | 84 |
| 3.8 | 3.3 | 2.9 | 7.6 | 5.1 | 3.8 | 3.0 | 2.4 | 7.6 | 6.0 | 4.9 |
| 23 | 21 | 20 | 23 | 22 | 23 | 23 | 27 | 20 | 23 | 24 |
| | | | | | | | | | | |
| 1.2 | 1.2 | 1.2 | 1.2 | 1.2 | 1.2 | 1.2 | 1.2 | 1.2 | 1.2 | 1.2 |
| 17 | 17 | 17 | 17 | 17 | 17 | 17 | 17 | 17 | 17 | 17 |
| 11 | 8 | 5 | 62 | 37 | 24 | 16 | 9 | 62 | 46 | 35 |
| 4.84 | 3.85 | 2.89 | 13.97 | 12.32 | 10.61 | 8.94 | 6.71 | 13.97 | 13.06 | 12.15 |
| 0.060 | 0.042 | 0.028 | 0.302 | 0.194 | 0.131 | 0.091 | 0.058 | 0.173 | 0.133 | 0.105 |
| | | | | | | | | | | |
| 420 | 380 | 360 | 460 | 420 | 380 | 350 | 310 | 430 | 410 | 390 |
| 504 | 456 | 432 | 552 | 504 | 456 | 420 | 372 | 516 | 492 | 468 |
| 8.4% | 7.6% | 7.2% | 9.2% | 8.4% | 7.6% | 7.0% | 6.2% | 8.6% | 8.2% | 7.8% |
| 65077 | 97116 | 120563 | 45227 | 65077 | 97116 | 134944 | 219270 | 59231 | 71662 | 87532 |
| 0.62 | 0.48 | 0.43 | 0.51 | 0.49 | 0.42 | 0.36 | 0.26 | 0.68 | 0.68 | 0.66 |
| | | | | | | | | | | |
| 38.01 | 33.14 | 29.44 | 76.03 | 51.00 | 38.01 | 30.41 | 24.04 | 76.03 | 59.86 | 49.27 |
| 0.91 | 0.87 | 0.82 | 1.65 | 1.21 | 1.00 | 0.87 | 0.78 | 1.77 | 1.46 | 1.26 |
| 0.7 | 0.7 | 0.7 | 0.7 | 0.7 | 0.7 | 0.7 | 0.7 | 0.7 | 0.7 | 0.7 |
| | | | | | | | | | | |
| 1.30 | 1.22 | 1.16 | 1.87 | 1.48 | 1.29 | 1.17 | 1.08 | 2.02 | 1.76 | 1.59 |
| 31044 | 38008 | 44809 | 12376 | 21396 | 31331 | 41818 | 53587 | 20004 | 27914 | 36362 |
| | | | | | | | | | | |
| 7.00 | 6.33 | 6.00 | 7.67 | 7.00 | 6.33 | 5.83 | 5.17 | 7.17 | 6.83 | 6.50 |
| 1.96 | 1.77 | 1.68 | 3.22 | 2.94 | 2.66 | 2.45 | 2.17 | 3.01 | 2.87 | 2.73 |
| 2.8 | 3.2 | 3.6 | 1.6 | 2.2 | 2.8 | 3.4 | 4 | 2.8 | 3.4 | 4 |
| 0.125 | 0.125 | 0.125 | 0.175 | 0.175 | 0.175 | 0.175 | 0.175 | 0.28 | 0.28 | 0.28 |
| | | | | | | | | | | |
| 31044 | 38008 | 44809 | 12376 | 21396 | 31331 | 41818 | 53587 | 20004 | 27914 | 36362 |
| 0.060 | 0.042 | 0.028 | 0.302 | 0.194 | 0.131 | 0.091 | 0.058 | 0.173 | 0.133 | 0.105 |
| 0.5 | 0.38 | 0.3 | 1 | 0.9 | 0.5 | 0.32 | 0.2 | 1 | 1 | 0.84 |
| 929.2 | 602.3 | 373.4 | 3742 | 3736 | 2057 | 1218 | 623.2 | 3457 | 3715 | 3213 |

Fig. 6A (Cont. II)

| 23 | 24 | 25 | 26 | 28 | 29 | 30 | 31 | 32 | 33 |
|---|---|---|---|---|---|---|---|---|---|
| 400x700 | | | | 400x1000 | | | | | |
| | | | | | | | | | |
| 45 | 55 | 64 | 75 | 36 | 51 | 66 | 82 | 96 | 113 |
| 8.4% | 6.9% | 5.6% | 4.5% | 18.0% | 13.6% | 10.7% | 8.4% | 6.9% | 5.6% |
| | | | | | | | | | |
| 7 | 8 | 9 | 10 | 4 | 5 | 6 | 7 | 8 | 9 |
| 600 | 600 | 600 | 600 | 900 | 900 | 900 | 900 | 900 | 900 |
| 350 | 350 | 350 | 350 | 350 | 350 | 350 | 350 | 350 | 350 |
| | | | | | | | | | |
| 6000 | 6000 | 6000 | 6000 | 6000 | 6000 | 6000 | 6000 | 6000 | 6000 |
| 34.64 | 34.64 | 34.64 | 34.64 | 34.64 | 34.64 | 34.64 | 34.64 | 34.64 | 34.64 |
| 4600 | 5200 | 5800 | 6400 | 4000 | 4900 | 5800 | 6700 | 7600 | 8500 |
| 133 | 150 | 167 | 185 | 115 | 141 | 167 | 193 | 219 | 245 |
| | | | | | | | | | |
| 30 | 23 | 18 | 14 | 42 | 25 | 17 | 12 | 9.5 | 7.5 |
| 2.45 | 2.14 | 1.90 | 1.67 | 2.90 | 2.24 | 1.84 | 1.55 | 1.38 | 1.22 |
| 42 | 37 | 33 | 29 | 75 | 58 | 48 | 40 | 36 | 32 |
| 71 | 62 | 55 | 48 | 84 | 65 | 53 | 45 | 40 | 35 |
| 4.2 | 3.6 | 3.2 | 2.8 | 4.9 | 3.8 | 3.1 | 2.6 | 2.3 | 2.1 |
| 27 | 26 | 27 | 30 | 24 | 30 | 31 | 34 | 32 | 32 |
| | | | | | | | | | |
| 1.2 | 1.2 | 1.2 | 1.2 | 1.2 | 1.2 | 1.2 | 1.2 | 1.2 | 1.2 |
| 17 | 17 | 17 | 17 | 17 | 17 | 17 | 17 | 17 | 17 |
| 27 | 22 | 18 | 14 | 60 | 43 | 33 | 25 | 21 | 17 |
| 11.20 | 10.33 | 9.41 | 8.36 | 20.81 | 19.27 | 17.85 | 16.30 | 15.10 | 13.73 |
| 0.084 | 0.069 | 0.056 | 0.045 | 0.180 | 0.136 | 0.107 | 0.084 | 0.069 | 0.056 |
| | | | | | | | | | |
| 370 | 350 | 330 | 310 | 390 | 360 | 330 | 310 | 300 | 270 |
| 444 | 420 | 396 | 372 | 468 | 432 | 396 | 372 | 360 | 324 |
| 7.4% | 7.0% | 6.6% | 6.2% | 7.8% | 7.2% | 6.6% | 6.2% | 6.0% | 5.4% |
| 108048 | 134944 | 170753 | 219270 | 87532 | 120563 | 170753 | 219270 | 250000 | 381039 |
| 0.61 | 0.56 | 0.49 | 0.42 | 0.66 | 0.59 | 0.49 | 0.44 | 0.44 | 0.32 |
| | | | | | | | | | |
| 41.64 | 36.46 | 32.26 | 28.45 | 49.27 | 38.01 | 31.35 | 26.34 | 23.43 | 20.82 |
| 1.13 | 1.04 | 0.98 | 0.92 | 1.26 | 1.06 | 0.95 | 0.85 | 0.78 | 0.77 |
| 0.7 | 0.7 | 0.7 | 0.7 | 0.7 | 0.7 | 0.7 | 0.7 | 0.7 | 0.7 |
| | | | | | | | | | |
| 1.46 | 1.37 | 1.30 | 1.23 | 1.59 | 1.40 | 1.28 | 1.19 | 1.14 | 1.09 |
| 45448 | 54673 | 64478 | 75186 | 36362 | 50659 | 65518 | 81549 | 96484 | 112546 |
| | | | | | | | | | |
| 6.17 | 5.83 | 5.50 | 5.17 | 6.50 | 6.00 | 5.50 | 5.17 | 5.00 | 4.50 |
| 2.59 | 2.45 | 2.31 | 2.17 | 4.10 | 3.78 | 3.47 | 3.26 | 3.15 | 2.84 |
| 4.6 | 5.2 | 5.8 | 6.4 | 4 | 4.9 | 5.8 | 6.7 | 7.6 | 8.5 |
| 0.28 | 0.28 | 0.28 | 0.28 | 0.4 | 0.4 | 0.4 | 0.4 | 0.4 | 0.4 |
| | | | | | | | | | |
| 45448 | 54673 | 64478 | 75186 | 36362 | 50659 | 65518 | 81549 | 96484 | 112546 |
| 0.084 | 0.069 | 0.056 | 0.045 | 0.180 | 0.136 | 0.107 | 0.084 | 0.069 | 0.056 |
| 0.6 | 0.46 | 0.36 | 0.28 | 0.84 | 0.5 | 0.34 | 0.24 | 0.19 | 0.15 |
| 2299 | 1730 | 1305 | 952.2 | 5503 | 3451 | 2374 | 1649 | 1262 | 944.9 |

Fig. 6B (Rk=80K)

| | Varient # | 1 | 2 | 3 | 4 | 5 | 6 | 7 | 8 |
|---|---|---|---|---|---|---|---|---|---|
| | System size (mm) | 200x500 | | | | 250x500 | | | |
| Param | Resn, K | 8 | 13 | 19 | 25 | 8 | 10 | 15 | 20 |
| | Duty Cycle | 23.7% | 14.7% | 9.4% | 5.6% | 23.7% | 17.7% | 12.5% | 9.0% |
| | | | | | | | | | |
| Size | # of reflections | 2 | 3 | 4 | 5 | 2 | 3 | 4 | 5 |
| | Length L, mm | 400 | 400 | 400 | 400 | 400 | 400 | 400 | 400 |
| | Width W, mm | 150 | 150 | 150 | 150 | 200 | 200 | 200 | 200 |
| | | | | | | | | | |
| TOF | K, eV | 6000 | 6000 | 6000 | 6000 | 6000 | 6000 | 6000 | 6000 |
| | V tof, mm/us | 34.64 | 34.64 | 34.64 | 34.64 | 34.64 | 34.64 | 34.64 | 34.64 |
| | Leff, mm | 1200 | 1600 | 2000 | 2400 | 1200 | 1600 | 2000 | 2400 |
| | TOF, us | 35 | 46 | 58 | 69 | 35 | 46 | 58 | 69 |
| | | | | | | | | | |
| Beam | Beam, eV | 100 | 50 | 30 | 19 | 100 | 100 | 60 | 40 |
| | V beam, mm/us | 4.47 | 3.16 | 2.45 | 1.95 | 4.47 | 4.47 | 3.46 | 2.83 |
| Trajectory | Z step, mm | 52 | 37 | 28 | 23 | 52 | 52 | 40 | 33 |
| | Inclination, mrad | 129 | 91 | 71 | 56 | 129 | 129 | 100 | 82 |
| | Inclination, deg | 7.6 | 5.4 | 4.2 | 3.3 | 7.6 | 7.6 | 5.9 | 4.8 |
| | Mirr Z edge, mm | 23 | 20 | 18 | 19 | 48 | 23 | 20 | 18 |
| | | | | | | | | | |
| OA | beam d, mm | 1.2 | 1.2 | 1.2 | 1.2 | 1.2 | 1.2 | 1.2 | 1.2 |
| | beam ang, mrad | 17 | 17 | 17 | 17 | 17 | 17 | 17 | 17 |
| | OA length | 37 | 22 | 13 | 8 | 37 | 37 | 25 | 18 |
| | OA time, us | 8.19 | 6.80 | 5.42 | 3.85 | 8.19 | 8.19 | 7.22 | 6.24 |
| | Duty Cycle | 0.237 | 0.147 | 0.094 | 0.056 | 0.237 | 0.177 | 0.125 | 0.090 |
| | | | | | | | | | |
| dK | E, V/mm | 420 | 410 | 340 | 310 | 430 | 410 | 370 | 340 |
| | dK, eV | 504 | 492 | 408 | 372 | 516 | 492 | 444 | 408 |
| R(6%) | dK/K | 8.40% | 8.20% | 6.80% | 6.20% | 8.60% | 8.20% | 7.40% | 6.80% |
| 80000 | Res(dK) | 20825 | 22932 | 48491 | 70166 | 18954 | 22932 | 34575 | 48491 |
| | dT(dK) | 0.83 | 1.01 | 0.60 | 0.49 | 0.91 | 1.01 | 0.83 | 0.71 |
| | | | | | | | | | |
| Packets | Vx, m/s | 76.03 | 53.76 | 41.64 | 33.14 | 76.03 | 76.03 | 58.89 | 48.08 |
| | Turn Around, ns | 1.81 | 1.31 | 1.22 | 1.07 | 1.77 | 1.85 | 1.59 | 1.41 |
| | DAS and Det, ns | 0.7 | 0.7 | 0.7 | 0.7 | 0.7 | 0.7 | 0.7 | 0.7 |
| | | | | | | | | | |
| Resolution | FWHM, ns | 2.11 | 1.80 | 1.53 | 1.37 | 2.11 | 2.22 | 1.93 | 1.73 |
| | Resolution | 8203 | 12863 | 18854 | 25288 | 8210 | 10388 | 14966 | 19999 |
| | | | | | | | | | |
| Mesh | angle, mrad | 7.00 | 6.83 | 5.67 | 5.17 | 7.17 | 6.83 | 6.17 | 5.67 |
| | Y spread, mm | 1.96 | 1.91 | 1.59 | 1.45 | 2.01 | 1.91 | 1.73 | 1.59 |
| | | | | | | | | | |
| | Leff | 1.2 | 1.6 | 2 | 2.4 | 1.2 | 1.6 | 2 | 2.4 |
| | Square | 0.1 | 0.1 | 0.1 | 0.1 | 0.125 | 0.125 | 0.125 | 0.125 |
| | | | | | | | | | |
| | Resolution | 8203 | 12863 | 18854 | 25288 | 8210 | 10388 | 14966 | 19999 |
| | Duty Cycle | 0.237 | 0.147 | 0.094 | 0.056 | 0.237 | 0.177 | 0.125 | 0.090 |
| | Transm OA | 1 | 1 | 0.6 | 0.38 | 1 | 1 | 1 | 0.8 |
| | Res*DC*Transm | 1940 | 1895 | 1063 | 534.3 | 1942 | 1843 | 1871 | 1442 |

Fig. 6B (Cont. I)

| 9 | 10 | 11 | 12 | 13 | 14 | 15 | 16 | 17 | 18 | 19 |
|---|---|---|---|---|---|---|---|---|---|---|
| | | | 250x700 | | | | | | | |
| | | | | | | | | | | |
| 27 | 32 | 38 | 10 | 18 | 27 | 36 | 47 | 16 | 23 | 30 |
| 6.0% | 4.2% | 2.8% | 30.2% | 19.4% | 13.1% | 9.1% | 5.8% | 17.3% | 13.3% | 10.5% |
| | | | | | | | | | | |
| 6 | 7 | 8 | 2 | 3 | 4 | 5 | 6 | 4 | 5 | 6 |
| 400 | 400 | 400 | 600 | 600 | 600 | 600 | 600 | 600 | 600 | 600 |
| 200 | 200 | 200 | 200 | 200 | 200 | 200 | 200 | 350 | 350 | 350 |
| | | | | | | | | | | |
| 6000 | 6000 | 6000 | 6000 | 6000 | 6000 | 6000 | 6000 | 6000 | 6000 | 6000 |
| 34.64 | 34.64 | 34.64 | 34.64 | 34.64 | 34.64 | 34.64 | 34.64 | 34.64 | 34.64 | 34.64 |
| 2800 | 3200 | 3600 | 1600 | 2200 | 2800 | 3400 | 4000 | 2800 | 3400 | 4000 |
| 81 | 92 | 104 | 46 | 64 | 81 | 98 | 115 | 81 | 98 | 115 |
| | | | | | | | | | | |
| 25 | 19 | 15 | 100 | 45 | 25 | 16 | 10 | 100 | 62 | 42 |
| 2.24 | 1.95 | 1.73 | 4.47 | 3.00 | 2.24 | 1.79 | 1.41 | 4.47 | 3.52 | 2.90 |
| 26 | 23 | 20 | 77 | 52 | 39 | 31 | 24 | 77 | 61 | 50 |
| 65 | 56 | 50 | 129 | 87 | 65 | 52 | 41 | 129 | 102 | 84 |
| 3.8 | 3.3 | 2.9 | 7.6 | 5.1 | 3.8 | 3.0 | 2.4 | 7.6 | 6.0 | 4.9 |
| 23 | 21 | 20 | 23 | 22 | 23 | 23 | 27 | 20 | 23 | 24 |
| | | | | | | | | | | |
| 1.2 | 1.2 | 1.2 | 1.2 | 1.2 | 1.2 | 1.2 | 1.2 | 1.2 | 1.2 | 1.2 |
| 17 | 17 | 17 | 17 | 17 | 17 | 17 | 17 | 17 | 17 | 17 |
| 11 | 8 | 5 | 62 | 37 | 24 | 16 | 9 | 62 | 46 | 35 |
| 4.84 | 3.85 | 2.89 | 13.97 | 12.32 | 10.61 | 8.94 | 6.71 | 13.97 | 13.06 | 12.15 |
| 0.060 | 0.042 | 0.028 | 0.302 | 0.194 | 0.131 | 0.091 | 0.058 | 0.173 | 0.133 | 0.105 |
| | | | | | | | | | | |
| 310 | 290 | 280 | 400 | 330 | 310 | 280 | 260 | 330 | 310 | 290 |
| 372 | 348 | 336 | 480 | 396 | 372 | 336 | 312 | 396 | 372 | 348 |
| 6.20% | 5.80% | 5.60% | 8.00% | 6.60% | 6.20% | 5.60% | 5.20% | 6.60% | 6.20% | 5.80% |
| 70166 | 91618 | 105425 | 25313 | 54641 | 70166 | 105425 | 141802 | 54641 | 70166 | 91618 |
| 0.58 | 0.50 | 0.49 | 0.91 | 0.58 | 0.58 | 0.47 | 0.41 | 0.74 | 0.70 | 0.63 |
| | | | | | | | | | | |
| 38.01 | 33.14 | 29.44 | 76.03 | 51.00 | 38.01 | 30.41 | 24.04 | 76.03 | 59.86 | 49.27 |
| 1.23 | 1.14 | 1.05 | 1.90 | 1.55 | 1.23 | 1.09 | 0.92 | 2.30 | 1.93 | 1.70 |
| 0.7 | 0.7 | 0.7 | 0.7 | 0.7 | 0.7 | 0.7 | 0.7 | 0.7 | 0.7 | 0.7 |
| | | | | | | | | | | |
| 1.52 | 1.43 | 1.36 | 2.22 | 1.79 | 1.52 | 1.37 | 1.23 | 2.52 | 2.17 | 1.94 |
| 26503 | 32259 | 38319 | 10396 | 17707 | 26503 | 35732 | 46972 | 16045 | 22617 | 29721 |
| | | | | | | | | | | |
| 5.17 | 4.83 | 4.67 | 6.67 | 5.50 | 5.17 | 4.67 | 4.33 | 5.50 | 5.17 | 4.83 |
| 1.45 | 1.35 | 1.31 | 2.80 | 2.31 | 2.17 | 1.96 | 1.82 | 2.31 | 2.17 | 2.03 |
| | | | | | | | | | | |
| 2.8 | 3.2 | 3.6 | 1.6 | 2.2 | 2.8 | 3.4 | 4 | 2.8 | 3.4 | 4 |
| 0.125 | 0.125 | 0.125 | 0.175 | 0.175 | 0.175 | 0.175 | 0.175 | 0.28 | 0.28 | 0.28 |
| | | | | | | | | | | |
| 26503 | 32259 | 38319 | 10396 | 17707 | 26503 | 35732 | 46972 | 16045 | 22617 | 29721 |
| 0.060 | 0.042 | 0.028 | 0.302 | 0.194 | 0.131 | 0.091 | 0.058 | 0.173 | 0.133 | 0.105 |
| 0.5 | 0.38 | 0.3 | 1 | 0.9 | 0.5 | 0.32 | 0.2 | 1 | 1 | 0.84 |
| 793.3 | 511.2 | 319.3 | 3144 | 3092 | 1740 | 1041 | 546.2 | 2772 | 3010 | 2626 |

Fig. 6B (Cont. II)

| 20 | 21 | 22 | 23 | 24 | 25 | 26 | 27 | 28 | 29 |
|---|---|---|---|---|---|---|---|---|---|
| 400x700 | | | | 400x1000 | | | | | |
| | | | | | | | | | |
| 38 | 46 | 54 | 64 | 30 | 42 | 54 | 69 | 83 | 98 |
| 8.4% | 6.9% | 5.6% | 4.5% | 18.0% | 13.6% | 10.7% | 8.4% | 6.9% | 5.6% |
| | | | | | | | | | |
| 7 | 8 | 9 | 10 | 4 | 5 | 6 | 7 | 8 | 9 |
| 600 | 600 | 600 | 600 | 900 | 900 | 900 | 900 | 900 | 900 |
| 350 | 350 | 350 | 350 | 350 | 350 | 350 | 350 | 350 | 350 |
| | | | | | | | | | |
| 6000 | 6000 | 6000 | 6000 | 6000 | 6000 | 6000 | 6000 | 6000 | 6000 |
| 34.64 | 34.64 | 34.64 | 34.64 | 34.64 | 34.64 | 34.64 | 34.64 | 34.64 | 34.64 |
| 4600 | 5200 | 5800 | 6400 | 4000 | 4900 | 5800 | 6700 | 7600 | 8500 |
| 133 | 150 | 167 | 185 | 115 | 141 | 167 | 193 | 219 | 245 |
| | | | | | | | | | |
| 30 | 23 | 18 | 14 | 42 | 25 | 17 | 12 | 9.5 | 7.5 |
| 2.45 | 2.14 | 1.90 | 1.67 | 2.90 | 2.24 | 1.84 | 1.55 | 1.38 | 1.22 |
| 42 | 37 | 33 | 29 | 75 | 58 | 48 | 40 | 36 | 32 |
| 71 | 62 | 55 | 48 | 84 | 65 | 53 | 45 | 40 | 35 |
| 4.2 | 3.6 | 3.2 | 2.8 | 4.9 | 3.8 | 3.1 | 2.6 | 2.3 | 2.1 |
| 27 | 26 | 27 | 30 | 24 | 30 | 31 | 34 | 32 | 32 |
| | | | | | | | | | |
| 1.2 | 1.2 | 1.2 | 1.2 | 1.2 | 1.2 | 1.2 | 1.2 | 1.2 | 1.2 |
| 17 | 17 | 17 | 17 | 17 | 17 | 17 | 17 | 17 | 17 |
| 27 | 22 | 18 | 14 | 60 | 43 | 33 | 25 | 21 | 17 |
| 11.20 | 10.33 | 9.41 | 8.36 | 20.81 | 19.27 | 17.85 | 16.30 | 15.10 | 13.73 |
| 0.084 | 0.069 | 0.056 | 0.045 | 0.180 | 0.136 | 0.107 | 0.084 | 0.069 | 0.056 |
| | | | | | | | | | |
| 280 | 270 | 260 | 250 | 300 | 290 | 280 | 250 | 240 | 220 |
| 336 | 324 | 312 | 300 | 360 | 348 | 336 | 300 | 288 | 264 |
| 5.60% | 5.40% | 5.20% | 5.00% | 6.00% | 5.80% | 5.60% | 5.00% | 4.80% | 4.40% |
| 105425 | 121933 | 141802 | 165888 | 80000 | 91618 | 105425 | 165888 | 195313 | 276620 |
| 0.63 | 0.62 | 0.59 | 0.56 | 0.72 | 0.77 | 0.79 | 0.58 | 0.56 | 0.44 |
| | | | | | | | | | |
| 41.64 | 36.46 | 32.26 | 28.45 | 49.27 | 38.01 | 31.35 | 26.34 | 23.43 | 20.82 |
| 1.49 | 1.35 | 1.24 | 1.14 | 1.64 | 1.31 | 1.12 | 1.05 | 0.98 | 0.95 |
| 0.7 | 0.7 | 0.7 | 0.7 | 0.7 | 0.7 | 0.7 | 0.7 | 0.7 | 0.7 |
| | | | | | | | | | |
| 1.76 | 1.64 | 1.54 | 1.45 | 1.93 | 1.67 | 1.54 | 1.39 | 1.33 | 1.26 |
| 37720 | 45741 | 54292 | 63824 | 29982 | 42236 | 54335 | 69438 | 82716 | 97531 |
| | | | | | | | | | |
| 4.67 | 4.50 | 4.33 | 4.17 | 5.00 | 4.83 | 4.67 | 4.17 | 4.00 | 3.67 |
| 1.96 | 1.89 | 1.82 | 1.75 | 3.15 | 3.05 | 2.94 | 2.63 | 2.52 | 2.31 |
| | | | | | | | | | |
| 4.6 | 5.2 | 5.8 | 6.4 | 4 | 4.9 | 5.8 | 6.7 | 7.6 | 8.5 |
| 0.28 | 0.28 | 0.28 | 0.28 | 0.4 | 0.4 | 0.4 | 0.4 | 0.4 | 0.4 |
| | | | | | | | | | |
| 37720 | 45741 | 54292 | 63824 | 29982 | 42236 | 54335 | 69438 | 82716 | 97531 |
| 0.084 | 0.069 | 0.056 | 0.045 | 0.180 | 0.136 | 0.107 | 0.084 | 0.069 | 0.056 |
| 0.6 | 0.46 | 0.36 | 0.28 | 0.84 | 0.5 | 0.34 | 0.24 | 0.19 | 0.15 |
| 1908 | 1447 | 1099 | 808.3 | 4538 | 2877 | 1969 | 1404 | 1082 | 818.8 |

Fig. 7

Rk=100K, K=5keV

| | Varient # | 1 | 2 | 3 | 4 | 5 | 6 | 7 | 8 | 9 | 10 |
|---|---|---|---|---|---|---|---|---|---|---|---|
| | System size (mm) | 150x300 | | | | 200x300 | | | | | |
| Param | Resn, K | 4 | 7 | 11 | 15 | 4 | 6 | 8 | 12 | 15 | 7 |
| | Duty Cycle | 26.9% | 14.4% | 7.3% | 2.8% | 24.8% | 17.7% | 12.1% | 7.5% | 4.4% | 26.0% |
| Size | # of reflections | 2 | 3 | 4 | 5 | 2 | 3 | 4 | 5 | 6 | 2 |
| | Length L, mm | 250 | 250 | 250 | 250 | 250 | 250 | 250 | 250 | 250 | 350 |
| | Width W, mm | 110 | 110 | 110 | 110 | 160 | 160 | 160 | 160 | 160 | 110 |
| TOF | K, eV | 3000 | 3000 | 3000 | 3000 | 4000 | 4000 | 4000 | 4000 | 4000 | 5000 |
| | V tof, mm/us | 24.49 | 24.49 | 24.49 | 24.49 | 28.28 | 28.28 | 28.28 | 28.28 | 28.28 | 31.62 |
| | Leff, mm | 625 | 875 | 1125 | 1375 | 625 | 875 | 1125 | 1375 | 1625 | 875 |
| | TOF, us | 26 | 36 | 46 | 56 | 22 | 31 | 40 | 49 | 57 | 28 |
| Beam | Beam, eV | 100 | 44 | 24 | 15 | 100 | 100 | 70 | 42 | 28 | 75 |
| | V beam, mm/us | 4.47 | 2.97 | 2.19 | 1.73 | 4.47 | 4.47 | 3.74 | 2.90 | 2.37 | 3.87 |
| Trajectory | Z step, mm | 46 | 30 | 22 | 18 | 40 | 40 | 33 | 26 | 21 | 43 |
| | Inclination, mrad | 183 | 121 | 89 | 71 | 158 | 158 | 132 | 102 | 84 | 122 |
| | Inclination, deg | 10.7 | 7.1 | 5.3 | 4.2 | 9.3 | 9.3 | 7.8 | 6.0 | 4.9 | 7.2 |
| | Mirr Z edge, mm | 9 | 10 | 10 | 11 | 40 | 21 | 14 | 16 | 17 | 12 |
| OA | beam d, mm | 1.2 | 1.2 | 1.2 | 1.2 | 1.2 | 1.2 | 1.2 | 1.2 | 1.2 | 1.2 |
| | beam ang, mrad | 17 | 17 | 17 | 17 | 17 | 17 | 17 | 17 | 17 | 17 |
| | OA length | 31 | 15 | 7 | 3 | 25 | 25 | 18 | 11 | 6 | 28 |
| | OA time, us | 6.85 | 5.15 | 3.36 | 1.55 | 5.48 | 5.48 | 4.83 | 3.66 | 2.50 | 7.19 |
| | Duty Cycle | 0.269 | 0.144 | 0.073 | 0.028 | 0.248 | 0.177 | 0.121 | 0.075 | 0.044 | 0.260 |
| dK | E, V/mm | 280 | 230 | 210 | 190 | 360 | 330 | 300 | 280 | 260 | 380 |
| | dK, eV | 336 | 276 | 252 | 228 | 432 | 396 | 360 | 336 | 312 | 456 |
| R(6%) | dK/K | 11.2% | 9.2% | 8.4% | 7.6% | 10.8% | 9.9% | 9.0% | 8.4% | 7.8% | 9.1% |
| 100000 | Res(dK) | 8236 | 16091 | 26031 | 38846 | 9526 | 13492 | 19753 | 26031 | 35013 | 18734 |
| | dT(dK) | 1.55 | 0.99 | 0.88 | 0.72 | 1.16 | 1.15 | 1.01 | 0.93 | 0.82 | 0.74 |
| Packets | Vx, m/s | 76.03 | 50.43 | 37.25 | 29.44 | 76.03 | 76.03 | 63.61 | 49.27 | 40.23 | 65.84 |
| | Turn Around, ns | 2.72 | 2.19 | 1.77 | 1.55 | 2.11 | 2.30 | 2.12 | 1.76 | 1.55 | 1.73 |
| | DAS and Det, ns | 0.7 | 0.7 | 0.7 | 0.7 | 0.7 | 0.7 | 0.7 | 0.7 | 0.7 | 0.7 |
| Resolution | FWHM, ns | 3.20 | 2.50 | 2.10 | 1.85 | 2.51 | 2.67 | 2.45 | 2.11 | 1.89 | 2.01 |
| | Resolution | 3983 | 7132 | 10930 | 15191 | 4404 | 5800 | 8120 | 11512 | 15231 | 6885 |
| Mesh | angle, mrad | 9.33 | 7.67 | 7.00 | 6.33 | 9.00 | 8.25 | 7.50 | 7.00 | 6.50 | 7.60 |
| | Y spread, mm | 1.63 | 1.34 | 1.23 | 1.11 | 1.58 | 1.44 | 1.31 | 1.23 | 1.14 | 1.86 |
| | Leff | 0.625 | 0.875 | 1.125 | 1.375 | 0.625 | 0.875 | 1.125 | 1.375 | 1.625 | 0.875 |
| | Square | 0.045 | 0.045 | 0.045 | 0.045 | 0.06 | 0.06 | 0.06 | 0.06 | 0.06 | 0.06 |
| | Resolution | 3983 | 7132 | 10930 | 15191 | 4404 | 5800 | 8120 | 11512 | 15231 | 6885 |
| | Duty Cycle | 0.269 | 0.144 | 0.073 | 0.028 | 0.248 | 0.177 | 0.121 | 0.075 | 0.044 | 0.260 |
| | Transm OA | 2 | 0.88 | 0.48 | 0.3 | 2 | 2 | 1.4 | 0.84 | 0.56 | 1.5 |
| | Res*DC*Transm | 2139 | 904.7 | 383.8 | 125.5 | 2186 | 2057 | 1380 | 728.7 | 371.2 | 2686 |

Fig. 7 (Cont. I)

| 11 | 12 | 13 | 15 | 16 | 17 | 18 | 19 | 20 | 21 | 22 | 23 | 24 | 25 |
|---|---|---|---|---|---|---|---|---|---|---|---|---|---|
| 150x400 | | | 200x400 | | | | | 250x400 | | | | | |
| | | | | | | | | | | | | | |
| 12 | 18 | 24 | 6 | 9 | 14 | 19 | 24 | 6 | 8 | 11 | 15 | 19 | 25 |
| 13.9% | 6.8% | 2.3% | 27.9% | 18.9% | 12.1% | 7.8% | 5.0% | 27.9% | 19.9% | 14.9% | 10.7% | 7.7% | 5.4% |
| | | | | | | | | | | | | | |
| 3 | 4 | 5 | 2 | 3 | 4 | 5 | 6 | 2 | 3 | 4 | 5 | 6 | 7 |
| 350 | 350 | 350 | 350 | 350 | 350 | 350 | 350 | 350 | 350 | 350 | 350 | 350 | 350 |
| 110 | 110 | 110 | 160 | 160 | 160 | 160 | 160 | 210 | 210 | 210 | 210 | 210 | 210 |
| | | | | | | | | | | | | | |
| 5000 | 5000 | 5000 | 5000 | 5000 | 5000 | 5000 | 5000 | 5000 | 5000 | 5000 | 5000 | 5000 | 5000 |
| 31.62 | 31.62 | 31.62 | 31.62 | 31.62 | 31.62 | 31.62 | 31.62 | 31.62 | 31.62 | 31.62 | 31.62 | 31.62 | 31.62 |
| 1225 | 1575 | 1925 | 875 | 1225 | 1575 | 1925 | 2275 | 875 | 1225 | 1575 | 1925 | 2275 | 2625 |
| 39 | 50 | 61 | 28 | 39 | 50 | 61 | 72 | 28 | 39 | 50 | 61 | 72 | 83 |
| | | | | | | | | | | | | | |
| 35 | 19 | 12 | 100 | 80 | 44 | 28 | 20 | 100 | 100 | 85 | 54 | 37 | 26 |
| 2.65 | 1.95 | 1.55 | 4.47 | 4.00 | 2.97 | 2.37 | 2.00 | 4.47 | 4.47 | 4.12 | 3.29 | 2.72 | 2.28 |
| 29 | 22 | 17 | 49 | 44 | 33 | 26 | 22 | 49 | 49 | 46 | 36 | 30 | 25 |
| 84 | 62 | 49 | 141 | 126 | 94 | 75 | 63 | 141 | 141 | 130 | 104 | 86 | 72 |
| 4.9 | 3.6 | 2.9 | 8.3 | 7.4 | 5.5 | 4.4 | 3.7 | 8.3 | 8.3 | 7.7 | 6.1 | 5.1 | 4.2 |
| 11 | 12 | 12 | 31 | 14 | 14 | 15 | 14 | 56 | 31 | 14 | 14 | 15 | 17 |
| | | | | | | | | | | | | | |
| 1.2 | 1.2 | 1.2 | 1.2 | 1.2 | 1.2 | 1.2 | 1.2 | 1.2 | 1.2 | 1.2 | 1.2 | 1.2 | 1.2 |
| 17 | 17 | 17 | 17 | 17 | 17 | 17 | 17 | 17 | 17 | 17 | 17 | 17 | 17 |
| 14 | 7 | 2 | 34 | 29 | 18 | 11 | 7 | 34 | 34 | 31 | 21 | 15 | 10 |
| 5.40 | 3.37 | 1.39 | 7.71 | 7.32 | 6.01 | 4.73 | 3.57 | 7.71 | 7.71 | 7.43 | 6.50 | 5.55 | 4.49 |
| 0.139 | 0.068 | 0.023 | 0.279 | 0.189 | 0.121 | 0.078 | 0.050 | 0.279 | 0.199 | 0.149 | 0.107 | 0.077 | 0.054 |
| | | | | | | | | | | | | | |
| 340 | 300 | 280 | 390 | 370 | 330 | 300 | 280 | 410 | 400 | 350 | 330 | 300 | 280 |
| 408 | 360 | 336 | 468 | 444 | 396 | 360 | 336 | 492 | 480 | 420 | 396 | 360 | 336 |
| 8.2% | 7.2% | 6.7% | 9.4% | 8.9% | 7.9% | 7.2% | 6.7% | 9.8% | 9.6% | 8.4% | 7.9% | 7.2% | 6.7% |
| 29231 | 48225 | 63552 | 16885 | 20843 | 32939 | 48225 | 63552 | 13824 | 15259 | 26031 | 32939 | 48225 | 63552 |
| 0.66 | 0.52 | 0.48 | 0.82 | 0.93 | 0.76 | 0.63 | 0.57 | 1.00 | 1.27 | 0.96 | 0.92 | 0.75 | 0.65 |
| | | | | | | | | | | | | | |
| 44.98 | 33.14 | 26.34 | 76.03 | 68.00 | 50.43 | 40.23 | 34.00 | 76.03 | 76.03 | 70.09 | 55.87 | 46.24 | 38.77 |
| 1.32 | 1.10 | 0.94 | 1.95 | 1.84 | 1.53 | 1.34 | 1.21 | 1.85 | 1.90 | 2.00 | 1.69 | 1.54 | 1.38 |
| 0.7 | 0.7 | 0.7 | 0.7 | 0.7 | 0.7 | 0.7 | 0.7 | 0.7 | 0.7 | 0.7 | 0.7 | 0.7 | 0.7 |
| | | | | | | | | | | | | | |
| 1.64 | 1.41 | 1.27 | 2.23 | 2.18 | 1.84 | 1.64 | 1.51 | 2.22 | 2.39 | 2.33 | 2.05 | 1.85 | 1.68 |
| 11834 | 17712 | 24032 | 6211 | 8905 | 13512 | 18570 | 23797 | 6231 | 8103 | 10701 | 14834 | 19444 | 24657 |
| | | | | | | | | | | | | | |
| 6.80 | 6.00 | 5.60 | 7.80 | 7.40 | 6.60 | 6.00 | 5.60 | 8.20 | 8.00 | 7.00 | 6.60 | 6.00 | 5.60 |
| 1.67 | 1.47 | 1.37 | 1.91 | 1.81 | 1.62 | 1.47 | 1.37 | 2.01 | 1.96 | 1.72 | 1.62 | 1.47 | 1.37 |
| | | | | | | | | | | | | | |
| | | | | | | | | | | | | | |
| 1.225 | 1.575 | 1.925 | 0.875 | 1.225 | 1.575 | 1.925 | 2.275 | 0.875 | 1.225 | 1.575 | 1.925 | 2.275 | 2.625 |
| 0.06 | 0.06 | 0.06 | 0.08 | 0.08 | 0.08 | 0.08 | 0.08 | 0.1 | 0.1 | 0.1 | 0.1 | 0.1 | 0.1 |
| | | | | | | | | | | | | | |
| 11834 | 17712 | 24032 | 6211 | 8905 | 13512 | 18570 | 23797 | 6231 | 8103 | 10701 | 14834 | 19444 | 24657 |
| 0.139 | 0.068 | 0.023 | 0.279 | 0.189 | 0.121 | 0.078 | 0.050 | 0.279 | 0.199 | 0.149 | 0.107 | 0.077 | 0.054 |
| 0.7 | 0.38 | 0.24 | 2 | 1.6 | 0.88 | 0.56 | 0.4 | 2 | 2 | 1.7 | 1.08 | 0.74 | 0.52 |
| 1154 | 455.8 | 131.3 | 3463 | 2691 | 1435 | 807.9 | 472.1 | 3474 | 3227 | 2714 | 1712 | 1111 | 693.5 |

Fig. 7 (Cont. II)

| 26 | 27 | 28 | 29 | 30 | 31 | 34 | 35 | 36 | 37 | 38 | 39 | 40 |
|---|---|---|---|---|---|---|---|---|---|---|---|---|
| | 200x500 | | | | | 250x500 | | | | | | |
| | | | | | | | | | | | | |
| 30 | 8 | 13 | 19 | 26 | 34 | 8 | 10 | 15 | 21 | 27 | 35 | 43 |
| 3.6% | 30.6% | 19.0% | 12.3% | 8.1% | 5.3% | 30.6% | 21.5% | 14.8% | 11.0% | 8.1% | 5.7% | 3.8% |
| | | | | | | | | | | | | |
| 8 | 2 | 3 | 4 | 5 | 6 | 2 | 3 | 4 | 5 | 6 | 7 | 8 |
| 350 | 450 | 450 | 450 | 450 | 450 | 450 | 450 | 450 | 450 | 450 | 450 | 450 |
| 210 | 160 | 160 | 160 | 160 | 160 | 210 | 210 | 210 | 210 | 210 | 210 | 210 |
| | | | | | | | | | | | | |
| 5000 | 5000 | 5000 | 5000 | 5000 | 5000 | 5000 | 5000 | 5000 | 5000 | 5000 | 5000 | 5000 |
| 31.62 | 31.62 | 31.62 | 31.62 | 31.62 | 31.62 | 31.62 | 31.62 | 31.62 | 31.62 | 31.62 | 31.62 | 31.62 |
| 2975 | 1125 | 1575 | 2025 | 2475 | 2925 | 1125 | 1575 | 2025 | 2475 | 2925 | 3375 | 3825 |
| 94 | 36 | 50 | 64 | 78 | 92 | 36 | 50 | 64 | 78 | 92 | 107 | 121 |
| | | | | | | | | | | | | |
| 19 | 100 | 50 | 28 | 18 | 13 | 100 | 90 | 50 | 36 | 25 | 17 | 12 |
| 1.95 | 4.47 | 3.16 | 2.37 | 1.90 | 1.61 | 4.47 | 4.24 | 3.16 | 2.68 | 2.24 | 1.84 | 1.55 |
| 22 | 64 | 45 | 34 | 27 | 23 | 64 | 60 | 45 | 38 | 32 | 26 | 22 |
| 62 | 141 | 100 | 75 | 60 | 51 | 141 | 134 | 100 | 85 | 71 | 58 | 49 |
| 3.6 | 8.3 | 5.9 | 4.4 | 3.5 | 3.0 | 8.3 | 7.9 | 5.9 | 5.0 | 4.2 | 3.4 | 2.9 |
| 19 | 16 | 13 | 13 | 13 | 11 | 41 | 14 | 15 | 10 | 10 | 13 | 17 |
| | | | | | | | | | | | | |
| 1.2 | 1.2 | 1.2 | 1.2 | 1.2 | 1.2 | 1.2 | 1.2 | 1.2 | 1.2 | 1.2 | 1.2 | 1.2 |
| 17 | 17 | 17 | 17 | 17 | 17 | 17 | 17 | 17 | 17 | 17 | 17 | 17 |
| 7 | 49 | 30 | 19 | 12 | 8 | 49 | 45 | 30 | 23 | 17 | 11 | 7 |
| 3.37 | 10.88 | 9.49 | 7.89 | 6.32 | 4.93 | 10.88 | 10.69 | 9.49 | 8.64 | 7.52 | 6.10 | 4.55 |
| 0.036 | 0.306 | 0.190 | 0.123 | 0.081 | 0.053 | 0.306 | 0.215 | 0.148 | 0.110 | 0.081 | 0.057 | 0.038 |
| | | | | | | | | | | | | |
| 260 | 380 | 330 | 300 | 270 | 260 | 400 | 380 | 350 | 290 | 260 | 250 | 240 |
| 312 | 456 | 396 | 360 | 324 | 312 | 480 | 456 | 420 | 348 | 312 | 300 | 288 |
| 6.2% | 9.1% | 7.9% | 7.2% | 6.5% | 6.2% | 9.6% | 9.1% | 8.4% | 7.0% | 6.2% | 6.0% | 5.8% |
| 85480 | 18734 | 32939 | 48225 | 73503 | 85480 | 15259 | 18734 | 26031 | 55229 | 85480 | 100000 | 117738 |
| 0.55 | 0.95 | 0.76 | 0.66 | 0.53 | 0.54 | 1.17 | 1.33 | 1.23 | 0.71 | 0.54 | 0.53 | 0.51 |
| | | | | | | | | | | | | |
| 33.14 | 76.03 | 53.76 | 40.23 | 32.26 | 27.41 | 76.03 | 72.12 | 53.76 | 45.62 | 38.01 | 31.35 | 26.34 |
| 1.27 | 2.00 | 1.63 | 1.34 | 1.19 | 1.05 | 1.90 | 1.90 | 1.54 | 1.57 | 1.46 | 1.25 | 1.10 |
| 0.7 | 0.7 | 0.7 | 0.7 | 0.7 | 0.7 | 0.7 | 0.7 | 0.7 | 0.7 | 0.7 | 0.7 | 0.7 |
| | | | | | | | | | | | | |
| 1.55 | 2.32 | 1.93 | 1.65 | 1.48 | 1.38 | 2.34 | 2.42 | 2.09 | 1.86 | 1.71 | 1.53 | 1.40 |
| 30254 | 7659 | 12920 | 19382 | 26380 | 33603 | 7611 | 10288 | 15330 | 21019 | 27063 | 34833 | 43221 |
| | | | | | | | | | | | | |
| 5.20 | 7.60 | 6.60 | 6.00 | 5.40 | 5.20 | 8.00 | 7.60 | 7.00 | 5.80 | 5.20 | 5.00 | 4.80 |
| 1.27 | 2.39 | 2.08 | 1.89 | 1.70 | 1.64 | 2.52 | 2.39 | 2.21 | 1.83 | 1.64 | 1.58 | 1.51 |
| | | | | | | | | | | | | |
| | | | | | | | | | | | | |
| 2.975 | 1.125 | 1.575 | 2.025 | 2.475 | 2.925 | 1.125 | 1.575 | 2.025 | 2.475 | 2.925 | 3.375 | 3.825 |
| 0.1 | 0.1 | 0.1 | 0.1 | 0.1 | 0.1 | 0.125 | 0.125 | 0.125 | 0.125 | 0.125 | 0.125 | 0.125 |
| | | | | | | | | | | | | |
| 30254 | 7659 | 12920 | 19382 | 26380 | 33603 | 7611 | 10288 | 15330 | 21019 | 27063 | 34833 | 43221 |
| 0.036 | 0.306 | 0.190 | 0.123 | 0.081 | 0.053 | 0.306 | 0.215 | 0.148 | 0.110 | 0.081 | 0.057 | 0.038 |
| 0.38 | 2 | 1 | 0.56 | 0.36 | 0.26 | 2 | 1.8 | 1 | 0.72 | 0.5 | 0.34 | 0.24 |
| 412.2 | 4683 | 2461 | 1338 | 767.4 | 465.4 | 4654 | 3976 | 2271 | 1671 | 1100 | 676.4 | 390 |

Fig. 8

200x500, N=5 reflections, optimizing DC

| | Varient # | 27 | 28 | 29 | 30 | 31 | 30 | 31 |
|---|---|---|---|---|---|---|---|---|
| | System size (mm) | 200x500 | | | | | | |
| Param | Resn, K | 31 | 30 | 29 | 28 | 28 | 27 | 26 |
| | Duty Cycle | 7.7% | 7.8% | 7.7% | 7.8% | 7.7% | 7.7% | 7.6% |
| Size | # of reflections | 5 | 5 | 5 | 5 | 5 | 5 | 5 |
| | Length L, mm | 450 | 450 | 450 | 450 | 450 | 450 | 450 |
| | Width W, mm | 160 | 160 | 160 | 160 | 160 | 160 | 160 |
| TOF | K, eV | 4000 | 5000 | 6000 | 7000 | 8000 | 9000 | 10000 |
| | V tof, mm/us | 28.28 | 31.62 | 34.64 | 37.42 | 40.00 | 42.43 | 44.72 |
| | Leff, mm | 2475 | 2475 | 2475 | 2475 | 2475 | 2475 | 2475 |
| | TOF, us | 88 | 78 | 71 | 66 | 62 | 58 | 55 |
| Beam | Beam, eV | 13.5 | 17 | 20 | 24 | 27 | 30 | 33 |
| | V beam, mm/us | 1.64 | 1.84 | 2.00 | 2.19 | 2.32 | 2.45 | 2.57 |
| Trajectory | Z step, mm | 26 | 26 | 26 | 26 | 26 | 26 | 26 |
| | Inclination, mrad | 58 | 58 | 58 | 59 | 58 | 58 | 57 |
| | Inclination, deg | 3.4 | 3.4 | 3.4 | 3.4 | 3.4 | 3.4 | 3.4 |
| | Mirr Z edge, mm | 15 | 14 | 15 | 14 | 15 | 15 | 15 |
| OA | beam d, mm | 1.2 | 1.2 | 1.2 | 1.2 | 1.2 | 1.2 | 1.2 |
| | beam ang, mrad | 17 | 17 | 17 | 17 | 17 | 17 | 17 |
| | OA length | 11 | 11 | 11 | 11 | 11 | 11 | 11 |
| | OA time, us | 6.78 | 6.10 | 5.49 | 5.18 | 4.80 | 4.48 | 4.22 |
| | Duty Cycle | 0.077 | 0.078 | 0.077 | 0.078 | 0.077 | 0.077 | 0.076 |
| dK | E, V/mm | 260 | 320 | 380 | 450 | 520 | 570 | 640 |
| | dK, eV | 312 | 384 | 456 | 540 | 624 | 684 | 768 |
| R(6%) | dK/K | 7.8% | 7.7% | 7.6% | 7.7% | 7.8% | 7.6% | 7.7% |
| 200000 | Res(dK) | 70026 | 74506 | 77693 | 73190 | 70026 | 77693 | 74506 |
| | dT(dK) | 0.62 | 0.53 | 0.46 | 0.45 | 0.44 | 0.38 | 0.37 |
| Packets | Vx, m/s | 27.93 | 31.35 | 34.00 | 37.25 | 39.50 | 41.64 | 43.67 |
| | Turn Around, ns | 1.07 | 0.98 | 0.89 | 0.83 | 0.76 | 0.73 | 0.68 |
| | DAS and Det, ns | 0.7 | 0.7 | 0.7 | 0.7 | 0.7 | 0.7 | 0.7 |
| Resolution | FWHM, ns | 1.43 | 1.31 | 1.23 | 1.17 | 1.12 | 1.08 | 1.05 |
| | Resolution | 30673 | 29792 | 29149 | 28162 | 27536 | 27028 | 26461 |
| Mesh | angle, mrad | 6.50 | 6.40 | 6.33 | 6.43 | 6.50 | 6.33 | 6.40 |
| | Y spread, mm | 2.05 | 2.02 | 2.00 | 2.03 | 2.05 | 2.00 | 2.02 |
| | Leff | 2.475 | 2.475 | 2.475 | 2.475 | 2.475 | 2.475 | 2.475 |
| | Square | 0.1 | 0.1 | 0.1 | 0.1 | 0.1 | 0.1 | 0.1 |
| | Resolution | 30673 | 29792 | 29149 | 28162 | 27536 | 27028 | 26461 |
| | Duty Cycle | 0.077 | 0.078 | 0.077 | 0.078 | 0.077 | 0.077 | 0.076 |
| | Transm OA | 0.27 | 0.34 | 0.4 | 0.48 | 0.54 | 0.6 | 0.66 |
| | Res*DC*Transm | 641.79 | 788.86 | 895.99 | 1058.6 | 1152.3 | 1246.2 | 1332.8 |

Fig. 8 (Cont.)

| 34 | 35 | 36 | 37 | 38 | 39 | 40 |
|---|---|---|---|---|---|---|
| 250x500 | | | | | | |
| | | | | | | |
| 25 | 24 | 24 | 23 | 23 | 23 | 22 |
| 10.7% | 10.7% | 10.7% | 10.7% | 10.7% | 10.7% | 10.7% |
| | | | | | | |
| 5 | 5 | 5 | 5 | 5 | 5 | 5 |
| 450 | 450 | 450 | 450 | 450 | 450 | 450 |
| 210 | 210 | 210 | 210 | 210 | 210 | 210 |
| | | | | | | |
| 4000 | 5000 | 6000 | 7000 | 8000 | 9000 | 10000 |
| 28.28 | 31.62 | 34.64 | 37.42 | 40.00 | 42.43 | 44.72 |
| 2475 | 2475 | 2475 | 2475 | 2475 | 2475 | 2475 |
| 88 | 78 | 71 | 66 | 62 | 58 | 55 |
| | | | | | | |
| 26 | 33 | 39 | 46 | 52 | 59 | 65 |
| 2.28 | 2.57 | 2.79 | 3.03 | 3.22 | 3.44 | 3.61 |
| 36 | 37 | 36 | 36 | 36 | 36 | 36 |
| 81 | 81 | 81 | 81 | 81 | 81 | 81 |
| 4.7 | 4.8 | 4.7 | 4.8 | 4.7 | 4.8 | 4.7 |
| 14 | 14 | 14 | 14 | 14 | 14 | 14 |
| | | | | | | |
| 1.2 | 1.2 | 1.2 | 1.2 | 1.2 | 1.2 | 1.2 |
| 17 | 17 | 17 | 17 | 17 | 17 | 17 |
| 21 | 22 | 21 | 21 | 21 | 21 | 21 |
| 9.33 | 8.39 | 7.62 | 7.08 | 6.60 | 6.24 | 5.90 |
| 0.107 | 0.107 | 0.107 | 0.107 | 0.107 | 0.107 | 0.107 |
| | | | | | | |
| 270 | 350 | 410 | 460 | 520 | 600 | 650 |
| 324 | 420 | 492 | 552 | 624 | 720 | 780 |
| 8.1% | 8.4% | 8.2% | 7.9% | 7.8% | 8.0% | 7.8% |
| 60214 | 52062 | 57330 | 67030 | 70026 | 63281 | 70026 |
| 0.73 | 0.75 | 0.62 | 0.49 | 0.44 | 0.46 | 0.40 |
| | | | | | | |
| 38.77 | 43.67 | 47.48 | 51.56 | 54.82 | 58.40 | 61.29 |
| 1.44 | 1.25 | 1.16 | 1.12 | 1.05 | 0.97 | 0.94 |
| 0.7 | 0.7 | 0.7 | 0.7 | 0.7 | 0.7 | 0.7 |
| | | | | | | |
| 1.75 | 1.62 | 1.49 | 1.41 | 1.34 | 1.28 | 1.24 |
| 24932 | 24213 | 23980 | 23445 | 23080 | 22709 | 22332 |
| | | | | | | |
| 6.75 | 7.00 | 6.83 | 6.57 | 6.50 | 6.67 | 6.50 |
| 2.13 | 2.21 | 2.15 | 2.07 | 2.05 | 2.10 | 2.05 |
| | | | | | | |
| | | | | | | |
| 2.475 | 2.475 | 2.475 | 2.475 | 2.475 | 2.475 | 2.475 |
| 0.125 | 0.125 | 0.125 | 0.125 | 0.125 | 0.125 | 0.125 |
| | | | | | | |
| 24932 | 24213 | 23980 | 23445 | 23080 | 22709 | 22332 |
| 0.107 | 0.107 | 0.107 | 0.107 | 0.107 | 0.107 | 0.107 |
| 0.52 | 0.66 | 0.78 | 0.92 | 1.04 | 1.18 | 1.3 |
| 1382.6 | 1713.4 | 1994.7 | 2309.2 | 2559.9 | 2866.3 | 3096.1 |

Fig. 9

200x500, N=6 reflections, optimizing DC

| | | | | | Optimum for R=20K | | | |
|---|---|---|---|---|---|---|---|---|
| | Point | 27 | 28 | 29 | 30 | 31 | 30 | 31 |
| | System | 200x500 | | | | | | |
| Param | Resn, K | 39 | 38 | 37 | 36 | 35 | 34 | 33 |
| | Duty Cycle | 4.9% | 4.9% | 4.8% | 4.7% | 4.9% | 4.8% | 4.7% |
| Size | # of reflections | 6 | 6 | 6 | 6 | 6 | 6 | 6 |
| | Length L, mm | 450 | 450 | 450 | 450 | 450 | 450 | 450 |
| | Width W, mm | 160 | 160 | 160 | 160 | 160 | 160 | 160 |
| TOF | K, eV | 4000 | 5000 | 6000 | 7000 | 8000 | 9000 | 10000 |
| | V tof, mm/us | 28.28 | 31.62 | 34.64 | 37.42 | 40.00 | 42.43 | 44.72 |
| | Leff, mm | 2925 | 2925 | 2925 | 2925 | 2925 | 2925 | 2925 |
| | TOF, us | 103 | 92 | 84 | 78 | 73 | 69 | 65 |
| Beam | Beam, eV | 9.5 | 12 | 14 | 16 | 19 | 21 | 23 |
| | V beam, mm/us | 1.38 | 1.55 | 1.67 | 1.79 | 1.95 | 2.05 | 2.14 |
| Trajectory | Z step, mm | 22 | 22 | 22 | 22 | 22 | 22 | 22 |
| | Inclination, mrad | 49 | 49 | 48 | 48 | 49 | 48 | 48 |
| | Inclination, deg | 2.9 | 2.9 | 2.8 | 2.8 | 2.9 | 2.8 | 2.8 |
| | Mirr Z edge, mm | 14 | 14 | 15 | 15 | 14 | 15 | 15 |
| OA | beam d, mm | 1.2 | 1.2 | 1.2 | 1.2 | 1.2 | 1.2 | 1.2 |
| | beam ang, mrad | 17 | 17 | 17 | 17 | 17 | 17 | 17 |
| | OA length | 7 | 7 | 7 | 7 | 7 | 7 | 7 |
| | OA time, us | 5.03 | 4.55 | 4.03 | 3.64 | 3.56 | 3.29 | 3.07 |
| | Duty Cycle | 0.049 | 0.049 | 0.048 | 0.047 | 0.049 | 0.048 | 0.047 |
| dK | E, V/mm | 240 | 280 | 340 | 410 | 490 | 540 | 590 |
| | dK, eV | 288 | 336 | 408 | 492 | 588 | 648 | 708 |
| R(6%) | dK/K | 7.2% | 6.7% | 6.8% | 7.0% | 7.4% | 7.2% | 7.1% |
| 200000 | Res(dK) | 96451 | 127104 | 121227 | 106210 | 88615 | 96451 | 103158 |
| | dT(dK) | 0.54 | 0.36 | 0.35 | 0.37 | 0.41 | 0.36 | 0.32 |
| Packets | Vx, m/s | 23.43 | 26.34 | 28.45 | 30.41 | 33.14 | 34.84 | 36.46 |
| | Turn Around, ns | 0.98 | 0.94 | 0.84 | 0.74 | 0.68 | 0.65 | 0.62 |
| | DAS and Det, ns | 0.7 | 0.7 | 0.7 | 0.7 | 0.7 | 0.7 | 0.7 |
| Resolution | FWHM, ns | 1.32 | 1.23 | 1.15 | 1.08 | 1.06 | 1.02 | 0.99 |
| | Resolution | 39304 | 37673 | 36869 | 36050 | 34597 | 33900 | 33163 |
| Mesh | angle, mrad | 6.00 | 5.60 | 5.67 | 5.86 | 6.13 | 6.00 | 5.90 |
| | Y spread, mm | 1.89 | 1.76 | 1.79 | 1.85 | 1.93 | 1.89 | 1.86 |
| | Leff | 2.925 | 2.925 | 2.925 | 2.925 | 2.925 | 2.925 | 2.925 |
| | Square | 0.1 | 0.1 | 0.1 | 0.1 | 0.1 | 0.1 | 0.1 |
| | Resolution | 39304 | 37673 | 36869 | 36050 | 34597 | 33900 | 33163 |
| | Duty Cycle | 0.049 | 0.049 | 0.048 | 0.047 | 0.049 | 0.048 | 0.047 |
| | Transm OA | 0.19 | 0.24 | 0.28 | 0.32 | 0.38 | 0.42 | 0.46 |
| | Res*DC*Transm | 363.07 | 444.54 | 492.23 | 537.37 | 639.16 | 678.9 | 715.71 |

Fig. 9 (Cont.)

| 34 | 35 | 36 | 37 | 38 | 39 | 40 |
|---|---|---|---|---|---|---|
| 250x500 | | | | | | |
| | | | | | | |
| 32 | 31 | 31 | 30 | 29 | 29 | 29 |
| 7.7% | 7.7% | 7.7% | 7.8% | 7.7% | 7.7% | 7.7% |
| | | | | | | |
| 6 | 6 | 6 | 6 | 6 | 6 | 6 |
| 450 | 450 | 450 | 450 | 450 | 450 | 450 |
| 210 | 210 | 210 | 210 | 210 | 210 | 210 |
| | | | | | | |
| 4000 | 5000 | 6000 | 7000 | 8000 | 9000 | 10000 |
| 28.28 | 31.62 | 34.64 | 37.42 | 40.00 | 42.43 | 44.72 |
| 2925 | 2925 | 2925 | 2925 | 2925 | 2925 | 2925 |
| 103 | 92 | 84 | 78 | 73 | 69 | 65 |
| | | | | | | |
| 18 | 22 | 27 | 32 | 36 | 40 | 44 |
| 1.90 | 2.10 | 2.32 | 2.53 | 2.68 | 2.83 | 2.97 |
| 30 | 30 | 30 | 30 | 30 | 30 | 30 |
| 67 | 66 | 67 | 68 | 67 | 67 | 66 |
| 3.9 | 3.9 | 3.9 | 4.0 | 3.9 | 3.9 | 3.9 |
| 14 | 15 | 14 | 14 | 14 | 15 | 15 |
| | | | | | | |
| 1.2 | 1.2 | 1.2 | 1.2 | 1.2 | 1.2 | 1.2 |
| 17 | 17 | 17 | 17 | 17 | 17 | 17 |
| 15 | 15 | 15 | 15 | 15 | 15 | 15 |
| 8.00 | 7.08 | 6.54 | 6.10 | 5.66 | 5.30 | 5.01 |
| 0.077 | 0.077 | 0.077 | 0.078 | 0.077 | 0.077 | 0.077 |
| | | | | | | |
| 260 | 340 | 380 | 420 | 480 | 560 | 630 |
| 312 | 408 | 456 | 504 | 576 | 672 | 756 |
| 7.8% | 8.2% | 7.6% | 7.2% | 7.2% | 7.5% | 7.6% |
| 70026 | 58462 | 77693 | 96451 | 96451 | 83393 | 79350 |
| 0.74 | 0.79 | 0.54 | 0.41 | 0.38 | 0.41 | 0.41 |
| | | | | | | |
| 32.26 | 35.66 | 39.50 | 43.01 | 45.62 | 48.08 | 50.43 |
| 1.24 | 1.05 | 1.04 | 1.02 | 0.95 | 0.86 | 0.80 |
| 0.7 | 0.7 | 0.7 | 0.7 | 0.7 | 0.7 | 0.7 |
| | | | | | | |
| 1.60 | 1.49 | 1.37 | 1.30 | 1.24 | 1.18 | 1.14 |
| 32227 | 31069 | 30906 | 29954 | 29493 | 29153 | 28675 |
| | | | | | | |
| 6.50 | 6.80 | 6.33 | 6.00 | 6.00 | 6.22 | 6.30 |
| 2.05 | 2.14 | 2.00 | 1.89 | 1.89 | 1.96 | 1.98 |
| | | | | | | |
| | | | | | | |
| 2.925 | 2.925 | 2.925 | 2.925 | 2.925 | 2.925 | 2.925 |
| 0.125 | 0.125 | 0.125 | 0.125 | 0.125 | 0.125 | 0.125 |
| | | | | | | |
| 32227 | 31069 | 30906 | 29954 | 29493 | 29153 | 28675 |
| 0.077 | 0.077 | 0.077 | 0.078 | 0.077 | 0.077 | 0.077 |
| 0.36 | 0.44 | 0.54 | 0.64 | 0.72 | 0.8 | 0.88 |
| 897.97 | 1046.3 | 1291.7 | 1495.3 | 1643.6 | 1794.1 | 1931.3 |

DC=10%

Fig. 10

| | | | | | | | | |
|---|---|---|---|---|---|---|---|---|
| | Variant | 1 | 2 | 3 | 4 | 5 | 6 | 7 |
| Param | Resn, K | 9 | 9 | 13 | 14 | 15 | 17 | 23 |
| | Duty Cycle | 9.8% | 11.9% | 7.7% | 12.8% | 12.0% | 10.7% | 10.4% |
| | | | | | | | | |
| Size | # of reflections | 3 | 4 | 5 | 3 | 4 | 5 | 4 |
| | Length L, mm | 250 | 250 | 250 | 350 | 350 | 350 | 450 |
| | Width W, mm | 110 | 160 | 160 | 110 | 160 | 210 | 150 |
| | | | | | | | | |
| TOF | K, eV | 6000 | 6000 | 6000 | 6000 | 6000 | 6000 | 9200 |
| | V tof, mm/us | 34.64 | 34.64 | 34.64 | 34.64 | 34.64 | 34.64 | 42.90 |
| | Leff, mm | 875 | 1125 | 1375 | 1225 | 1575 | 1925 | 2200 |
| | TOF, us | 25 | 32 | 40 | 35 | 45 | 56 | 51 |
| | | | | | | | | |
| Beam | Beam, eV | 50 | 100 | 65 | 36 | 52 | 65 | 42 |
| | V beam, mm/us | 3.16 | 4.47 | 3.61 | 2.68 | 3.22 | 3.61 | 2.90 |
| Trajectory | Z step, mm | 23 | 32 | 26 | 27 | 33 | 36 | 30 |
| | Inclination, mrad | 91 | 129 | 104 | 77 | 93 | 104 | 68 |
| | Inclination, deg | 5.4 | 7.6 | 6.1 | 4.6 | 5.5 | 6.1 | 4.0 |
| | Mirr Z edge, mm | 21 | 15 | 15 | 14 | 15 | 14 | 14 |
| | | | | | | | | |
| OA | beam d, mm | 1.2 | 1.2 | 1.2 | 1.2 | 1.2 | 1.2 | 1.2 |
| | beam ang, mrad | 17 | 17 | 17 | 17 | 17 | 17 | 17 |
| | OA length | 8 | 17 | 11 | 12 | 18 | 21 | 15 |
| | OA time, us | 2.47 | 3.86 | 3.06 | 4.51 | 5.45 | 5.94 | 5.32 |
| | Duty Cycle | 0.098 | 0.119 | 0.077 | 0.128 | 0.120 | 0.107 | 0.104 |
| | | | | | | | | |
| dK | E, V/mm | 500 | 540 | 500 | 470 | 460 | 470 | 660 |
| | dK, eV | 600 | 648 | 600 | 564 | 552 | 564 | 792 |
| R(6%) | dK/K | 10.0% | 10.8% | 10.0% | 9.4% | 9.2% | 9.4% | 8.6% |
| 250000 | Res(dK) | 32400 | 23815 | 32400 | 41499 | 45227 | 41499 | 58992 |
| | dT(dK) | 0.39 | 0.68 | 0.61 | 0.43 | 0.50 | 0.67 | 0.43 |
| | | | | | | | | |
| Packets | Vx, m/s | 53.76 | 76.03 | 61.29 | 45.62 | 54.82 | 61.29 | 49.27 |
| | Turn Around, ns | 1.08 | 1.41 | 1.23 | 0.97 | 1.19 | 1.30 | 0.75 |
| | DAS and Det, ns | 0.7 | 0.7 | 0.7 | 0.7 | 0.7 | 0.7 | 0.7 |
| | | | | | | | | |
| Resolution | FWHM, ns | 1.34 | 1.71 | 1.54 | 1.27 | 1.47 | 1.62 | 1.11 |
| | Resolution | 9419 | 9475 | 12897 | 13920 | 15457 | 17104 | 23064 |
| | | | | | | | | |
| Mesh | angle, mrad | 8.33 | 9.00 | 8.33 | 7.83 | 7.67 | 7.83 | 7.17 |
| | Y spread, mm | 1.46 | 1.58 | 1.46 | 1.92 | 1.88 | 1.92 | 2.26 |
| | | | | | | | | |
| | | | | | | | | |
| | Leff | 0.875 | 1.125 | 1.375 | 1.225 | 1.575 | 1.925 | 2.2 |
| | Square | 0.045 | 0.06 | 0.06 | 0.06 | 0.08 | 0.1 | 0.1 |
| | | | | | | | | |
| | Resolution | 9419 | 9475 | 12897 | 13920 | 15457 | 17104 | 23064 |
| | Duty Cycle | 0.098 | 0.119 | 0.077 | 0.128 | 0.120 | 0.107 | 0.104 |
| | Transm OA | 1 | 2 | 1.3 | 0.72 | 1.04 | 1.3 | 0.84 |
| | Res*DC*Transm | 922.3 | 2254 | 1291 | 1279 | 1928 | 2378 | 2008 |

Fig. 10 (Cont.)

| | | | | |
|---|---|---|---|---|
| 8 | 9 | 10 | 11 | 12 |
| 26 | 31 | 38 | 51 | 64 |
| 9.3% | 13.9% | 10.8% | 13.8% | 10.9% |
| | | | | |
| 5 | 4 | 6 | 5 | 6 |
| 450 | 650 | 650 | 950 | 950 |
| 200 | 200 | 350 | 350 | 350 |
| | | | | |
| 9200 | 9200 | 9200 | 9200 | 9200 |
| 42.90 | 42.90 | 42.90 | 42.90 | 42.90 |
| 2650 | 3000 | 4300 | 5150 | 6100 |
| 62 | 70 | 100 | 120 | 142 |
| | | | | |
| 50 | 38 | 60 | 36 | 25 |
| 3.16 | 2.76 | 3.46 | 2.68 | 2.24 |
| 33 | 42 | 52 | 59 | 50 |
| 74 | 64 | 81 | 63 | 52 |
| 4.3 | 3.8 | 4.8 | 3.7 | 3.1 |
| 17 | 16 | 18 | 26 | 26 |
| | | | | |
| 1.2 | 1.2 | 1.2 | 1.2 | 1.2 |
| 17 | 17 | 17 | 17 | 17 |
| 18 | 27 | 37 | 44 | 35 |
| 5.75 | 9.71 | 10.82 | 16.56 | 15.44 |
| 0.093 | 0.139 | 0.108 | 0.138 | 0.109 |
| | | | | |
| 640 | 600 | 580 | 530 | 510 |
| 768 | 720 | 696 | 636 | 612 |
| 8.3% | 7.8% | 7.6% | 6.9% | 6.7% |
| 66719 | 86371 | 98914 | 141863 | 165459 |
| 0.46 | 0.40 | 0.51 | 0.42 | 0.43 |
| | | | | |
| 53.76 | 46.87 | 58.89 | 45.62 | 38.01 |
| 0.84 | 0.78 | 1.02 | 0.86 | 0.75 |
| 0.7 | 0.7 | 0.7 | 0.7 | 0.7 |
| | | | | |
| 1.19 | 1.12 | 1.33 | 1.19 | 1.11 |
| 26014 | 31103 | 37593 | 50558 | 64106 |
| | | | | |
| 6.96 | 6.52 | 6.30 | 5.76 | 5.54 |
| 2.19 | 2.97 | 2.87 | 3.83 | 3.69 |
| | | | | |
| | | | | |
| 2.65 | 3 | 4.3 | 5.15 | 6.1 |
| 0.125 | 0.175 | 0.28 | 0.4 | 0.4 |
| | | | | |
| 26014 | 31103 | 37593 | 50558 | 64106 |
| 0.093 | 0.139 | 0.108 | 0.138 | 0.109 |
| 1 | 0.76 | 1 | 0.72 | 0.5 |
| 2420 | 3283 | 4059 | 5020 | 3480 |

250x700mm

Fig. 11

| | | | | | | | | | |
|---|---|---|---|---|---|---|---|---|---|
| | Variant | 1 | 2 | 3 | 4 | | 5 | 6 | 7 |
| Param | Resn, K | 33 | 32 | 30 | 29 | | 45 | 44 | 42 |
| | Duty Cycle | 14.9% | 14.9% | 14.9% | 14.8% | | 10.7% | 10.6% | 10.4% |
| | | | | | | | | | |
| Size | # of reflections | 4 | 4 | 4 | 4 | | 5 | 5 | 5 |
| | Length L, mm | 650 | 650 | 650 | 650 | | 650 | 650 | 650 |
| | Width W, mm | 210 | 210 | 210 | 210 | | 210 | 210 | 210 |
| | | | | | | | | | |
| Acc | Acceleartion, V | 3000 | 4000 | 6000 | 8000 | | 3000 | 4000 | 6000 |
| Push | Push amplitude | 1400 | 1400 | 2400 | 2400 | | 1400 | 1400 | 2400 |
| TOF | K, eV | 3700 | 4700 | 7200 | 9200 | | 3700 | 4700 | 7200 |
| | V tof, mm/us | 27.20 | 30.66 | 37.95 | 42.90 | | 27.20 | 30.66 | 37.95 |
| | Leff, mm | 2925 | 2925 | 2925 | 2925 | | 3575 | 3575 | 3650 |
| | TOF, us | 108 | 95 | 77 | 68 | | 131 | 117 | 96 |
| | | | | | | | | | |
| Beam | Beam, eV | 18 | 23 | 35 | 44 | | 11.5 | 14.5 | 22 |
| | V beam, mm/us | 1.90 | 2.14 | 2.65 | 2.97 | | 1.52 | 1.70 | 2.10 |
| Trajectory | Z step, mm | 45 | 45 | 45 | 45 | | 36 | 36 | 36 |
| | Inclination, mrad | 70 | 70 | 70 | 69 | | 56 | 56 | 55 |
| | Inclination, deg | 4.1 | 4.1 | 4.1 | 4.1 | | 3.3 | 3.3 | 3.3 |
| | Mirr Z edge, mm | 14 | 14 | 14 | 15 | | 14 | 15 | 15 |
| | | | | | | | | | |
| OA | beam d, mm | 1.2 | 1.2 | 1.2 | 1.2 | | 1.2 | 1.2 | 1.2 |
| | beam ang, mrad | 17 | 17 | 17 | 17 | | 17 | 17 | 17 |
| | OA length | 30 | 30 | 30 | 30 | | 21 | 21 | 21 |
| | OA time, us | 15.99 | 14.21 | 11.46 | 10.10 | | 14.00 | 12.39 | 9.98 |
| | Duty Cycle | 0.149 | 0.149 | 0.149 | 0.148 | | 0.107 | 0.106 | 0.104 |
| | | | | | | | | | |
| dK | E, V/mm | 230 | 330 | 460 | 600 | | 230 | 290 | 440 |
| | dK, eV | 276 | 396 | 552 | 720 | | 276 | 348 | 528 |
| R(6%) | dK/K | 7.5% | 8.4% | 7.7% | 7.8% | | 7.5% | 7.4% | 7.3% |
| 250000 | Res(dK) | 104644 | 64292 | 93782 | 86371 | | 104644 | 107800 | 112031 |
| | dT(dK) | 0.51 | 0.74 | 0.41 | 0.39 | | 0.63 | 0.54 | 0.43 |
| | | | | | | | | | |
| Packets | Vx, m/s | 32.26 | 36.46 | 44.98 | 50.43 | | 25.78 | 28.95 | 35.66 |
| | Turn Around, ns | 1.40 | 1.10 | 0.98 | 0.84 | | 1.12 | 1.00 | 0.81 |
| | DAS and Det, ns | 0.7 | 0.7 | 0.7 | 0.7 | | 0.7 | 0.7 | 0.7 |
| | | | | | | | | | |
| Resolution | FWHM, ns | 1.65 | 1.50 | 1.27 | 1.16 | | 1.46 | 1.33 | 1.15 |
| | Resolution | 32594 | 31722 | 30328 | 29319 | | 44910 | 43711 | 41685 |
| | | | | | | | | | |
| Mesh | angle, mrad | 6.22 | 7.02 | 6.39 | 6.52 | | 6.22 | 6.17 | 6.11 |
| | Y spread, mm | 2.83 | 3.19 | 2.91 | 2.97 | | 2.83 | 2.81 | 2.78 |
| | | | | | | | | | |
| | | | | | | | | | |
| | Leff | 2.925 | 2.925 | 2.925 | 2.925 | | 3.575 | 3.575 | 3.65 |
| | Square | 0.175 | 0.175 | 0.175 | 0.175 | | 0.175 | 0.175 | 0.175 |
| | | | | | | | | | |
| | Resolution | 32594 | 31722 | 30328 | 29319 | | 44910 | 43711 | 41685 |
| | Duty Cycle | 0.149 | 0.149 | 0.149 | 0.148 | | 0.107 | 0.106 | 0.104 |
| | Transm OA | 0.36 | 0.46 | 0.7 | 0.88 | | 0.23 | 0.29 | 0.44 |
| | Res*DC*Transm | 1745 | 2173 | 3156 | 3820 | | 1101 | 1347 | 1903 |
| | OA length | 13.04 | 12.12 | 13.04 | 13.33 | | 13.04 | 13.79 | 13.64 |
| | OA gap | 6.087 | 4.242 | 5.217 | 4 | | 6.087 | 4.828 | 5.455 |

Fig. 11 (Cont.)

| | | | | |
|---|---|---|---|---|
| 8 | 9 | 10 | 11 | 12 |
| 40 | 59 | 57 | 52 | 50 |
| 10.4% | 7.6% | 7.6% | 7.6% | 7.6% |
| | | | | |
| 5 | 6 | 6 | 6 | 6 |
| 650 | 650 | 650 | 650 | 650 |
| 210 | 210 | 210 | 210 | 210 |
| | | | | |
| 8000 | 3000 | 4000 | 6000 | 8000 |
| 2400 | 1400 | 1400 | 2400 | 2400 |
| 9200 | 3700 | 4700 | 7200 | 9200 |
| 42.90 | 27.20 | 30.66 | 37.95 | 42.90 |
| 3650 | 4300 | 4300 | 4300 | 4300 |
| 85 | 158 | 140 | 113 | 100 |
| | | | | |
| 28 | 8 | 10 | 15.5 | 20 |
| 2.37 | 1.26 | 1.41 | 1.76 | 2.00 |
| 36 | 30 | 30 | 30 | 30 |
| 55 | 46 | 46 | 46 | 47 |
| 3.2 | 2.7 | 2.7 | 2.7 | 2.7 |
| 15 | 14 | 15 | 15 | 14 |
| | | | | |
| 1.2 | 1.2 | 1.2 | 1.2 | 1.2 |
| 17 | 17 | 17 | 17 | 17 |
| 21 | 15 | 15 | 15 | 15 |
| 8.81 | 12.04 | 10.59 | 8.61 | 7.65 |
| 0.104 | 0.076 | 0.076 | 0.076 | 0.076 |
| | | | | |
| 560 | 210 | 270 | 420 | 520 |
| 672 | 252 | 324 | 504 | 624 |
| 7.3% | 6.8% | 6.9% | 7.0% | 6.8% |
| 113820 | 150574 | 143468 | 134944 | 153094 |
| 0.37 | 0.52 | 0.49 | 0.42 | 0.33 |
| | | | | |
| 40.23 | 21.50 | 24.04 | 29.93 | 34.00 |
| 0.72 | 1.02 | 0.89 | 0.71 | 0.65 |
| 0.7 | 0.7 | 0.7 | 0.7 | 0.7 |
| | | | | |
| 1.07 | 1.35 | 1.23 | 1.08 | 1.01 |
| 39747 | 58681 | 56846 | 52287 | 49514 |
| | | | | |
| 6.09 | 5.68 | 5.74 | 5.83 | 5.65 |
| 2.77 | 2.58 | 2.61 | 2.65 | 2.57 |
| | | | | |
| | | | | |
| 3.65 | 4.3 | 4.3 | 4.3 | 4.3 |
| 0.175 | 0.175 | 0.175 | 0.175 | 0.175 |
| | | | | |
| 39747 | 58681 | 56846 | 52287 | 49514 |
| 0.104 | 0.076 | 0.076 | 0.076 | 0.076 |
| 1 | 0.16 | 1 | 0.31 | 0.4 |
| 4117 | 714.9 | 4294 | 1232 | 1512 |
| 14.29 | 14.29 | 14.81 | 14.29 | 15.38 |
| 4.286 | 6.667 | 5.185 | 5.714 | 4.615 |

MULTI-REFLECTING TIME-OF-FLIGHT MASS SPECTROMETERS

CROSS-REFERENCE TO RELATED APPLICATION APPLICATIONS

This application is a national phase filing claiming the benefit of and priority to International Patent Application No. PCT/GB2018/051206, filed on May 4, 2018, which claims priority from and the benefit of United Kingdom patent application No. 1707208.3 filed on May 5, 2017. The contents of these applications are incorporated herein by reference.

FIELD OF THE INVENTION

The present invention relates generally to mass spectrometers and in particular to multi reflecting time-of-flight mass spectrometers (MR-TOF-MS) and methods of their use.

BACKGROUND

A time-of-flight mass spectrometer is a widely used tool of analytical chemistry, characterized by high speed analysis of wide mass ranges. It has been recognized that multi-reflecting time-of-flight mass spectrometers (MR-TOF-MS) provide a substantial increase in resolving power by reflecting the ions multiple times so as to extend the flight path of the ions. Such an extension of the ion flight paths has been achieved by reflecting ions between ion mirrors.

SU 1725289 discloses an MR-TOF-MS instrument having an ion mirror arranged on either side of a field-free region. An ion source is arranged in the field-free region, which ejects ions into one of the ion mirrors. The ions are reflected back and forth between the ion mirrors as they drift along the instrument until the ions reach an ion detector. The mass to charge ratio of an ion can then be determined by detecting the time it has taken for the ion to travel from the ion source to the ion detector.

WO 2005/001878 discloses a similar instrument having a set of periodic lenses within the field-free region between the ion mirrors so as to prevent the ion beam diverging significantly in the direction orthogonal to the dimension in which the ions are reflected by the ion mirror, thereby increasing the duty cycle of the spectrometer.

SUMMARY

According to a first aspect the present invention provides a multi-reflecting time of flight mass analyser comprising:

an ion accelerator;

two ion mirrors arranged for reflecting ions in a first dimension (x-dimension) and being elongated in a second dimension (z-dimension); and an ion detector;

wherein the ion accelerator is arranged and configured for accelerating ions into a first of the ion mirrors at an angle to the first dimension such that the ions are repeatedly reflected between the ion mirrors in the first dimension (x-dimension) as they travel in the second dimension (z-dimension);

wherein the ions are not spatially focussed in the second dimension (z-dimension) as they travel from the ion accelerator to the detector; and wherein the mass analyser has a duty cycle of ≥5%, a resolution of ≥20,000, wherein the distance in the first dimension (x-dimension) between points of reflection in the two ion mirrors is ≤1000 mm; and wherein the mass analyser is configured such that the ions travel a distance in the second dimension (z-dimension) from the ion accelerator to the detector of ≤700 mm.

No focusing of the ions is provided in the second dimension (z-dimension) between the ion mirrors, e.g. there are no periodic lenses focussing the ions in the second dimension (z-dimension). As such, each packet of ions expands in the second dimension (z-dimension) as it travels from the ion accelerator to the detector. MR-TOF-MS instruments have conventionally sought to obtain a very high resolution and hence require a high number of reflections between the ion mirrors. Therefore, conventionally it has been considered necessary to provide second dimension (z-dimension) focussing between the ion mirrors to prevent the width of the ion packet diverging to the extent that it becomes larger than the detector width by the time it has completed the high number of mirror reflections and reached the detector. This was considered necessary to maintain an acceptable transmission, and hence sensitivity, of the instrument. Also, if the ion packets diverge too much in the second dimension (z-dimension), then some ions may reach the detector having only been reflected a first number of times, whereas other ions may reach the detector having been reflected a larger number of times. Ions may therefore have significantly different flight path lengths through the field-free region on the way to the detector, which is undesirable in time of flight mass analysers.

However, the inventors of the present invention have realised that if the ion flight path within the instrument is maintained relatively small and the duty cycle (as defined herein below, i.e. D/L) is made relatively high, then the second dimension (z-dimension) focussing can be eliminated whilst maintaining a reasonably high sensitivity and resolution. More specifically, each ion packet that is pulsed out of the ion accelerator expands in the second dimension (z-dimension) as it travels towards the detector, due to thermal velocities of the ions. This is particularly problematic in multi reflecting time-of-flight mass spectrometers because on one hand the ion detector must be relatively short in the second dimension (z-dimension) so that ions do not collide with it until the desired number of ion mirror reflections have been performed, but on the other hand it must be long enough to receive the expanded ion packet. The more the ion packet expands in the second dimension (z-dimension), relative to its original length in this dimension, the more problematic this becomes. The inventors have recognised that by maintaining the initial size of the ion packet (i.e. D) relatively high and the distance between the ion accelerator and the detector (i.e. L) relatively small (i.e. by providing a relatively high duty cycle, D/L), the proportional expansion of the ion packet between the ion accelerator and the detector remains relatively low.

The first aspect of the invention also provides a method of time of flight mass analysis comprising: providing a mass analyser as described above; controlling the ion accelerator so as to accelerate ions into the first ion mirror at an angle to the first dimension such that the ions are repeatedly reflected between the ion mirrors in the first dimension (x-dimension) as they travel in the second dimension (z-dimension), wherein the distance in the first dimension (x-dimension) between points of reflection in the two ion mirrors is ≤1000 mm, wherein the ions travel a distance in the second dimension (z-dimension) from the ion accelerator to the detector of ≤700 mm, and wherein the ions are not spatially focussed in the second dimension (z-dimension) as they travel from the ion accelerator to the detector; and wherein the ions are detected by the detector and time of flight mass analysed with a duty cycle of ≥5% and a resolution of ≥20,000.

From a second aspect the present invention provides a multi-reflecting time of flight mass analyser comprising:

an ion accelerator;

two ion mirrors arranged for reflecting ions in a first dimension (x-dimension) and being elongated in a second dimension (z-dimension); and an ion detector;

wherein the ion accelerator is arranged and configured for accelerating ions into a first of the ion mirrors at an angle to the first dimension such that the ions are repeatedly reflected between the ion mirrors in the first dimension (x-dimension) as they travel in the second dimension (z-dimension); and wherein the ions are reflected so as to pass from one of the ion mirrors to the other of the ion mirrors n times, and wherein the ions are not spatially focussed in the second dimension (z-dimension) during ≥60% of these n times.

The second aspect of the invention also provides a method of time of flight mass analysis comprising: providing a mass analyser as described above; and controlling the ion accelerator so as to accelerate ions into the first ion mirror at an angle to the first dimension such that the ions are repeatedly reflected between the ion mirrors in the first dimension (x-dimension) as they travel in the second dimension (z-dimension), wherein the ions are reflected so as to pass from one of the ion mirrors to the other of the ion mirrors n times, and wherein the ions are not spatially focussed in the second dimension (z-dimension) during ≥60% of these n times.

From a third aspect the present invention provides a multi-reflecting time of flight mass analyser comprising:

an ion accelerator;

two ion mirrors arranged for reflecting ions in a first dimension (x-dimension) and being elongated in a second dimension (z-dimension); and an ion detector;

wherein the ion accelerator is arranged and configured for accelerating ions into a first of the ion mirrors at an angle to the first dimension such that the ions are repeatedly reflected between the ion mirrors in the first dimension (x-dimension) as they travel in the second dimension (z-dimension).

The third aspect of the invention also provides a method of time of flight mass analysis comprising: providing a mass analyser as described above; and controlling the ion accelerator so as to accelerate ions into the first ion mirror at an angle to the first dimension such that the ions are repeatedly reflected between the ion mirrors in the first dimension (x-dimension) as they travel in the second dimension (z-dimension).

The spectrometers herein may comprise an ion source selected from the group consisting of: (i) an Electrospray ionisation ("ESI") ion source; (ii) an Atmospheric Pressure Photo ionisation ("APPI") ion source; (iii) an Atmospheric Pressure Chemical Ionisation ("APCI") ion source; (iv) a Matrix Assisted Laser Desorption ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The ion-molecule reaction device may be configured to perform ozonlysis for the location of olefinic (double) bonds in lipids.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; and (xi) a Fourier Transform mass analyser.

The spectrometer may comprise one or more energy analysers or electrostatic energy analysers.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which:

FIGS. 5A-5B show the resolution and duty cycle modelled for different sized MR-TOF-MS instruments, for ions having an energy in the field-free region between the mirrors of 9.2 keV;

FIG. 6A-6B show data for corresponding parameters to those shown in FIGS. 5A-5B, except that the data is modelled for ions having an energy in the field-free region between the mirrors of 6 keV;

FIG. 7 shows data for corresponding parameters to those shown in FIGS. 5A-5B, except that the data is modelled for ions having an energy in the field-free region between the mirrors of 3 keV, 4 keV and 5 keV;

FIG. 8 shows data for corresponding parameters to those shown in FIGS. 5A-5B, except that the data is modelled for ions being reflected in the mirrors five times and having an energy in the field-free region between the mirrors of between 4-10 keV;

FIG. 9 shows data for corresponding parameters to those shown in FIG. 8, except that the data is modelled for ions being reflected in the mirrors six times;

FIG. 10 shows data for corresponding parameters to those shown in FIGS. 5A-5B, except that the data is modelled for achieving a duty cycle of around 10%; and FIG. 11 shows data for corresponding parameters to those shown in FIGS. 5A-5B, for instruments having a medium size.

DETAILED DESCRIPTION

Figure 1:
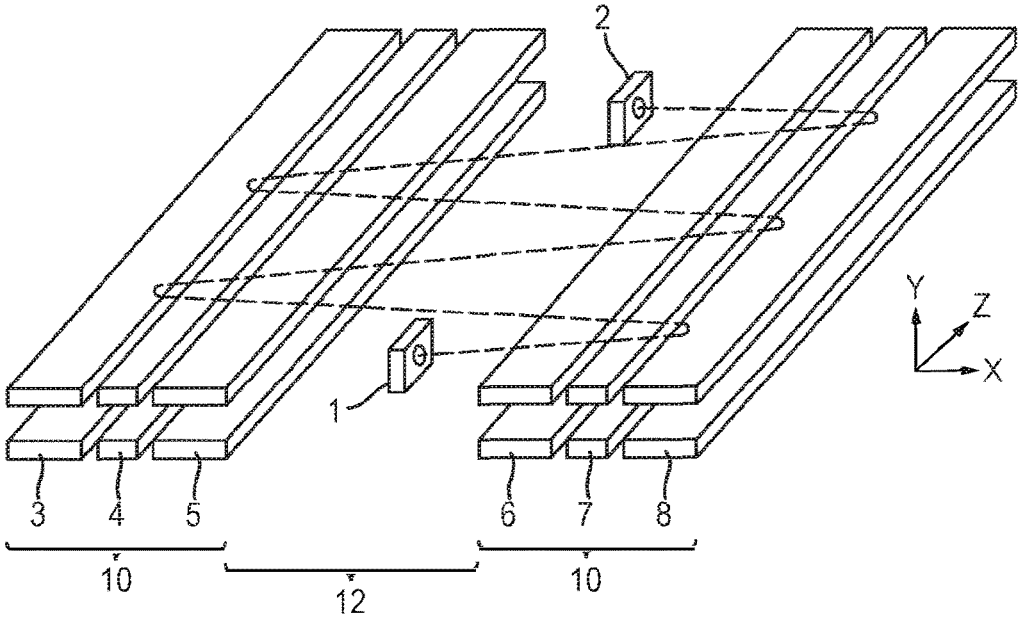
FIG. 1 shows an MR-TOF-MS instrument according to the prior art.

FIG. 1 shows the MR-TOF-MS instrument of SU 1725289. The instrument comprises two ion mirrors 10 separated in the x-dimension by a field-free region 12. Each ion mirror 10 comprises three pairs of electrodes 3-8 that are elongated in the z-dimension. An ion source 1 is arranged in the field-free region 12 at one end of the instrument (in the z-dimension) and an ion detector 2 is arranged at the other end of the instrument (in the z-dimension).

In use, the ion source 1 accelerates ions into a first of the ion mirrors 10 at an inclination angle to the x-axis. The ions therefore have a velocity in the x-dimension and also a drift velocity in the z-dimension. The ions enter into the first ion mirror 10 and are reflected back towards the second of the ion mirrors 10. The ions then enter the second mirror and are reflected back to the first ion mirror. The first ion mirror then reflects the ions back to the second ion mirror. This continues and the ions are continually reflected between the two ion mirrors as they drift along the device in the z-dimension until the ions impact upon ion detector 2. The ions therefore follow a substantially sinusoidal mean trajectory within the x-z plane between the ion source 1 and the ion detector 2.

Figure 2:
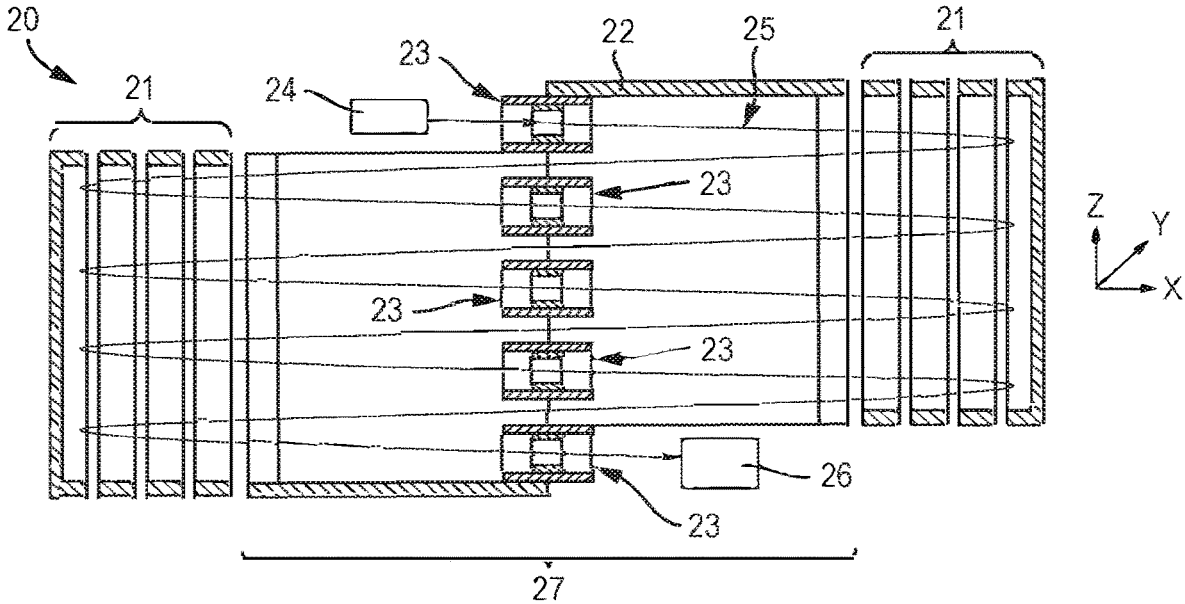
FIG. 2 shows another MR-TOF-MS instrument according to the prior art.

FIG. 2 shows an MR-TOF-MS instrument disclosed in WO 2005/001878. This instrument is similar to that of SU 1725289 in that ions from an ion source 24 are reflected multiple times between two ion mirrors 21 as they drift in the z-dimension towards an ion detector 26. However, the instrument of WO 2005/001878 also comprises a set of periodic lenses 23 within the field-free region 27 between the ion mirrors 21. These lenses 23 are arranged such that the ion packets pass through them as they are reflected between the ion mirrors 21. Voltages are applied to the electrodes of the lenses 23 so as to spatially focus the ion packets in the z-dimension. This prevents the ion packets from diverging excessively in the z-dimension and overlapping with each other, and from becoming longer than the detector 26 in the z-dimension by the time they reach the detector 26.

Embodiments of the present invention relate to an MR-TOF-MS instrument not having a set of lenses 23 within the field-free region between the ion mirrors.

According to a first aspect the present invention provides a multi-reflecting time of flight mass analyser comprising:

an ion accelerator;

two ion mirrors arranged for reflecting ions in a first dimension (x-dimension) and being elongated in a second dimension (z-dimension); and an ion detector;

wherein the ion accelerator is arranged and configured for accelerating ions into a first of the ion mirrors at an angle to the first dimension such that the ions are repeatedly reflected between the ion mirrors in the first dimension (x-dimension) as they travel in the second dimension (z-dimension);

wherein the ions are not spatially focussed in the second dimension (z-dimension) as they travel from the ion accelerator to the detector; and wherein the mass analyser has a duty cycle of ≥5%, a resolution of ≥20,000, wherein the distance in the first dimension (x-dimension) between points of reflection in the two ion mirrors is ≤1000 mm; and wherein the mass analyser is configured such that the ions travel a distance in the second dimension (z-dimension) from the ion accelerator to the detector of ≤700 mm.

Although the term "duty cycle" is well understood to the person skilled in the art, for the avoidance of doubt, duty cycle is the proportion of time that ions from a continuous ion source are accepted into a mass analyser. For orthogonal acceleration ion accelerators, such as those according to the embodiments of the invention, the duty cycle is given by:

$$DutyCycle = \frac{D}{L}\sqrt{\frac{m/z}{(m/z)_{max}}}$$

where D is the length in the second dimension (z-dimension) of the ion packet when it is orthogonally accelerated by the ion accelerator (i.e. the length in second dimension of the orthogonal acceleration region of the ion accelerator); L is the distance, in the second dimension, from the centre of the orthogonal acceleration region of the ion accelerator to the centre of the detection region of the ion detector; (m/z) is the mass to charge ratio of an ion being analysed; and $(m/z)_{max}$ is the maximum mass to charge ratio of interest desired to be analysed.

It is therefore apparent that the duty cycle of the mass analyser is mass dependent. This is because ions of higher mass to charge ratio take longer to pass through and fill the extraction region of the ion accelerator. However, when describing a mass analyser, the skilled person considers the duty cycle of the mass analyser to be the duty cycle for the maximum mass to charge ratio of interest, i.e. the duty cycle when $(m/z)=(m/z)_{max}$ in the equation above. Accordingly, when duty cycle is referred to herein, it refers to the ratio of D/L (as a percentage), which is a value defined purely by the geometric parameters D and L of the mass analyser. This may also be known as the "sampling efficiency".

Also, for the avoidance of doubt, the term resolution used herein has its normal meaning in the art, i.e. m/(A m) at FWHM, where m is mass to charge ratio.

The following features are disclosed in relation to the first aspect of the invention.

Each mirror may have at least four electrodes arranged and configured such that the first order time of flight focussing of ions is substantially independent of the position of the ions in the plane orthogonal to the first dimension (y-z plane).

Therefore, the first order time of flight focussing of ions may be substantially independent of the position of the ions in both the second dimension (z-dimension) and a third dimension (y-dimension) that is orthogonal to the first and second dimensions (x and z dimensions).

The mass analyser may comprise voltage sources for applying at least four different voltages to the four different electrodes in each ion mirror for reflecting ions and achieving said time of flight focussing.

The ions are not spatially focussed in the second dimension (z-dimension) as they travel from the ion accelerator to the detector. As such, ion lenses are not provided between the ion mirrors for spatially focussing ions in the second dimension (z-dimension). Similarly, the ion mirrors are not configured to spatially focus the ions in the second dimension (z-dimension).

The ion detector may be spaced from the ion accelerator in the second dimension (z-dimension). Alternatively, the ions may travel from the ion accelerator in a first direction in the second dimension (z-dimension) and may then be reflected by a reflecting electrode so as to travel in a second, opposite direction in the second dimension (z-dimension) to the detector. One or more further reflection electrodes may be provided to cause one or more further z-dimension reflections, with the detector positioned appropriately to detect the ions after these z-dimension reflections.

Embodiments of the invention provide a spectrometer comprising the mass analyser described herein.

The spectrometer may comprise an ion source for supplying said ions to the ion accelerator, wherein the ion source is arranged such that said ion accelerator receives ions from the ion source travelling in the second dimension (z-dimension).

This arrangement provides the mass analyser with a relatively high duty cycle. As described above, the duty cycle is the ratio of length in second dimension (z-dimension) of the ion packet, when it is accelerated by the ion accelerator, to the distance from the centre of the ion accelerator to the centre of the detector. The embodiments of the invention relate to a relatively small mass analyser and therefore it is desired for the ion accelerator to pulse out a relatively elongated ion packet (in the second, z-dimension) in order to achieve a relatively high duty cycle. The relatively elongated ion packet in the second dimension (z-dimension) is facilitated by providing the ions to the ion accelerator travelling in the second dimension (z-dimension). This is contrary to conventional multi-reflecting TOF spectrometers, in which the ion packet is desired to be maintained very small in the second dimension (z-dimension) so that a high number of ion mirror reflections can be performed before the ion packets diverge in the second dimension (z-dimension) to the extent that they overlap in the second dimension (z-dimension). In order to achieve this, such conventional instruments provide the ions to the ion accelerator in a direction corresponding to a third dimension that is perpendicular to the first and second dimensions described herein. Consequently, such conventional instruments suffer from a relatively low duty cycle.

The ion source may be a continuous ion source for substantially continually generating ions, or may be a pulsed ion source.

The mass analyser may have a duty cycle of ≥10%.

As described above, the mass analyser has a duty cycle of ≥5%. It is contemplated that the mass analyser may have a duty cycle of: ≥6%, ≥7%, ≥8%, ≥9%, ≥10%, ≥11%, ≥12%, ≥13%, ≥14%, ≥15%, ≥16%, ≥17%, ≥18%, ≥19%, ≥20%, ≥25%, ≥30%. Additionally, or alternatively, it is contemplated that the mass analyser may have a duty cycle of: ≤30%, ≤25%, ≤20%, ≤19%, ≤18%, ≤17%, ≤16%, ≤15%, ≤14%, ≤13%, ≤12%, ≤11%, ≤10%, ≤9%, ≤8%, ≤7%, or ≤6%.

Any one of these listed upper end points of the duty cycle may be combined with any one of the lower end points of the duty cycle listed above (where the upper end point is higher than the lower end point. Any one or combination of these end points may also be combined with any one of the ranges (or combination or ranges) described in relation to any one, or any combination, of the other parameters discussed herein. For example, any one or combination of the end points or ranges described in relation to the duty cycle may be combined with any one or any combination of ranges described in relation to: resolution; and/or distance in the second dimension (z-dimension) from the ion accelerator to the detector; and/or distance in the first direction (x-dimension) between points of reflection in the two ion mirrors; and/or number of reflections; and/or ion energy in the second dimension; and/or electric field strength; and/or kinetic energy.

The mass analyser may be configured such that the ions travel a first distance in the second dimension (z-dimension) from the ion accelerator to the detector, wherein the ion accelerator is arranged and configured to pulse packets of ions having an initial length in the second dimension (z-dimension), and wherein the first distance and initial length are such that the spectrometer has a duty cycle of ≥5%.

However, the first distance and initial length may be arranged such that the duty cycle is any of the other ranges of duty cycle disclosed herein.

The mass analyser may have a resolution of ≥30,000.

However, it is contemplated that the mass analyser may have a resolution of: ≥22000, ≥24000, ≥26000, ≥28000, ≥30000, ≥35000, ≥40000, ≥45000, ≥50000, ≥60000, ≥70000, ≥80000, ≥90000, or ≥100000. Additionally, or alternatively, it is contemplated that the mass analyser may have a resolution of: ≤100000, 5 90000, ≤80000, ≤70000, ≤60000, ≤50000, ≤45000, ≤40000, ≤35000, ≤30000, ≤28000, ≤26000, ≤24000, or ≤22000.

Any one of these listed upper end points of the resolution may be combined with any one of the lower end points of the resolution listed above (where the upper end point is higher than the lower end point. Any one or combination of these end points may also be combined with any one of the ranges (or combination or ranges) described in relation to any one, or any combination, of the other parameters discussed herein. For example, any one or combination of the end points or ranges described in relation to the resolution may be combined with any one or any combination of ranges described in relation to: duty cycle; and/or distance in the second dimension (z-dimension) from the ion accelerator to the detector; and/or distance in the first direction (x-dimension) between points of reflection in the two ion mirrors; and/or number of reflections; and/or ion energy in the second dimension; and/or electric field strength; and/or kinetic energy.

The distance in the second dimension (z-dimension) from the ion accelerator to the detector may be one of: ≤650 mm; ≤600 mm; ≤550 mm; ≤500 mm; ≤480 mm; ≤460 mm; ≤440 mm; ≤420 mm; ≤400 mm; ≤380 mm; ≤360 mm; ≤340 mm; ≤320 mm; ≤300 mm; ≤280 mm; ≤260 mm; ≤240 mm; ≤220 mm; or ≤200 mm; and/or the first distance in the second dimension (z-dimension) from the ion accelerator to the detector may be one of: ≥100 mm; ≥120 mm; ≥140 mm; ≥160 mm; ≥180 mm; ≥200 mm; ≥220 mm; ≥240 mm; ≥260 mm; ≥280 mm; ≥300 mm; ≥320 mm; ≥340 mm; ≥360 mm; ≥380 mm; or ≥400 mm. Any one of these listed upper end points of the first distance in the second dimension (z-dimension) may be combined with any one of the lower end points of the first distance in the second dimension (z-dimension) that are listed above (where the upper end point is higher than the lower end point. Any one or combination of these end points may also be combined with any one of the ranges (or combination or ranges) described in relation to any one, or any combination, of the other parameters discussed herein. For example, any one or combination of the end points or ranges described in relation to the distance from the ion accelerator to the detector may be combined with any one or any combination of ranges described in relation to: duty cycle; and/or resolution; and/or distance in the first direction (x-dimension) between points of reflection in the two ion mirrors; and/or number of reflections; and/or ion energy in the second dimension; and/or electric field strength; and/or kinetic energy.

The distance in the first direction (x-dimension) between points of reflection in the two ion mirrors may be: ≤950 mm; ≤900 mm; ≤850 mm; ≤800 mm; ≤750 mm; ≤700 mm; ≤650 mm; ≤600 mm; ≤550 mm; ≤500 mm; ≤450 mm; or ≤400 mm; and/or the distance in the first direction (x-dimension) between points of reflection in the two ion mirrors may be: ≥350 mm; ≥360 mm; ≥380 mm; ≥400 mm; ≥450 mm; ≥500 mm; ≥550 mm; ≥600 mm; ≥650 mm; ≥700 mm; ≥750 mm; ≥800 mm; ≥850 mm; or ≥900 mm.

Any one of these listed upper end points of the distance between points of reflection in the two ion mirrors may be combined with any one of the lower end points of the distance between points of reflection in the two ion mirrors that are listed above (where the upper end point is higher than the lower end point. Any one or combination of these end points may also be combined with any one of the ranges (or combination or ranges) described in relation to any one, or any combination, of the other parameters discussed herein. For example, any one or combination of the end points or ranges described in relation to the distance between the points of reflection may be combined with any one or any combination of ranges described in relation to: duty cycle; and/or resolution; and/or distance in the second dimension (z-dimension) from the ion accelerator to the detector; and/or number of reflections; and/or ion energy in the second dimension; and/or electric field strength; and/or kinetic energy.

The ion accelerator, ion mirrors and detector may be arranged and configured so that the ions are reflected at least x times by the ion mirrors as the travel from the ion accelerator to the detector; wherein x is: ≥2, ≥3, ≥4, ≥5, ≥6, ≥7, ≥8, ≥9, ≥10, ≥11, ≥12, ≥13, ≥14, or ≥15; and/or wherein x is: ≤15; ≤14; ≤13; ≤12; ≤11; ≤10; ≤9; ≤8; ≤7; ≤6; ≤5; ≤4; ≤3; or ≤2; and/or wherein x is 3-10; wherein x is 4-9; wherein x is 5-10; wherein x is 3-6; wherein x is 4-5; or; wherein x is 5-6.

Any one of these listed upper end points of the number of reflections may be combined with any one of the lower end points of the number of reflections that are listed above (where the upper end point is higher than the lower end point. Any one or combination of these end points may also be combined with any one of the ranges (or combination or ranges) described in relation to any one, or any combination, of the other parameters discussed herein. For example, any one or combination of the end points or ranges described in relation to the number of reflections may be combined with any one or any combination of ranges described in relation to: duty cycle; and/or resolution; and/or distance in the second dimension (z-dimension) from the ion accelerator to the detector; and/or distance in the first direction (x-dimension) between points of reflection in the two ion mirrors; and/or ion energy in the second dimension; and/or electric field strength; and/or kinetic energy.

The ions may travel between 100 mm and 450 mm in the second dimension (z-dimension) from the ion accelerator to the detector; wherein the distance in the first direction (x-dimension) between points of reflection in the two ion mirrors may be between 350 and 950 mm; and wherein the ions may be reflected between 2 and 15 times by the ion mirrors as the travel from the ion accelerator to the detector.

Alternatively, the ions may travel between 150 mm and 400 mm in the second dimension (z-dimension) from the ion accelerator to the detector; wherein the distance in the first direction (x-dimension) between points of reflection in the two ion mirrors may be between 400 and 900 mm; and wherein the ions may be reflected between 3 and 10 times by the ion mirrors as the travel from the ion accelerator to the detector. Alternatively, the ions may travel between 150 mm and 350 mm in the second dimension (z-dimension). Alternatively, or additionally, the distance in the first direction (x-dimension) between points of reflection in the two ion mirrors may be between 400 and 600 mm.

It is contemplated that the ions may travel between 100 mm and 400 mm in the second dimension (z-dimension) from the ion accelerator to the detector; wherein the distance in the first direction (x-dimension) between points of reflection in the two ion mirrors may be between 300 and 700 mm; and wherein the ions may be reflected between 3 and 6 times by the ion mirrors as the travel from the ion accelerator to the detector. Alternatively, the ions may travel between 150 mm and 350 mm in the second dimension (z-dimension) from the ion accelerator to the detector. Alternatively, or additionally, the distance in the first direction (x-dimension) between points of reflection in the two ion mirrors is between 400 and 600 mm. Additionally, or instead of either one of both of these parameters, the ions may be reflected between 4 and 5 times, or between 5 and 6 times, by the ion mirrors as the travel from the ion accelerator to the detector.

The spectrometer may be configured to cause the ions to travel in the second dimension (z-dimension) with an energy of: ≤140 eV; ≤120 eV; ≤100 eV; ≤90 eV; ≤80 eV; ≤70 eV; ≤60 eV; ≤50 eV; ≤40 eV; ≤30 eV; ≤20 eV; or ≤10 eV; and/or the spectrometer may be configured to cause the ions to travel in the second dimension (z-dimension) with an energy of: ≥120 eV; ≥100 eV; ≥90 eV; ≥80 eV; ≥70 eV; ≥60 eV; ≥50 eV; ≥40 eV; ≥30 eV; ≥20 eV; or ≥10 eV. The spectrometer may be configured to cause the ions to travel in the second dimension (z-dimension) with an energy between: 15-70 eV; 10-65 eV; 10-60 eV; 20-100 eV; 25-100 eV; 20-90 eV; 40-60 eV; 30-50 eV; 20-30 eV; 20-45 eV; 25-40 eV; 15-40 eV; 10-45 eV; or 10-25 eV.

Any one of these listed upper end points of the energy may be combined with any one of the lower end points of the energy that are listed above (where the upper end point is higher than the lower end point. Any one or combination of these end points may also be combined with any one of the ranges (or combination or ranges) described in relation to any one, or any combination, of the other parameters discussed herein. For example, any one or combination of the end points or ranges described in relation to the energy in the second dimension may be combined with any one or any combination of ranges described in relation to: duty cycle; and/or resolution; and/or distance in the second dimension (z-dimension) from the ion accelerator to the detector; and/or distance in the first direction (x-dimension) between points of reflection in the two ion mirrors; and/or number of reflections; and/or electric field strength; and/or kinetic energy.

The ranges of resolution, duty cycle and size of the mass analyser (i.e. the distance in the first direction between points of reflection in the two ion mirrors, and the distance travelled between the ion accelerator and detector in the second dimension) described herein are for practical values of Time of Flight energies and mirror voltages.

The ion accelerator may be configured to generate an electric field of y V/mm for accelerating the ions; wherein y is: ≥700; ≥650; ≥600; ≥580; ≥560; ≥540; ≥520; ≥500; ≥480; ≥460; ≥440; ≥420; ≥400; ≥380; ≥360; ≥340; ≥320; ≥300; ≥280; ≥260; ≥240; 220; or ≥200; and/or wherein y is: ≤700; ≤650; ≤600; ≤580; ≤560; ≤540; ≤520; ≤500; ≤480; ≤460; ≤440; ≤420; ≤400; ≤380; ≤360; ≤340; ≤320; ≤300; ≤280; ≤260; ≤240; ≤220; or ≤200.

Any one of these listed upper end points of the electric field may be combined with any one of the lower end points of the electric field that are listed above (where the upper end point is higher than the lower end point. Any one or combination of these end points may also be combined with any one of the ranges (or combination or ranges) described in relation to any one, or any combination, of the other parameters discussed herein. For example, any one or combination of the end points or ranges described in relation to the electric field strength may be combined with any one or any combination of ranges described in relation to: duty cycle; and/or resolution; and/or distance in the second dimension (z-dimension) from the ion accelerator to the detector; and/or distance in the first direction (x-dimension) between points of reflection in the two ion mirrors; and/or number of reflections; and/or ion energy in the second dimension; and/or kinetic energy.

A region substantially free of electric fields may be arranged between the ion mirrors such that when the ions are reflected between the ion mirrors they travel through said region.

The ions may have a kinetic energy E, when between the ion mirrors and/or in said region substantially free of electric fields; wherein E is: ≥1 keV; ≥2 keV; ≥3 keV; ≥4 keV; ≥5 keV; ≥6 keV; ≥7 keV; ≥8 keV; ≥9 keV; ≥10 keV; ≥11 keV; ≥12 keV; ≥13 keV; ≥14 keV; or ≥15 keV; and/or wherein E is ≤15 keV; ≤14 keV; ≤13 keV; ≤12 keV; ≤11 keV; ≤10 keV; ≤9 keV; ≤8 keV; ≤7 keV; ≤6 keV; or ≤5 keV; and/or between 5 and 10 keV.

Any one of these listed upper end points of the kinetic energy may be combined with any one of the lower end points of the kinetic energy that are listed above (where the upper end point is higher than the lower end point. Any one or combination of these end points may also be combined with any one of the ranges (or combination or ranges) described in relation to any one, or any combination, of the other parameters discussed herein. For example, any one or combination of the end points or ranges described in relation to the kinetic energy may be combined with any one or any combination of ranges described in relation to: duty cycle; and/or resolution; and/or distance in the second dimension (z-dimension) from the ion accelerator to the detector; and/or distance in the first direction (x-dimension) between points of reflection in the two ion mirrors; and/or number of reflections; and/or ion energy in the second dimension; and/or electric field strength.

The spectrometer may comprise an ion guide for guiding ions into the ion accelerator and a heater 39 for heating said ion guide.

The spectrometer may comprise a heater for heating electrodes of the ion accelerator.

The spectrometer may comprise a heater arranged and configured to heat the ion guide and/or accelerator to a temperature of: ≥100° C., ≥110° C., ≥120° C., ≥130° C., ≥140° C., or ≥150° C. Heating the various components as described herein may assist in reducing interface charging.

The ion accelerator disclosed herein may be a gridless ion accelerator. If the ion accelerator is heated, then a gridless ion accelerator does not suffer from sagging of the grid that would otherwise be caused by the heating.

The spectrometer may comprise a collimator for collimating the ions passing towards the ion accelerator, the collimator configured to collimate ions in the first dimension (x-dimension) and/or a dimension (y-dimension) orthogonal to both the first and second dimensions.

The spectrometer may comprise ion optics 33 arranged and configured to expand the ion beam passing towards the ion accelerator in the first dimension (x-dimension) and/or a dimension (y-dimension) orthogonal to both the first and second dimensions.

The spectrometer may comprise an ion separator for separating ion spatially, or according to mass to chare ratio or ion mobility, in the second dimension (z-dimension) prior to the ions entering the ion accelerator.

From a second aspect the present invention provides a multi-reflecting time of flight mass analyser comprising:

an ion accelerator;

two ion mirrors arranged for reflecting ions in a first dimension (x-dimension) and being elongated in a second dimension (z-dimension); and an ion detector;

wherein the ion accelerator is arranged and configured for accelerating ions into a first of the ion mirrors at an angle to the first dimension such that the ions are repeatedly reflected between the ion mirrors in the first dimension (x-dimension) as they travel in the second dimension (z-dimension); and wherein the ions are reflected so as to pass from one of the ion mirrors to the other of the ion mirrors n times, and wherein the ions are not spatially focussed in the second dimension (z-dimension) during ≥60% of these n times.

The mass analyser according to said second aspect may have any of the features disclosed herein in relation to said first aspect, except wherein the mass analyser may or may not be limited to the ions not being spatially focussed in the second dimension (z-dimension) as they travel from the ion accelerator to the detector (e.g. during the entire flight from the ion accelerator to the detector), as described in relation to the first aspect. It is contemplated that there may be some spatial focussed in the second dimension (z-dimension) between some of the mirror reflections. Therefore, according to the second aspect of the invention, the ions are not spatially focussed in the second dimension (z-dimension) during ≥60% of said n times. Optionally, the ions are not spatially focussed in the second dimension (z-dimension) during ≥65%, ≥70%, ≥75%, ≥80%, ≥85%, ≥90%, ≥ or 95% of said n times.

The mass analyser according to said second aspect may have any of the features disclosed herein in relation to said first aspect, except wherein the mass analyser may or may not be limited to the duty cycle being ≥5%, as described in relation to the first aspect.

The mass analyser according to said second aspect may have any of the features disclosed herein in relation to said first aspect, except wherein the mass analyser may or may not be limited to the resolution being ≥20,000, as described in relation to the first aspect.

The mass analyser according to said second aspect may have any of the features disclosed herein in relation to said first aspect, except wherein the mass analyser may or may not be limited to said distance in the first dimension (x-dimension) between points of reflection in the two ion mirrors being ≤1000 mm, as described in relation to the first aspect The mass analyser according to said second aspect may have any of the features disclosed herein in relation to said first aspect, except wherein the mass analyser may or may not be limited to the distance the ions travel in the second dimension (z-dimension) from the ion accelerator to the detector being ≤700 mm, as described in relation to the first aspect.

The first aspect of the invention also provides a method of time of flight mass analysis comprising:

providing a mass analyser as described in relation to said first aspect of the invention; and controlling the ion accelerator so as to accelerate ions into the first ion mirror at an angle to the first dimension such that the ions are repeatedly reflected between the ion mirrors in the first dimension (x-dimension) as they travel in the second dimension (z-dimension), wherein the distance in the first dimension (x-dimension) between points of reflection in the two ion mirrors is ≤1000 mm, wherein the ions travel a distance in the second dimension (z-dimension) from the ion accelerator to the detector of ≤700 mm, and wherein the ions are not spatially focussed in the second dimension (z-dimension) as they travel from the ion accelerator to the detector;

wherein the ions are detected by the detector and time of flight mass analysed with a duty cycle of ≥5% and a resolution of ≥20,000.

The second aspect of the invention also provides a method of time of flight mass analysis comprising:

providing a mass analyser as described in relation to said second aspect of the invention; and controlling the ion accelerator so as to accelerate ions into the first ion mirror at an angle to the first dimension such that the ions are repeatedly reflected between the ion mirrors in the first dimension (x-dimension) as they travel in the second dimension (z-dimension), wherein the ions are reflected so as to pass from one of the ion mirrors to the other of the ion mirrors n times, and wherein the ions are not spatially focussed in the second dimension (z-dimension) during ≥60% of these n times.

Specific embodiments of the invention will now be described with reference to the drawings in order to assist in the understanding of the invention.

Figure 3:
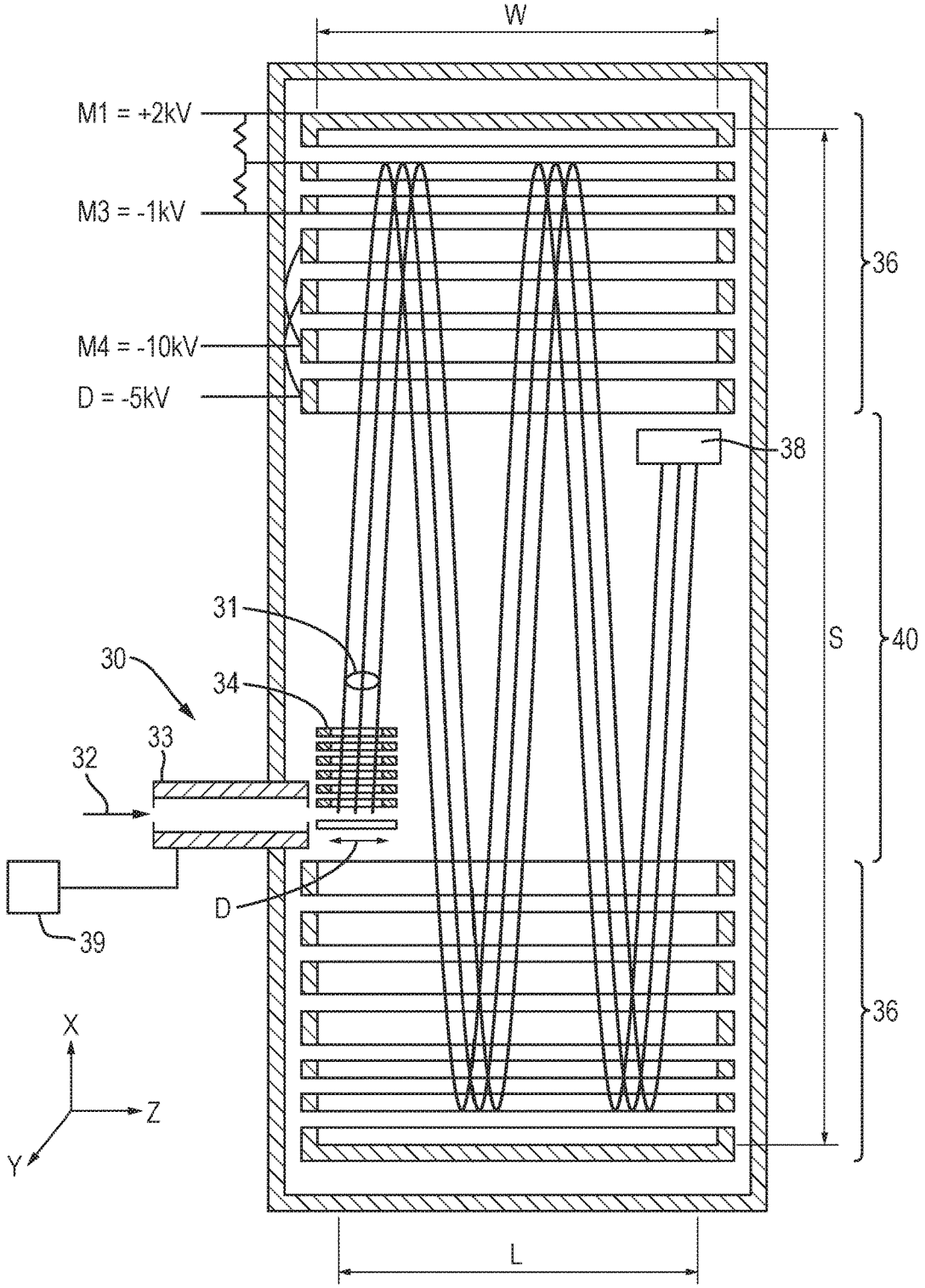
FIG. 3 shows a schematic of an embodiment of the invention.

FIG. 3 shows a schematic of an embodiment of the present invention. The spectrometer comprises an ion entrance 30 for receiving an ion beam 32 along an entrance axis, an ion accelerator 34 for orthogonally accelerating the received ions in a pulsed manner, a pair of ion mirrors 36 for reflecting the ions, and an ion detector 38 for detecting the ions. Each ion mirror 36 comprises a plurality of electrodes (arranged along the x-dimension) so that different voltages may be applied to the electrodes to cause the ions to be reflected. The electrodes are elongated in the Z-dimension, which allows the ions to be reflected multiple times by each mirror, as will be described in more detail below. Each ion mirror may form a two-dimensional electrostatic field in the X-Y plane. The drift space 40 arranged between the ion mirrors 36 may be substantially electric field-free such that when the ions are reflected and travel in the space between the ion mirrors they travel through a substantially field-free region.

In use, ions are supplied to the ion entrance 30, either as a continuous ion beam or an intermittent or pulsed manner. The ions are desirably transmitted into the ion entrance along an axis aligned with the z-dimension. This allows the duty cycle of the instrument to remain high. However, it is contemplated that the ions could be introduced along an entrance axis that is aligned with the y-dimension. The ions pass from the ion entrance to the ion accelerator 34, which pulses the ions (e.g. periodically) in the x-dimension such that packets of ions 31 travel in the x-dimension towards and into a first of the ion mirrors 36. The ions retain a component of velocity in the z-dimension from that which they had when passing into the ion accelerator 34, or a provided with such a component of velocity in the z-dimension (e.g. if the ion entered the ion accelerator along the y-dimension). As such, ions are injected into the time of flight region 40 of the instrument at a small angle of inclination to the x-dimension, with a major velocity component in the x-dimension towards the ion mirror 36 and a minor velocity component in the z-dimension towards the detector 38.

The ions pass into a first of the ion mirrors and are reflected back towards the second of the ion mirrors. The ions pass through the field-free region 40 between the mirrors 38 as they travel towards the second ion mirror and they separate according to their mass to charge ratios in the known manner that occurs in time of flight mass analysers. The ions then enter the second mirror and are reflected back to the first ion mirror, again passing through the field-free region between the mirrors as they travel towards the first ion mirror. The first ion mirror then reflects the ions back to the second ion mirror. This continues and the ions are continually reflected between the two ion mirrors as they drift along the device in the z-dimension until the ions impact upon ion detector. The ions therefore follow a substantially sinusoidal mean trajectory within the x-z plane between the ion source and the ion detector. Although four ion reflections are shown in FIG. 3, other numbers of ion reflections are contemplated, as described elsewhere herein.

The time that has elapsed between a given ion being pulsed from the ion accelerator to the time that the ion is detected may be determined and used, along with the knowledge of the flight path length, to calculate the mass to charge ratio of that ion.

As described above, when duty cycle is referred to herein it refers to the ratio of D/L (as a percentage), where D is the length in the z-dimension of the ion packet 31 when it is orthogonally accelerated by the ion accelerator 34 (i.e. the length in z-dimension of the orthogonal acceleration region of the ion accelerator 31), and L is the distance in the z-dimension from the centre of the orthogonal acceleration region of the ion accelerator 34 to the centre of the detection region of the ion detector 38.

No focusing of the ions is provided in the z-dimension between the ion mirrors, e.g. there are no periodic lenses focussing the ions in the z-dimension. As such, each packet of ions expands in the z-dimension as it travels from the ion accelerator to the detector. MR-TOF-MS instruments have conventionally sought to obtain a very high resolution and hence require a high number of reflections between the ion mirrors. Therefore, conventionally it has been considered necessary to provide z-dimension focussing between the ion mirrors to prevent the width of the ion packet diverging to the extent that it becomes larger than the detector width by the time it has completed the high number of mirror reflections and reached the detector. This was considered necessary to maintain an acceptable sensitivity of the instrument. Also, if the ion packets diverge too much in the z-dimension, then some ions may reach the detector having only been reflected a first number of times, whereas other ions may reach the detector having been reflected a larger number of times. Ions may therefore have significantly different flight path lengths through the field-free region on the way to the detector, which is undesirable in time of flight mass analysers. However, the inventors of the present invention have realised that if the ion flight path within the instrument is maintained relatively small and the duty cycle (i.e. D/L) made relatively high, then the z-dimension focussing can be eliminated.

Therefore, the distance S between the points of reflection in the two ion mirrors is maintained relatively small, and the distance W that the ions travel in the z-dimension from the ion accelerator to the detector is maintained relatively small.

It is contemplated that collimators may be provided to collimate the ions packets in the z-dimension as they travel from the ion accelerator to the detector. This ensures that all ions perform the same number of reflections in the ion mirrors between the ion accelerator and detector (i.e. prevents aliasing at the detector).

Optionally, each ion mirror may have at least four electrodes to which four different (non-grounded) voltages are applied. Each ion mirror may comprise additional electrodes, which may be grounded or maintained at the same voltages as other electrodes in the mirror. Each mirror optionally has at least four electrodes arranged and configured such that the first order time of flight focussing of ions is substantially independent of the position of the ions in the y-z plane, i.e. independent of the position of the ions in both the y-dimension and z-dimension (to the first order approximation). FIG. 3 shows exemplary voltages that may be applied to the electrodes of one of the ion mirrors. Although not illustrated, the same voltages may be applied to the other ion mirror in a symmetrical manner. For example, the entrance electrode of each ion mirror is maintained at a drift voltage (e.g. −5 kV), thereby maintaining a field-free region between the ion mirrors. An electrode further into the ion mirror may be maintained at a lower (or higher, depending on ion polarity) voltage (e.g. −10 kV). An electrode further into the ion mirror may be maintained at the drift voltage (e.g. −5 kV). An electrode further into the ion mirror may be maintained at a lower (or higher) voltage (e.g. −10 kV). One or more further electrodes into the ion mirror may be maintained at one or more higher, optionally progressively higher, voltages (e.g. 11 kV and +2 kV) so as to reflect the ions back out of the mirror.

The ion entrance may receive ions from an ion guide 33 that may, for example, collimate the ions in the y-dimension and/or x-dimension, e.g. using a slit collimator. The ion guide may be heated, e.g. to ≥100° C., ≥110° C., ≥120° C., ≥130° C., ≥140° C., or ≥150° C.

It is contemplated that the ion beam may be expanded in the y-dimension and/or x-dimension prior to entering the ion accelerator 34. Alternatively, or additionally, the ions may be separated in the z-dimension prior to entering the ion accelerator 34.

The electrodes of the ion accelerator 34 may be heated, e.g. to ≥100° C., ≥110° C., ≥120° C., ≥130° C., ≥140° C., or ≥150° C. Alternatively, or additionally, a gridless ion accelerator be used. If the ion accelerator is heated, then a gridless ion accelerator does not suffer from sagging of the grid that would otherwise be caused by the heating.

Heating the various components as described herein may assist in reducing interface charging.

Although the ion accelerator 34 has been described as receiving a beam of ions, it is contemplated that the ion accelerator may alternatively comprise a pulsed ion source.

Figure 4:
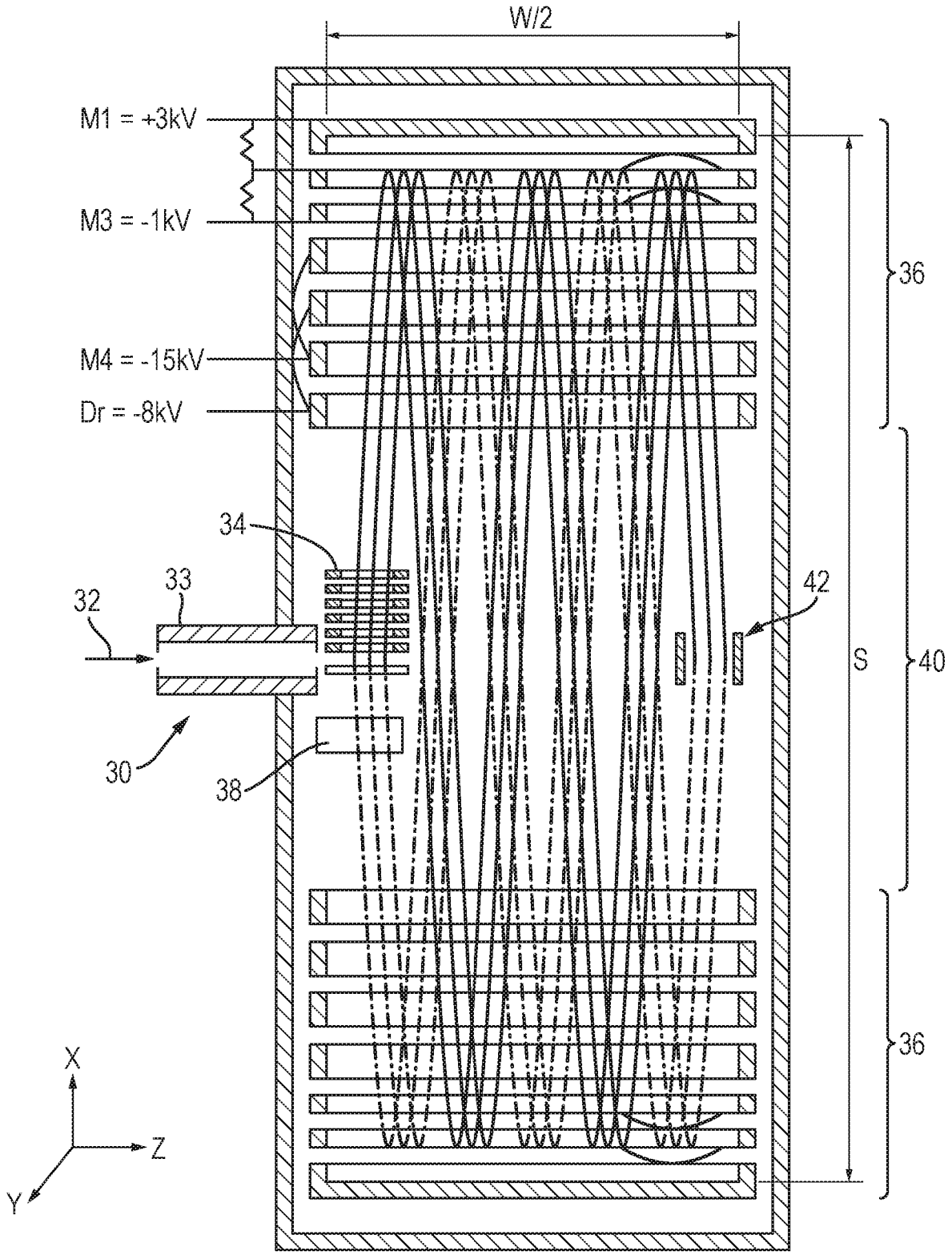
FIG. 4 show a schematic of another embodiment of the invention.

FIG. 4 shows another embodiment of the present invention. This embodiment is substantially the same as that shown in FIG. 3, except that the detector 38 is located on the same side of the instrument (in the z-dimension) as the ion accelerator 34, and the instrument comprises a reflection electrode 42 for reflecting the ions back in the z-dimension towards the detector 38. In use, the ions pass through the instrument in the same way as in FIG. 3 and are reflected multiple times between the ion mirrors 36 as they pass in a first direction in the z-dimension. After a number of reflections, the ions pass to the reflection electrode 42, which may be arranged between the ion mirrors. The reflection electrode 42 reflects the ions back in the z-dimension such that they drift in a second direction opposite to the first direction. As the ions drift in the second direction they continue to be reflected between the ion mirrors 36 until they impact upon the ion detector 38. This embodiment allows more reflections to occur in a given physical space, as compared to the embodiment of FIG. 3. It is contemplated that the ions could be reflected in the z-dimension one or more further times and the detector located appropriately to receive ions after these one or more further z-reflections.

FIGS. 5A-5B show the resolution and duty cycle modelled for different sized MR-TOF-MS instruments (i.e. having different W and S distances) and having no z-dimension focussing. The data is modelled for ions having an energy in the field-free region between the mirrors of 9.2 keV.

FIG. 6A-6B show data for corresponding parameters to those shown in FIGS. 5A-5B, except that the data is modelled for ions having an energy in the field-free region between the mirrors of 6 keV.

FIG. 7 shows data for corresponding parameters to those shown in FIGS. 5A-5B, except that the data is modelled for ions having an energy in the field-free region between the mirrors of 3 keV, 4 keV and 5 keV.

FIG. 8 shows data for corresponding parameters to those shown in FIGS. 5A-5B, except that the data is modelled for ions being reflected in the mirrors five times and having an energy in the field-free region between the mirrors of between 4-10 keV.

FIG. 9 shows data for corresponding parameters to those shown in FIG. 8, except that the data is modelled for ions being reflected in the mirrors six times.

FIG. 10 shows data for corresponding parameters to those shown in FIGS. 5A-5B, except that the data is modelled for achieving a duty cycle of around 10%.

FIG. 11 shows data for corresponding parameters to those shown in FIGS. 5A-5B, for instruments having a medium size.

Although the present invention has been described with reference to preferred embodiments, it will be understood by those skilled in the art that various changes in form and detail may be made without departing from the scope of the invention as set forth in the accompanying claims.

The invention claimed is:

1. A multi-reflecting time of flight mass analyser comprising:

an ion accelerator;

two ion mirrors arranged for reflecting ions in a first dimension (x-dimension) and being elongated in a second dimension (z-dimension); and an ion detector;

wherein the ion accelerator is arranged and configured for accelerating ions into a first of the ion mirrors at an angle to the first dimension such that the ions are repeatedly reflected between the ion mirrors in the first dimension (x-dimension) as they travel in the second dimension (z-dimension) and wherein the ions are reflected at least four times by the ion mirrors;

wherein the ions are not spatially focussed in the second dimension (z-dimension) as they travel from the ion accelerator to the detector; and wherein the mass analyser has a duty cycle of ≥5%, a resolution of ≥20,000, wherein the distance in the first dimension (x-dimension) between points of reflection in the two ion mirrors is ≤1000 mm; and wherein the mass analyser is configured such that the ions travel a distance in the second dimension (z-dimension) from the ion accelerator to the detector of ≤700 mm.

2. The mass analyser of claim 1, wherein each mirror has at least four electrodes arranged and configured such that the first order time of flight focussing of ions is substantially independent of the position of the ions in the plane orthogonal to the first dimension (y-z plane).

3. The mass analyser of claim 1, coupled to an ion source for supplying said ions to the ion accelerator, wherein the ion source is arranged such that said ion accelerator receives ions from the ion source travelling in the second dimension (z-dimension).

4. The mass analyser of claim 1, wherein the distance in the second dimension (z-dimension) from the ion accelerator to the detector is one of: ≤650 mm; ≤600 mm; ≤550 mm; ≤500 mm; ≤480 mm; ≤460 mm; ≤440 mm; ≤420 mm; <400 mm; ≤380 mm; ≤360 mm; ≤340 mm; ≤320 mm; ≤300 mm; ≤280 mm; ≤260 mm; ≤240 mm; ≤220 mm; or ≤200 mm.

5. The mass analyser of claim 1, wherein the distance in the first direction (x-dimension) between points of reflection in the two ion mirrors is: ≤800 mm; ≤750 mm; ≤700 mm; ≤650 mm; ≤600 mm; ≤550 mm; ≤500 mm; ≤450 mm; or ≤400 mm.

6. The mass analyser of claim 1, wherein the ion accelerator, ion mirrors and detector are arranged and configured so that the ions are reflected at least x times by the ion mirrors as the ions travel from the ion accelerator to the detector;

wherein x is 5-6.

7. The mass analyser of claim 1, wherein the ions travel ≤650 mm in the second dimension (z-dimension) from the ion accelerator to the detector;

wherein the distance in the first direction (x-dimension) between points of reflection in the two ion mirrors is ≤750 mm; and wherein the ions are reflected only between 4 and 15 times by the ion mirrors as the travel from the ion accelerator to the detector.

8. The mass analyser of claim 1, wherein ions travel in the second dimension (z-dimension) with an energy of: ≤140 eV; ≤120 eV; ≤100 eV; ≤90 eV; ≤80 eV; ≤70 eV; ≤60 eV; ≤50 eV; ≤40 eV; ≤30 eV; ≤20 eV; or ≤10 eV.

9. The mass analyser of claim 1, wherein a region substantially free of electric fields is arranged between the ion mirrors such that when the ions are reflected between the ion mirrors they travel through said region; and wherein the ions have a kinetic energy E, when between the ion mirrors and/or in said region substantially free of electric fields;

wherein E is: ≥1 keV; ≥2 keV; ≥3 keV; ≥4 keV; ≥5 keV; ≥6 keV; ≥7 keV; ≥8 keV; ≥9 keV; ≥10 keV; ≥11 keV; ≥12 keV; ≥13 keV; ≥14 keV; or ≥15 keV.

10. The mass analyser of claim 1, coupled to an ion guide for guiding ions into the ion accelerator and a heater for heating said ion guide.

11. The mass analyser of claim 1, comprising a heater for heating electrodes of the ion accelerator.

12. The mass analyser of claim 1, coupled to a collimator for collimating the ions passing towards the ion accelerator, the collimator configured to collimate ions in the first dimension (x-dimension) and/or a dimension (y-dimension) orthogonal to both the first and second dimensions.

13. The mass analyser of claim 1, coupled to ion optics arranged and configured to expand the ion beam passing towards the ion accelerator in the first dimension (x-dimension) and/or a dimension (y-dimension) orthogonal to both the first and second dimensions.

14. The mass analyser of claim 1, coupled to an ion separator for separating ion spatially, or according to mass to charge ratio or ion mobility, in the second dimension (z-dimension) prior to the ions entering the ion accelerator.

15. A method of time of flight mass analysis comprising:

providing a mass analyser as claimed in claim 1; and controlling the ion accelerator so as to accelerate ions into the first ion mirror at an angle to the first dimension such that the ions are repeatedly reflected between the ion mirrors in the first dimension (x-dimension) as they travel in the second dimension (z-dimension), wherein the ions are reflected at least four times by the ion mirrors, wherein the distance in the first dimension (x-dimension) between points of reflection in the two ion mirrors is ≤1000 mm, wherein the ions travel a distance in the second dimension (z-dimension) from the ion accelerator to the detector of ≤700 mm, and wherein the ions are not spatially focussed in the second dimension (z-dimension) as they travel from the ion accelerator to the detector;

wherein the ions are detected by the detector and time of flight mass analysed with a duty cycle of ≥5% and a resolution of ≥20,000.

16. The mass analyser of claim 1, wherein substantially all of the ions that reach the detector have undergone the same number of ion mirror reflections.

17. A multi-reflecting time of flight mass analyser comprising:

an ion accelerator;

two ion mirrors arranged for reflecting ions in a first dimension (x-dimension) and being elongated in a second dimension (z-dimension);

an ion detector;

wherein the ion accelerator is arranged and configured for accelerating ions into a first of the ion mirrors at an angle to the first dimension such that the ions are repeatedly reflected between the ion mirrors in the first dimension (x-dimension) as they travel in the second dimension (z-dimension) and such that the ions are reflected at least four times by the ion mirrors; and wherein the ions are reflected so as to pass from one of the ion mirrors to the other of the ion mirrors n times, and wherein the ions are not spatially focussed in the second dimension (z-dimension) by periodic lenses during ≥60% of these n times; and wherein the mass analyser has a duty cycle of ≥5%, and a resolution of ≥20,000, wherein the distance in the first dimension (x-dimension) between points of reflection in the two ion mirrors is ≤800 mm, and wherein the mass analyser is configured such that the ions travel a distance in the second dimension (z-dimension) from the ion accelerator to the detector of ≤700 mm.

18. A method of time of flight mass analysis comprising:

providing a mass analyser as claimed claim 17; and controlling the ion accelerator so as to accelerate ions into the first ion mirror at an angle to the first dimension such that the ions are repeatedly reflected between the ion mirrors in the first dimension (x-dimension) as they travel in the second dimension (z-dimension), wherein the ions are reflected at least four times by the ion mirrors, wherein the ions are reflected so as to pass from one of the ion mirrors to the other of the ion mirrors n times, and wherein the ions are not spatially focused in the second dimension (z-dimension) during ≥60% of these n times.

* * * * *